US005553584A

United States Patent [19]

Konno

[11] Patent Number: 5,553,584

[45] Date of Patent: Sep. 10, 1996

[54] VALVE OPERATING DEVICE FOR INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 364,337

[22] Filed: Dec. 27, 1994

[30] Foreign Application Priority Data

| | | | |
|---|---|---|---|
| Dec. 24, 1993 | [JP] | Japan | 5-328417 |
| Dec. 24, 1993 | [JP] | Japan | 5-328420 |
| Dec. 28, 1993 | [JP] | Japan | 5-336613 |

[51] Int. Cl.[6] ..... F01L 13/00

[52] U.S. Cl. ..... 123/90.16; 123/90.44

[58] Field of Search ..... 123/90.15, 90.16, 123/90.17, 90.39, 90.4, 90.44

[56] References Cited

U.S. PATENT DOCUMENTS

| | | | |
|---|---|---|---|
| 4,612,884 | 9/1986 | Ajiki et al. | 123/90.16 |
| 4,727,831 | 3/1988 | Nagahiro et al. | 123/90.16 |
| 4,887,563 | 12/1989 | Ishida et al. | 123/90.16 |
| 5,042,437 | 8/1991 | Sakuragi et al. | 123/90.16 |
| 5,099,806 | 3/1992 | Murata et al. | 123/90.16 |

FOREIGN PATENT DOCUMENTS

| | | |
|---|---|---|
| 0291357 | 11/1988 | European Pat. Off. . |
| 0639694 | 2/1995 | European Pat. Off. . |
| 4212263 | 10/1993 | Germany . |
| 63-100210 | 5/1988 | Japan . |
| 3-75729 | 12/1991 | Japan . |
| 4-72403 | 3/1992 | Japan . |
| 4-38887 | 6/1992 | Japan . |
| 2197686 | 5/1988 | United Kingdom . |
| 2199079 | 6/1988 | United Kingdom . |

*Primary Examiner*—Weilun Lo
*Attorney, Agent, or Firm*—Lyon & Lyon

[57] ABSTRACT

An engine valve operating device includes rocker arms, cams on a cam shaft corresponding to the rocker arms, and a connection switchover device for switching over between the connection and disconnection of the rocker arms. The switchover device includes a piston slidably fitted into the first rocker arm operatively connected to an engine valve with one end facing a hydraulic pressure chamber, a pin slidably fitted into the second rocker arm adjacent the first rocker arm with one end abutting against the other end of the piston, a limiting mechanism slidably fitted into the third rocker arm operatively connected to another engine valve and adjoining the second rocker arm on the opposite side from the first rocker arm and which limiting mechanism abuts against the other end of the pin, and a spring biasing mechanism in the third rocker arm for biasing the limiting mechanism toward the pressure chamber. The pin and the limiting mechanism are displaced at two stages by the spring mechanism in response to a two-stage increase in the hydraulic pressure in the pressure chamber. The pin has an axial length such that with one axial end fitted into the first rocker arm, the other end is located between the second and third rocker arms.

2 Claims, 48 Drawing Sheets

VALVE OPERATING DEVICE FOR INTERNAL COMBUSTION ENGINE

BACKGROUND OF THE INVENTION

1. Field of the Invention

The present invention relates to a valve operating device for an internal combustion engine, which is capable of changing the operating characteristics of engine valves.

2. Description of the Prior Art

A valve operating device for an internal combustion engine has already been known, for example, from Japanese Patent Application Laid-open No. 100210/88, which includes a plurality of rocker arms disposed adjacent one another for swinging movement about a common axis, a plurality of cams provided on a cam shaft in independent correspondence to the rocker arms, and a connection switchover means capable of switching over the connection and disconnection of a combination of the rocker arms.

In the connection switchover means of such valve operating device, a hydraulic pressure is applied to a hydraulic pressure chamber from one axial direction of switchover members slidably fitted in the rocker arms and connected to one another, and the spring characteristic of a return spring acting in the other axial direction of the switchover members is changed at a plurality of stages in order to enable the sliding stroke of each switchover member to be switched over at a plurality of stages by switching over the hydraulic pressure applied to the hydraulic pressure chamber at a plurality of stages. However, in order to enable the connection and disconnection of the adjacent rocker arms to be switched over at each of the sliding strokes of the switchover members, each of the switchover members must be formed into a stepped configuration, resulting in a troublesome machining. Moreover, in the prior art device, the rocker arms are not in their connected states in a condition in which each of the switchover members has not been slid by hydraulic pressure. Therefore, if a free rocker arm capable of being freed relative to the engine valves is disposed between a pair of driving rocker arms operatively connected to the engine valves and corresponding to cams for substantially stopping the engine valves, when the connection switchover means has been brought into its inoperative state due to any cause in an operating range in which the engine valves should be driven by the free rocker arm, the free rocker arm cannot be connected to any of the driving rocker arms, and when the cams corresponding to the driving rocker arms are arranged to substantially stop the engine valves, the engine valves are also brought into their substantially stopped states.

In the above prior art device, all the switchover means are simultaneously operated in a switching manner and hence, the degree of freedom of the connection and disconnection of the rocker arms in combination is limited. In order to change the various operating characteristics of the engine valves, it is desirable to increase the degree of freedom of the connection and disconnection of the rocker arms in combination.

A valve operating device for an internal combustion engine has already been also known, for example, from Japanese Patent Publication No. 75729/91, which includes a driving rocker arm operatively connected to an engine valve, first and second free rocker arms adjacently disposed on opposite sides of the driving rocker arm, so that they can be freed relative to the engine valve, first and second cams provided on cam shaft in independent correspondence to the free rocker arms and having cam profiles intersecting each other, and connection switchover means capable of switching over the connection and disconnection of the driving rocker arm to and from the free rocker arms.

In this device, the engine valve is opened and closed relatively slowly in a high-speed operating range of the engine to insure a sufficient opening area desired by the engine, and the engine valve is opened and closed relatively rapidly in a low-speed operating range of the engine to insure a sufficient opening area desired by the engine, by switching over a state in which the first free rocker arm is connected to the driving rocker arm operatively connected to the engine valve to open and close the engine valve by the first cam and a state in which the second free rocker arm is connected to the driving rocker arm operatively connected to the engine valve to open and close the engine valve by the second cam. However, in switching over the state in which the driving rocker arm is connected to the first free rocker arm and the state in which the driving rocker arm is connected to the second free rocker arm, the switching operation should be completed at one timing when the first and second rocker arms have been stopped by base circle portions of the first and second cams. However, when both the connection switchover means have been brought into their connecting states at a displaced timing of switching, an abnormal behavior such as a valve jumping may be produced in the engine valve due to the intersection of the profiles of the first and second cams for swinging the first and second free rocker arms.

Further, a valve operating device for an internal combustion engine has already been known, for example, from Japanese Patent Publication No. 38887/92, which includes a rocker arm swingably carried on a rocker arm shaft and having a support sleeve integrally provided thereon with its inner surface put into sliding contact with an outer surface of the rocker arm shaft, another rocker arm swingably carried on the support sleeve, an engine valve operatively connected to at least one of the rocker arms, and a connection switchover means provided between the support sleeve and the other rocker arm and capable of switching the connection and disconnection of the rocker arms from one to another in response to the switching operation of a switchover piston having an axis perpendicular to an axis of the rocker arm shaft.

In such valve operating device, the switchover piston having the axis perpendicular to the axis of the rocker arm shaft is fitted into the support sleeve for sliding movement between a connecting position in which it is in with the rocker engagement arm carried on the support sleeve and the engagement with the rocker arm is released. For this reason, the support sleeve must be increased in size and correspondingly, the rocker arm swingably carried on the support sleeve is also increased in size, resulting in an increased inertial moment. When the rocker arm is being swung in the disconnecting state, a centrifugal force is applied to the switchover piston outwardly in a radial direction of the rocker arm shaft and hence, when the spring force of a return spring for biasing the switchover piston toward a disconnecting position is small, a tip end of the switchover piston is urged against an inner surface of the rocker arm by such centrifugal force, resulting in an increased wear between the switchover piston and the support sleeve. If the spring force of the return spring is increased, the hydraulic pressure force applied to the switchover piston during connection must be increased. In a high-speed rotational range, it is difficult to overcome the wear problem even by the increase in spring force of the return spring.

A connection switchover means having an operating axis perpendicular to an axis of the rocker arm shaft is disclosed in Japanese Patent Application Laid-open No. 72403/92. In this connection switchover means, a pair of rocker arms are adjacently disposed on opposite sides of a rocker arm integral with a rocker arm shaft to abut against cams having different profiles, and connection switchover means provided between the rocker arm shaft and the rocker arms disposed on the opposite sides, respectively. In this connection switchover means, a problem of an increase in size of the rocker arms and a problem of a wear are not arisen, but a combination of the rocker arm integral with the rocker arm shaft and the rocker arms disposed on the opposite sides of such rocker arm is disposed for every cylinder and hence, in a multi-cylinder internal combustion engine, hydraulic pressure circuits leading to oil passage provided in the rocker arm shafts in cylinders must be provided in a cylinder head, resulting in a complicated arrangement of the hydraulic pressure circuits in the cylinder head.

SUMMARY OF THE INVENTION

Accordingly, it is a first object of the present invention to insure a state in which at least one of rocker arms connected to engine valves is connected to a further rocker arm located between these rocker arms, in addition to the simplification of the switchover member.

It is a second object of the present invention to increase the degree of freedom of connection and disconnection of the rocker arms in combination.

To achieve the first object, according to a first aspect and feature of the present invention, there is provided a valve operating device for an internal combustion engine, comprising a plurality of rocker arms adjacently disposed for swinging movement about a common axis, a plurality of cams provided on a cam shaft in independent correspondence to the rocker arms, and a connection switchover means capable of switching over between the connection and disconnection of the rocker arms in combination, wherein the connection switchover means includes a switchover piston slidably fitted into the first rocker arm operatively connected to an engine valve with one end facing a hydraulic pressure chamber, a switchover pin slidably fitted into the second rocker arm adjacent the first rocker arm with one end abutting against the other end of the switchover piston, a limiting mechanism which is slidably fitted into the third rocker arm operatively connected to another engine valve and adjoining the second rocker arm on the opposite side from the first rocker arm and which abuts against the other end of the switchover pin, and a spring biasing mechanism provided in the third rocker arm for biasing the limiting mechanism toward the hydraulic pressure chamber by a spring force which enables the sliding stroke of each of the switchover piston, the switchover pin and the limiting member to be changed at two stages in response to increasing of the hydraulic pressure at two stages in the hydraulic pressure chamber, the switchover pin having an axial length such that in a condition in which one axial end thereof has been fitted into one of the first and second rocker arms, the other axial end thereof is located between the other of the first and third rocker arms and the second rocker arm.

With the first feature of the present invention, it is possible not only to simplify the shape of the switchover pin to facilitate the machining thereof, but also to necessarily connect at least one of the first and third rocker arms operatively connected to the engine valve to the intermediate rocker arm. Therefore, even if the cams corresponding to the first and third rocker arms are arranged to substantially stop the engine valves, both the engine valves cannot be brought into their stopped state, irrespective of the operated state of the connection switchover means.

To achieve the second object, according to a second aspect and feature of the present invention, there is provided a valve operating device for an internal combustion engine, comprising a plurality of rocker arms adjacently disposed for swinging movement about a common axis, a plurality of cams provided on a cam shaft in independent correspondence to the rocker arms, and a connection switchover means capable of switching over the connection and disconnection of the rocker arms in combination, wherein the connection switchover means includes a switchover piston fitted into one of the rocker arms on one side in a direction of adjacent arrangement of them with one end facing a hydraulic pressure chamber, a limiting member slidably fitted into one of the rocker arms on the other side in the direction of adjacent arrangement of them, a return spring for biasing the limiting member toward the one side in the direction of adjacent arrangement, and switchover pins fitted into intermediate two of the rocker arms in the direction of adjacent arrangement of them and disposed between the switchover piston and the limiting member, at least one of the switchover pins fitted into the intermediate rocker arms comprising a pair of pin members, and a spring interposed between the pin members for biasing the pin members away from each other by a spring force smaller than that of the return spring.

With the second feature of the present invention, it is possible to increase the degree of freedom of the connection and disconnection of the rocker arms in combination, and to change the various operating characteristics of the engine valves more by properly selecting the dispositions of the cams and the engine valves relative to the rocker arms.

Further, to achieve the second object, according to a third aspect and feature of the present invention, there is provided a valve operating device for an internal combustion engine, comprising a plurality of rocker arms adjacently disposed for swinging movement about a common axis, a plurality of cams provided on a cam shaft in independent correspondence to the rocker arms, and a connection switchover means capable of switching over the connection and disconnection of the rocker arms in combination, wherein the connection switchover means includes a first switchover piston fitted into one of the rocker arms on one side in a direction of adjacent arrangement of them with its outer end facing a first hydraulic pressure chamber, a second switchover piston fitted into one of the rocker arms on the other side in the direction of adjacent arrangement of them with its outer end facing a second hydraulic pressure chamber, a first switchover member fitted into intermediate one of the rocker arms in the direction of adjacent arrangement of them and connected to the first switchover piston, a second switchover member fitted into the intermediate rocker arm and connected to the second switchover piston, and a return spring interposed between the first and second switchover members.

With the third feature of the present invention, it is possible to increase the degree of freedom of the connection and disconnection of the rocker arms in combination and to change the operating characteristics of the engine valves variously by properly selecting the dispositions of the cams and the engine valves relative to the rocker arms.

It is a third object of the present invention to avoid the connection of the driving rocker arm to both the first and second free rocker arms to prevent an abnormal behavior such as a valve jumping from being produced.

To achieve the above third object, according to a fourth aspect and feature of the present invention, there is provided a valve operating device for an internal combustion engine, comprising a driving rocker arm operatively connected to an engine valve, first and second free rocker arm disposed on opposite sides of the driving rocker arm, so that they can be freed relative to the engine valve, first and second cams provided on a cam shaft in independent correspondence to the free rocker arms and having cam profiles intersecting each other, and a connection switchover means capable of switching over the connection and disconnection of the driving rocker arm to and from the free rocker arms, wherein the device further includes a third cam provided on the cam shaft in correspondence to the driving rocker arm and having a cam profile with the valve lift amount and opening angle being smaller than those provided by the first and second cams, and the connection switchover means includes a switchover pin slidably fitted into the driving rocker arm and formed shorter than the distance between those sides of the first and second free rocker arms which are opposed to the driving rocker arm, a first biasing mechanism disposed in the first free rocker arm and capable of exhibiting a biasing force for biasing the switchover pin in an axial one direction, and a second biasing mechanism disposed in the second free rocker arm and capable of exhibiting a biasing force for biasing the switchover pin in an axial other direction.

With the fourth feature of the present invention, it is possible to reliably avoid the connection of both the first and second free rocker arms to the driving rocker arms to prevent an abnormal behavior such as a valve jumping to be produced in the engine valve, and to open and close the engine valves by the third cam in a condition in which both the free rocker arms are not connected to the driving rocker arm.

Further, to achieve the above third object, according to a fifth aspect and feature of the present invention, there is provided a valve operating device for an internal combustion engine, comprising a driving rocker arm operatively connected to an engine valve, first and second free rocker arm disposed on opposite sides of the driving rocker arm, so that they can be freed relative to the engine valve, first and second cams provided on a cam shaft in independent correspondence to the free rocker arms and having cam profiles intersecting each other, and a connection switchover means capable of switching over the connection and disconnection of the driving rocker arm to and from the free rocker arms, wherein the device further includes a third cam provided on the cam shaft in correspondence to the driving rocker arm and having a cam profile with the valve lift amount and opening angle being smaller than those provided by the first and second cams, and the connection switchover means includes a switchover piston slidably fitted into the first free rocker arm, so that it can be fitted into the driving rocker arm in response to the application of a first hydraulic pressure force, a first limiting member slidably fitted into the driving rocker arm and capable of abutting against the first limiting member, a return spring interposed between both the limiting members for exhibiting a spring force for biasing the first and second limiting members away from each other, and a second switchover piston which is slidably fitted into the second free rocker arm, so that it can be fitted into the driving rocker arm in response to the application of a second hydraulic pressure force different from the first hydraulic pressure force, and which is put into abutment against the second limiting member.

With the fifth feature of the present invention, it is possible to reliably avoid the connection of both the first and second free rocker arms to the driving rocker arms to prevent an abnormal behavior such as a valve jumping to be produced in the engine valve, and to open and close the engine valves by the third cam in a condition in which both the free rocker arms are not connected to the driving rocker arm.

It is a fourth object of the present invention to provide a valve operating device for an internal combustion engine, wherein it is possible to enable a decrease in inertial moment and a reduction in size of the rocker arms and to prevent a reduction in durability of the rocker arms and moreover, it is possible to enable simplification of the hydraulic pressure circuit.

To achieve the above fourth object, according to a sixth aspect and feature of the present invention, there is provided a valve operating device for an internal combustion engine, comprising a rocker arm swingably carried on a rocker arm shaft and having a support sleeve integrally provided thereon with its inner surface put into sliding contact with an outer surface of the rocker arm shaft, other rocker arms swingably carried on the support sleeve, an engine valve operatively connected to at least one of the other rocker arms, and connection switchover means provided between the support sleeve and the other rocker arms and capable of switching the connection and disconnection of the rocker arms in response to the switching operation of a switchover piston having an axis perpendicular to an axis of the rocker arm shaft, wherein each of the rocker arms swingably carried on the support sleeve is provided with a guide portion having a guide bore which has an axis perpendicular to the axis of the rocker arm shaft and which is closed at its outer end; the support sleeve is provided with an engage bore which is coaxially connected to an inner end of the guide bore when each of the rocker arms is in its stopped state, and the connection switchover means includes a switchover piston fitted into the guide bore for sliding movement between a connecting position in which one end faces a hydraulic pressure chamber leading to an oil passage provided in the rocker arm shaft, and the other end is fitted into the engage bore, and a disconnecting position in which the other end is disengaged from the engage bore, and a return spring provided between the switchover piston and the guide portion for exhibiting a spring force for biasing the switchover piston toward the disconnecting position.

With the sixth feature of the present invention, it is possible to prevent a wear from being produced between the switchover piston and the support sleeve, and to form the support sleeve at a relatively thin wall thickness to reduce the weight of the rocker arm integral with the support sleeve, to reduce the size of the rocker arm carried on the support sleeve and to reduce the weight of the rocker arm, and to decrease the inertial moment to provide an increase in rotation. Moreover, even in a multi-cylinder internal combustion engine, the oil passage common to the cylinders is provided in the rocker arm shaft and therefore, it is possible to simplify the hydraulic pressure circuit.

In addition to the sixth feature, according to a seventh feature of the present invention, the guide bore comprises an axially inner small-diameter bore portion having the same diameter as the engage bore leading to the oil passage in the rocker arm shaft, and a large-diameter bore portion coaxially connected to the small-diameter bore portion through a step and closed at its outer end, and the switchover piston is formed into a hollow cylindrical configuration comprising a small-diameter cylindrical portion slidably fitted into the small-diameter bore portion, and a large-diameter cylindrical portion slidably fitted into the smaller diameter bore portion to define a hydraulic pressure chamber between the large-diameter cylindrical portion and the outer closed end of the guide bore and coaxially connected to an outer end of the small-diameter cylindrical portion.

With the seventh feature, an oil passage connecting the oil passage in the rocker arm shaft and the hydraulic pressure chamber is not required and hence, it is possible to simplify the construction to reduce the number of machining steps.

Yet further, to achieve the fourth object, according to an eighth aspect and feature of the present invention, there is provided a valve operating device for an internal combustion engine, comprising a rocker arm slidably fitted into a rocker arm shaft and having a support sleeve integrally provided thereon with its inner surface put into sliding contact with an outer surface of the rocker arm shaft, other rocker arms swingably carried on the support sleeve, an engine valve operatively connected to at least one of the other rocker arms, and connection switchover means provided between the support sleeve and the other rocker arms and capable of switching over the connection and disconnection of the rocker arms in response to the switching operation of a switchover piston having an axis perpendicular to an axis of the rocker arm shaft, wherein the support sleeve is provided with an engage bore having an axis perpendicular to the axis of the rocker arm shaft and leading to an oil passage provided in the rocker arm shaft, the rocker arm swingably carried on the support sleeve is provided with a guide portion having a guide bore which is coaxially connected to the engage bore when each of the rocker arms is in its stopped state, and the connection switchover means includes a switchover piston slidably fitted into the guide bore for sliding movement between a connecting position in which one end is fitted into the engage bore, so that the one end can receive a hydraulic pressure from the oil passage in the rocker arm shaft, and a disconnecting position in which the one end is disengaged from the engage bore, and a return spring provided between the switchover piston and the guide portion for exhibiting a spring force for biasing the switchover piston toward the connecting position.

With the eighth feature, it is possible to prevent a wear from being produced between the switchover piston and the rocker arm shaft, and to form the support sleeve at a relatively thin wall thickness to reduce the weight of the rocker arm integral with the support sleeve, to reduce the size of the rocker arm carried on the support sleeve and to reduce the weight of the rocker arm, and to decrease the inertial moment to provide an increase in rotation. Moreover, even in a multi-cylinder internal combustion engine, the oil passage common to the cylinders is provided in the rocker arm shaft and therefore, it is possible to simplify the hydraulic pressure circuit.

The above and other objects, features and advantages of the invention will become apparent from the following description of the preferred embodiments taken in conjunction with the accompanying drawings.

BRIEF DESCRIPTION OF THE DRAWINGS

FIGS. 1 to 3 illustrate a first embodiment of the present invention, wherein FIG. 1 is a vertical sectional side view of the first embodiment, taken along a line 1—1 in FIG. 2;

FIG. 2 is a plan view taken along a line 2—2 in FIG. 1;

FIG. 3 is a sectional view taken along a line 3—3 in FIG. 1;

FIGS. 17 to 20 illustrate an eleventh embodiment of the present invention, wherein FIG. 17 is a vertical sectional side view of the eleventh embodiment;

FIG. 18 is a plan view taken along a line 18—18 in FIG. 17;

FIG. 19 is a sectional view taken along a line 19—19 in FIG. 17;

FIG. 20 is a diagram illustrating a combination of cam profiles.

FIGS. 21 and 22 illustrate a twelfth embodiment of the present invention, wherein FIG. 21 is a sectional view similar to FIG. 19;

FIG. 22 is a diagram illustrating a combination of cam profiles.

FIGS. 32 to 34 illustrate an eighteenth embodiment of the present invention, wherein FIG. 32 is a vertical sectional side view of the eighteenth embodiment;

FIG. 33 is a sectional view taken along a line 33—33 in FIG. 32;

FIG. 34 is a sectional view taken along a line 34—34 in FIG. 32;

FIG. 35 is a cross-sectional plan view of a nineteenth embodiment of the present invention, wherein

FIG. 37 is a cross-sectional plan view of a twentieth embodiment of the present invention, wherein

FIG. 39 is a cross-sectional plan view of a 21st embodiment of the present invention, wherein

FIG. 41 is a cross-sectional plan view of a 22nd embodiment of the present invention, wherein

FIG. 43 is a cross-sectional plan view of a 23rd embodiment of the present invention, wherein

DESCRIPTION OF THE PREFERRED EMBODIMENTS

The present invention will now be described by way of preferred embodiments with reference to the accompanying drawings.

Figure 1:
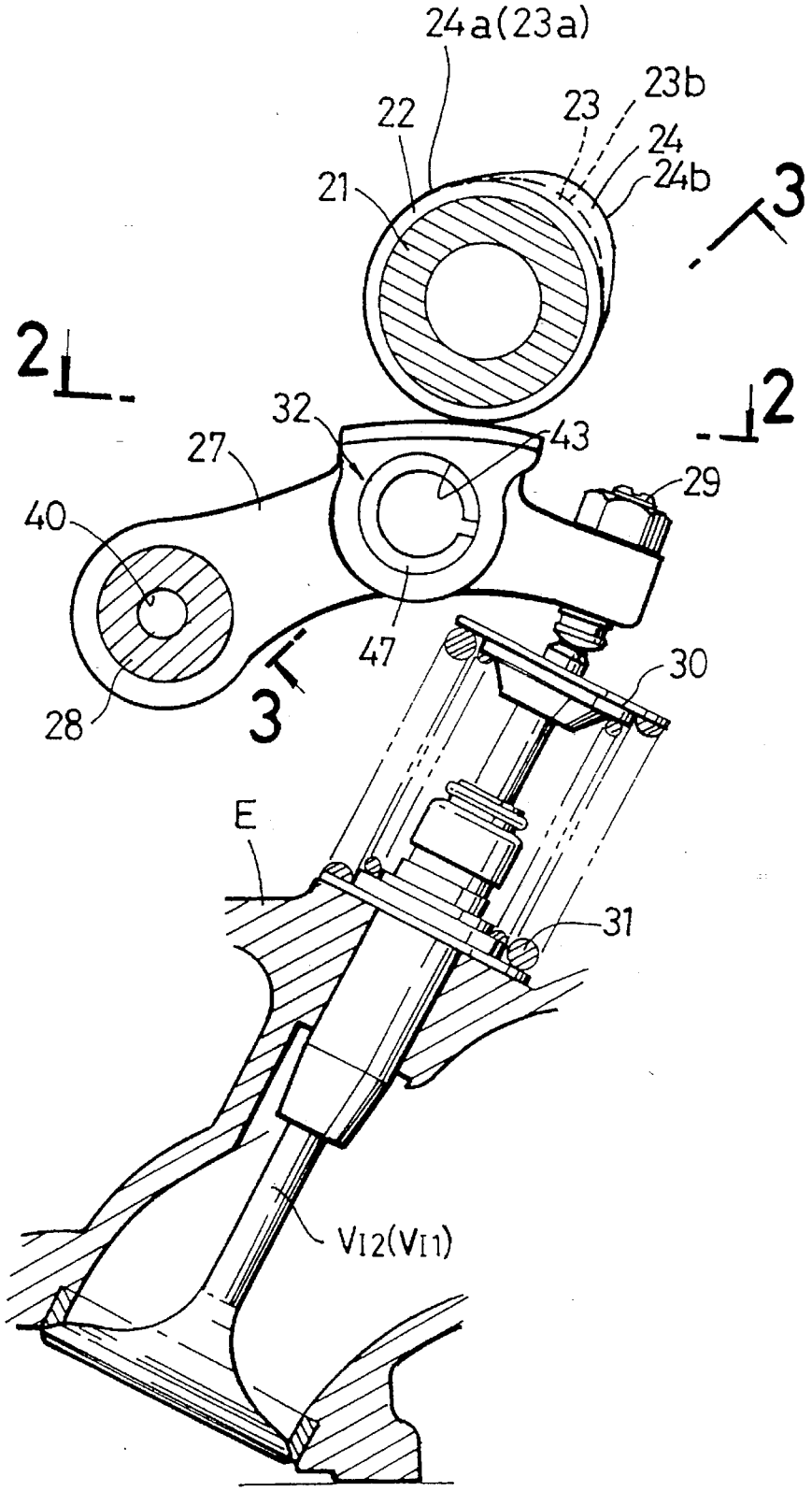
Figure 2:
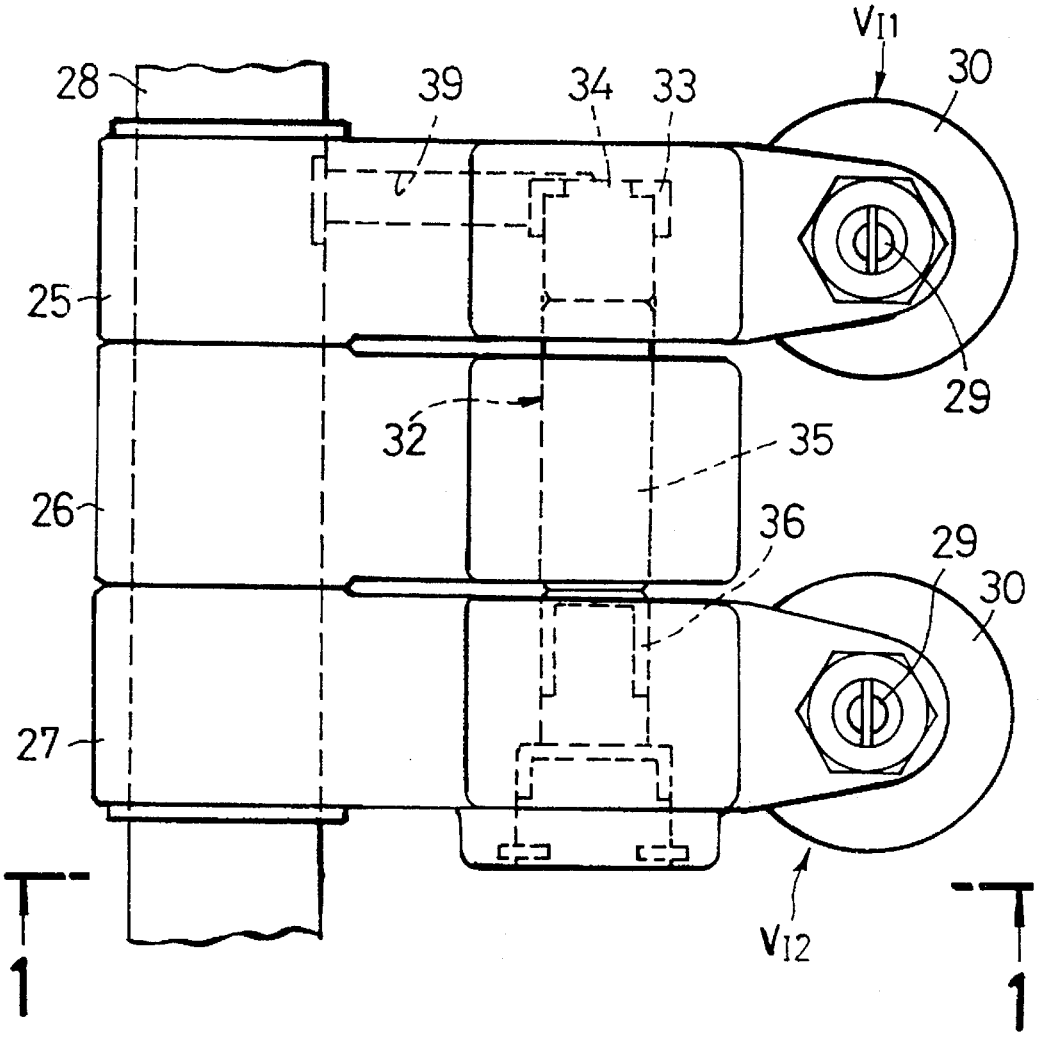
Figure 3:
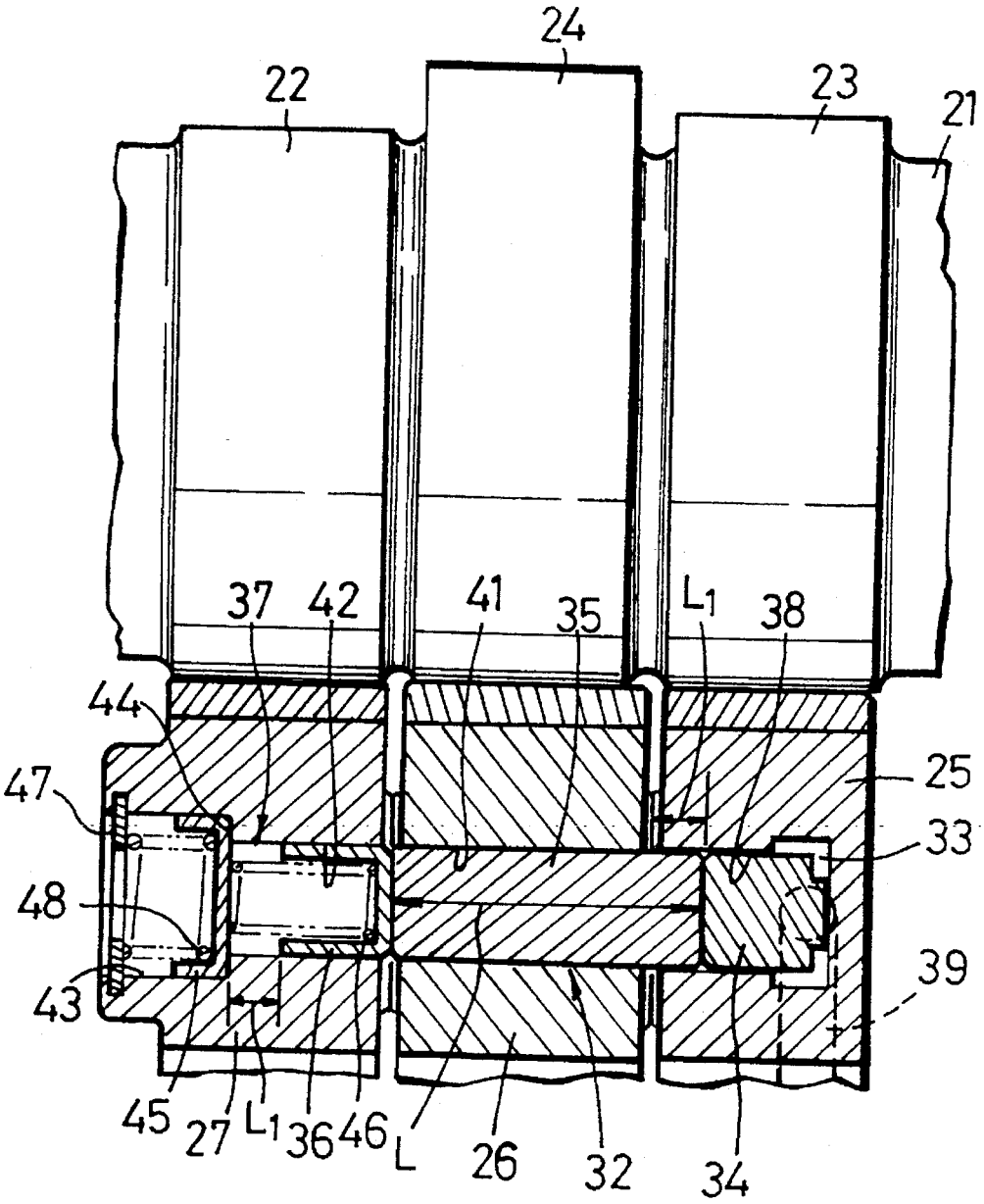

FIGS. 1 to 3 illustrate a first embodiment of the present invention. FIG. 1 is a vertical sectional view of the first embodiment taken along a line 1—1 in FIG. 2; FIG. 2 is a plan view taken along a line 2—2 in FIG. 1; and FIG. 3 is a sectional view taken along a line 3—3 in FIG. 1.

Intake valves $V_{I1}$ and $V_{I2}$ as a pair of engine valves are provided in an engine body E and opened and closed by the actions of a circular portion or valve stopping cam 22, a low valve lift or substantially stopping cam 23 and a high valve lift or operating cam 24 which are integrally provided on a cam shaft 21 driven at a rotational ratio of ½ synchronously with the rotation of an engine crankshaft (not shown), and first, second and third rocker arms 25, 26 and 27 which are disposed adjacent to one another for swinging movement about a common swinging axis parallel to the cam shaft 21.

The cam shaft 21 is rotatably disposed at an upper portion of the engine body E and is integrally provided with the stopping cam 22, the substantially stopping cam 23 and the operating cam 24 in such a manner that the operating cam 24 is sandwiched between the stopping cam 22 and the substantially stopping cam 23. Thus, the stopping cam 22 has a substantially circular profile which permits the intake valve $V_{I2}$ to be closed and stopped, and is formed into a shape spaced at a constant distance apart from the axis of the cam shaft 21. The operating cam 24 has a base circle portion **24*a* having the same radius as the stopping cam 22, and a cam lobe 24*b* protruding radially outwardly from the base circle portion 24*a*. The substantially stopping cam 23 has a low valve lift profile permitting the intake valve $V_{I1}$ to be substantially stopped and includes a base circle portion 23*a* corresponding to the base circle portion 24*a* of the operating cam 24, and a cam lobe 23*b* slightly protruding radially outwardly from the base circle portion 23*a* at a location corresponding to the cam lobe 24*b* of the operating cam 24**.

The first, second and third rocker arms 25, 26 and 27 are disposed adjacently to one another with the second rocker arm 26 being sandwiched between the first and third rocker arms 25 and 27, and are swingably carried on a common rocker arm shaft 28 which is rotatably carried on the engine body below the cam shaft 21. Moreover, the substantially stopping cam 23 is provided on the cam shaft 21 in correspondence to the first rocker arm 25; the operating cam 24 is provided on the cam shaft 21 in correspondence to the second rocker arm 26, and the stopping cam 22 is provided on the cam shaft 21 in correspondence to the third rocker arm 27.

The first and third rocker arms 25 and 27 extend to positions above the pair of intake valves $V_{I1}$ and $V_{I2}$, and tappet screws 29, 29 are advanceably and retractably threadedly inserted into ends of the first and third rocker arms 25 and 27 and are capable of abutting against upper ends of the intake valves $V_{I1}$ and $V_{I2}$, respectively. A collar 30 is provided at an upper portion of each of the intake valves $V_{I1}$ and $V_{I2}$, and valve springs 31 are interposed between the collars 30, 30 and the engine body E to surround the intake valves $V_{I1}$ and $V_{I2}$, respectively, so that the intake valves $V_{I1}$ and $V_{I2}$ are biased in their closing directions, i.e., upwardly by the action of the valve springs 31. Further, the second rocker arm 26 is resiliently biased in a direction to contact with the operating cam 24 by a lost motion mechanism (not shown) provided between the second rocker arm 26 itself and the engine body E.

The connection and disconnection between the first, second and third rocker arms 25, 26 and 27 in combination are switched over by a connection switch-over means 32. The connection switchover means 32 includes a switchover piston 34 slidably connected to the first rocker arm 25 with one end facing a hydraulic pressure chamber 33, a switchover pin 35 slidably fitted into the second rocker arm 26 with one end abutting against the other end of the switchover piston 34, and a limiting mechanism that includes a limiting member 36 slidably fitted into the third rocker arm 27 to abut against the other end of the switchover pin 35, and a spring biasing mechanism 37 provided on the third rocker arm 27 for biasing the limiting member 36 toward the hydraulic pressure chamber 33 by a spring force which enables the sliding stroke of each of the switchover pin 35 and the limiting member 36 to be changed at two stages.

A bottomed guide hole 38 is provided in the first rocker arm 35 in parallel to the rocker arm shaft 28 and opens toward the second rocker arm 26, and the switchover piston 34 is slidably fitted in the guide hole 38 to define the hydraulic pressure chamber 33 between the one end of the switchover piston 34 and a closed end of the guide hole 38. Moreover, the axial length of the switchover piston 34 is determined so that the other end of the switchover piston 34 is located at a position retracted from the position between the first and second rocker arms 25 and 26 in the direction toward the pressure chamber 33 in a condition in which the switchover piston 34 has been slid to a position where the volume of the hydraulic pressure chamber 33 is minimized, as shown in FIG. 3. A communication passage 39 is also provided in the first rocker arm 25 to communicate with the hydraulic pressure chamber 33, and an oil passage 40 (see FIG. 1) is provided in the rocker arm shaft 28 to normally communicate with the communication passage 39 and thus with the hydraulic pressure chamber 33, irrespective of the swinging state of the first rocker arm 25.

A guide bore 41 is provided in the second rocker arm 26 in parallel to the rocker arm shaft 28 and opens at opposite ends thereof in correspondence to the guide hole 38 and guide bore 42 (described below), and the column-shaped switchover pin 35 is slidably fitted in the guide bore 41. Moreover, the axial length L of the switchover pin 35 is determined so that its one axial end is fitted by a distance $L_1$ into the guide hole 38 in the first rocker arm 25 when, the other end thereof is located at an intermediate position between the third and second rocker arms 27 and 26, as shown in FIG. 3.

A small-diameter guide bore 42 opposed to the guide bore 41 and a large-diameter guide bore 43 are provided in the third rocker arm 27 in the named order from the side of the second rocker arm 26 and in parallel to the rocker arm shaft 28. The large-diameter guide bore 43 is coaxially connected to the small-diameter guide bore 42 through a step 44. The limiting member 36 formed into a bottomed cylinder-like configuration is slidably fitted into the small-diameter guide bore 42.

The spring biasing mechanism 37 includes an auxiliary limiting member 45 formed into a bottomed cylinder-like shape and slidably fitted in the large-diameter guide bore 43 in the third rocker arm 27, a first return spring 46 mounted under compression between the limiting member 36 and the auxiliary limiting member 45, and a second return spring 48 mounted under compression between the auxiliary limiting member 45 and a stopping ring 47 fitted in the large-diameter guide bore 43 at a location near its outer end. The spring force of the second return spring 48 is set larger than the spring force of the first return spring 46. The limiting member 36 whose surface abutting against switchover pin 35 corresponds to the intermediate location between the second and third rocker arms 26 and 27 is spaced, at a distance equal to the distance $L_1$ of the fitting of the switchover pin 35 into the first rocker arm 25, apart from the auxiliary limiting member 45 which is in abutment against the step 44.

The operation of the first embodiment will be described below. In a condition in which the hydraulic pressure in the hydraulic pressure chamber 33 has been released, the switchover piston 34, the switchover pin 35 and the limiting member 36 are in their states in which they have been moved to the maximum toward the hydraulic pressure chamber 33 by the spring force exhibited by the spring biasing mechanism 37, with one end of the switchover pin 35 being received in the guide hole 38, and with the surface of the limiting member 36 abutting against the other end of the switchover pin 35 being located between the second and third rocker arms 26 and 27. Thus, the first and second rocker arms 25 and 26 are in their interconnected states in which one of the intake valves $V_{I1}$ is opened and closed with a characteristic corresponding to the profile of the operating cam 24, while the second and third rocker arms 26 and 27 are in their disconnected states in which the other intake valve $V_{I2}$ is brought into a closed and stopped state by the stopping cam 22.

If a relatively low hydraulic pressure enough to overcome the spring force of the first return spring 46 of the spring biasing mechanism 37 is then applied to the hydraulic pressure chamber 33, the switchover piston 34 is moved by the distance $L_1$ by compressing the first return spring 46, until it causes the limiting member 36 to abut against the auxiliary limiting member 45 which is in abutment against the step 44. This causes the abutting surfaces of the one end of the switchover pin 35 and the switchover piston 34 to be located between the first and 2nd rocker arms 25 and 26, and causes the other end of the switchover pin 35 to be received into the small-diameter guide hole 42. Thus, the first and second rocker arms 25 and 26 are brought into their disconnected states in which the one intake valve $V_{I1}$ is brought into a substantially stopped or low valve lift state by the substantially stopping cam 23, while the other intake valve $V_{I2}$ is opened and closed with a characteristic corresponding to the profile of the operating cam 24 in response to the connection of the second and third rocker arms 26 and 27.

If a relatively high hydraulic pressure enough to overcome the spring forces of the first and second return springs 46 and 48 of the spring biasing mechanism 37 is further applied to the hydraulic pressure chamber 33, the switchover piston 34 is moved until it compresses the first return spring 46 to further force the limiting member 36 in abutment against the auxiliary limiting member 45 into the large-diameter guide bore 43, so that the end of the switchover piston 34 is fitted into the guide bore 41 in the second rocker arm 26, and the switchover pin 35 is further forced into the small-diameter guide bore 42. Thus, the first, second and third rocker arms 25, 26 and 27 are connected together, so that both the intake valves $V_{I1}$ and $V_{I2}$ are opened and closed with the characteristic corresponding to the operating cam 24.

With such valve operating device, at least one of the first and third rocker arms 25 and 27 connected to the intake valves $V_{I1}$ and $V_{I2}$ is connected to the second rocker arm 26, and even if the connection switchover means 32 is inoperative for any reason, both the intake valves $V_{I1}$ and $V_{I2}$ cannot be brought into their substantially stopped state and stopped state, respectively, at the same time. The switchover pin 35 may have a columnar simple shape and hence, is easy to machine.

In the above-described first embodiment, a substantially circular profile or stopping cam 22 may be used in place of the substantially stopping cam 23 and even in this case, a similar effect can be provided.

Figure 4:
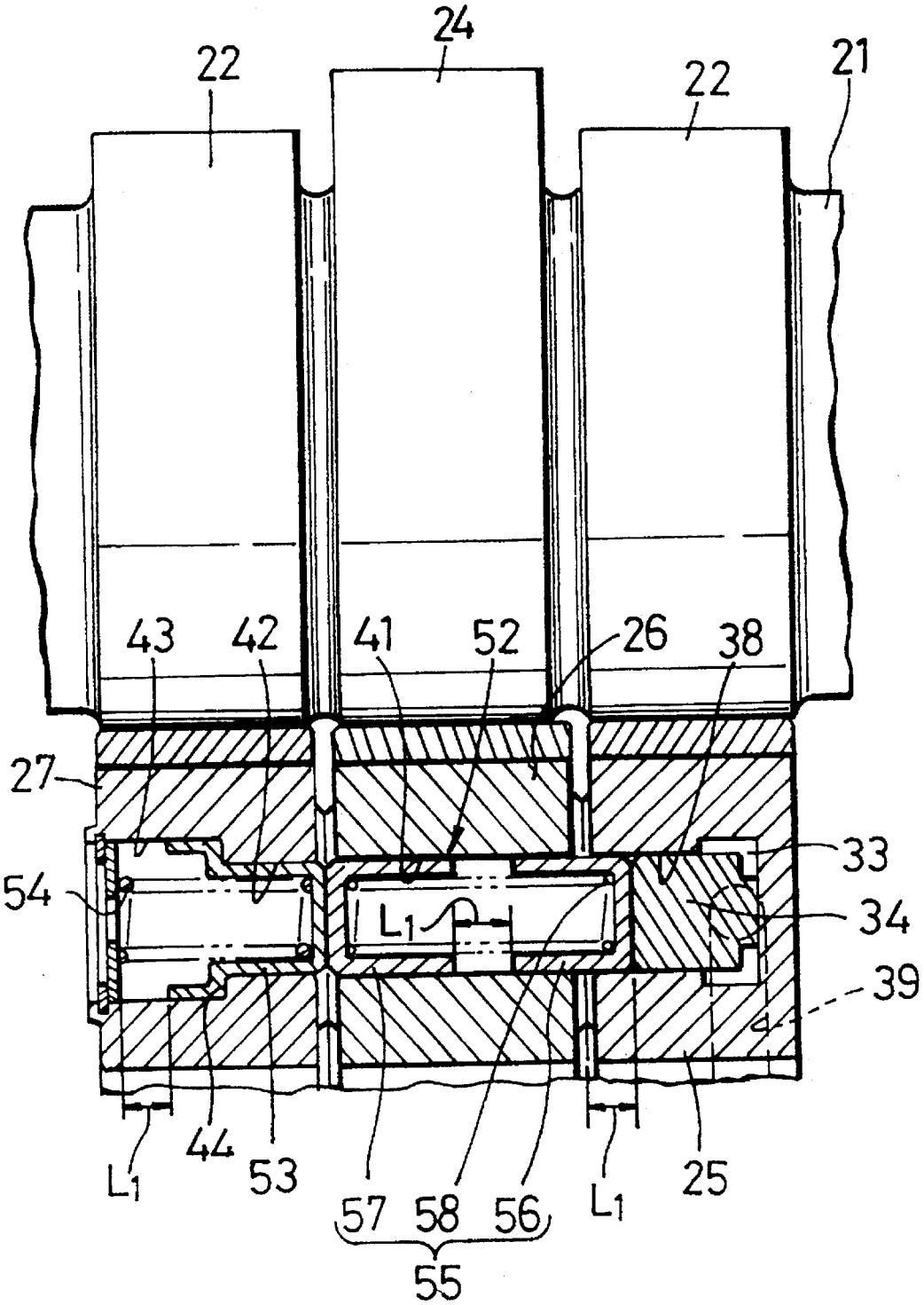
FIG. 4 is a sectional view similar to FIG. 3, but illustrating a second embodiment of the present invention.

FIG. 4 illustrates a second embodiment of the present invention, wherein portions or components corresponding to those in the above-described first embodiment are designated by like reference characters.

Stopping cams 22, 22 of a substantially circular profile are provided on a cam shaft 21 in correspondence to first and third rocker arms 25 and 27 operatively connected to intake valves $V_{I1}$ and $V_{I2}$ (see FIGS. 1 and 2), and an operating cam 24 is provided on the cam shaft 21 in correspondence to a second rocker arm 26.

The connection and disconnection of the first, second and third rocker arms 25, 26 and 27 in combination are switched over by a connection switchover means 52. The connection switchover means 52 includes a switchover piston 34 fitted into one of the rocker arms 25, 26 and 27 located on one side in the direction of adjacent arrangement thereof, i.e., into the first rocker arm 25 with one end thereof facing a hydraulic pressure chamber 33, and a mechanism including a limiting member 53 slidably fitted into another of the rocker arms 25, 26 and 27 located on the other side in the direction of adjacent arrangement thereof, i.e., into the third rocker arm 27, a return spring 54 for biasing the limiting member 53 toward the one side in the direction of adjacent arrangement, i.e., toward the first rocker arm 25, and a switchover pin 55 fitted into an intermediate one of the adjacently arranged rocker arms 25, 26 and 27, i.e., into the second rocker arm 26 and disposed between the switchover piston 34 and the limiting member 53.

Moreover, the axial length of the switchover piston 34 is determined so that the other end of the switchover piston 34 is located at a position in which it has been retracted from the position between the first and second rocker arms 25 and 26 in the direction toward the guide hole 38 in a condition in which the piston 34 has been slid to a position to minimize the volume of the hydraulic pressure chamber 33, as shown in FIG. 4. The limiting member 53 is fitted in the small-diameter guide bore 42 and the large-diameter fitting bore 43 provided in the third rocker arm 27. The end of forward movement of the limiting member 53 by the action of the return spring 54 is defined by abutment of the limiting member 53 against the step 44 between the small-diameter guide bore 42 and the large-diameter fitting bore 43 and in such state, one end of the limiting member 53 is located at the intermediate position between the second and third rocker arms 26 and 27.

The switchover pin 55 includes a first bottomed cylindrical pin member 56 slidably fitted in the guide bore 41 in the second rocker arm 26 to abut against the switchover piston 34, a second bottomed cylindrical pin member 57 slidably fitted in the guide bore 41 in the second rocker arm 26 to abut against the limiting member 53, and a spring 58 mounted under compression between both the pin members 56 and 57. The spring 58 exhibits a smaller spring force than the spring force of the return spring 54 to bias the pin members 56 and 57 away from each other.

Moreover, the first pin member 56 has a length such that it has been fitted in the guide hole 38 in the first rocker arm 25 by the distance $L_1$ and spaced at the distance $L_1$ apart from the second pin member 57 in abutment against the limiting member 53, when the switchover piston 34 is in the position to minimize the volume of the hydraulic pressure chamber 33 and the limiting member 53 is in abutment against the step 44. The limiting member 53 is retreatable by the distance $L_1$ from the position in which it is in abutment against the step 44.

The operation of the second embodiment will be described below. In a condition in which the hydraulic pressure has been released, the switchover piston 34 is in the position to minimize the volume of the hydraulic pressure chamber 33 and the limiting member 53 is located at the end of forward movement to abut against the step 44, under the spring forces of the return spring 53 and the spring 58. In this state, the second pin member 57 of the switchover pin 55 is located in the position in which the surface abutting against the limiting member 53 corresponds to the intermediate location between the second and third rocker arms 26 and 27, and under the spring force of the spring 58 mounted under compression between the first and second pin members 56 and 57, the first pin member 56 is in the position in which the one end thereof has been fitted into the guide hole 38 in the first rocker arm 25 and the other end thereof has been fitted into the guide bore 41 in the second rocker arm 26. Therefore, the first and second rocker arms 25 and 26 are interconnected, but the second and third rocker arms 26 and 27 are in their disconnected states, so that one of the intake valves $V_{I1}$ is opened and closed with the characteristic corresponding to the profile of the operating cam 24, and the other intake valve $V_{I2}$ is brought into its stopped state by the stopping cam 22.

If a relatively low hydraulic pressure enough to overcome the spring force of the spring 58 is then applied to the hydraulic pressure chamber 33, the switchover piston 34 compresses the spring 59 to urge the first pin member 56, so that the first pin member 56 is moved by the distance $L_1$ until it abuts against the second pin member 57. In this state, the abutting surfaces of the switchover piston 34 and the first pin member 56 are at the position corresponding to the intermediate location between the first and second rocker arms 25 and 26, and the abutting surfaces of the second pin member 57 and the limiting member 53 are at the position corresponding to the intermediate location between the second and third rocker arms 26 and 27. Therefore, the rocker arms 25, 26 and 27 are in their disconnected states in which the intake valves $V_{I1}$ and $V_{I2}$ are stopped by the stopping cams 22, 22.

If a relatively high hydraulic pressure enough to overcome the spring forces of the return spring 53 and the spring 58 is further applied to the hydraulic pressure chamber 33, the switchover piston 34 causes the first and second pin members 56 and 57 in their mutually abutting states to be further moved by the distance $L_1$, so that the switchover piston 34 is fitted into the guide bore 41 in the second rocker arm 26, while the second pin member 57 is fitted into the small-diameter guide bore 42 in the third rocker arm 27, thereby causing all the rocker arms 25, 26 and 27 to be connected together, so that the intake valves $V_{I1}$ and $V_{I2}$ are opened and closed with the characteristic corresponding to the profile of the operating cam 24.

In the second embodiment, low-speed cams may be used in place of the stopping cams 22, 22, and a high-speed cam may be used in place of the operating cam 24.

Figure 5:
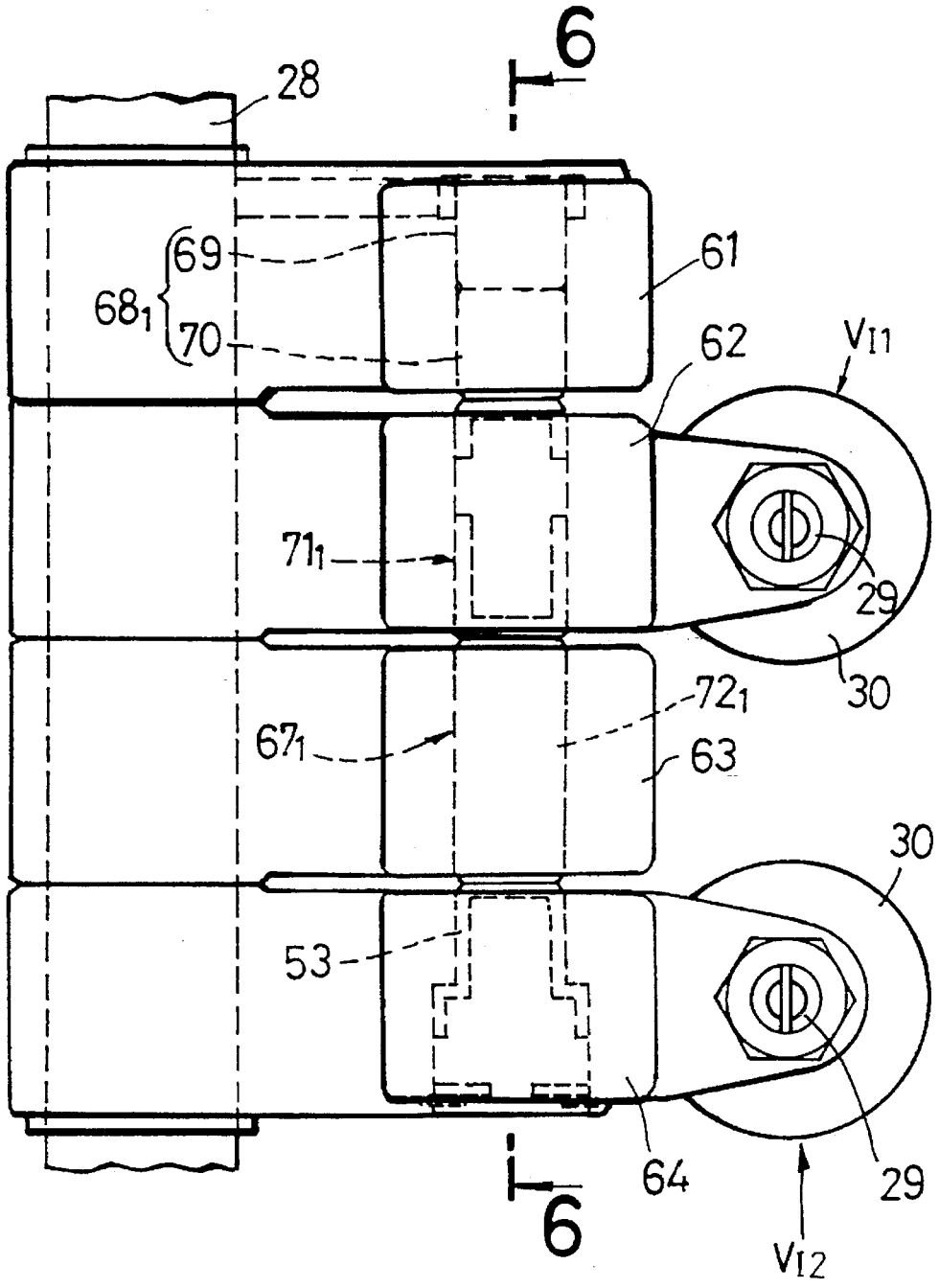
FIG. 5 is a plan view of a third embodiment of the present invention.
Figure 6:
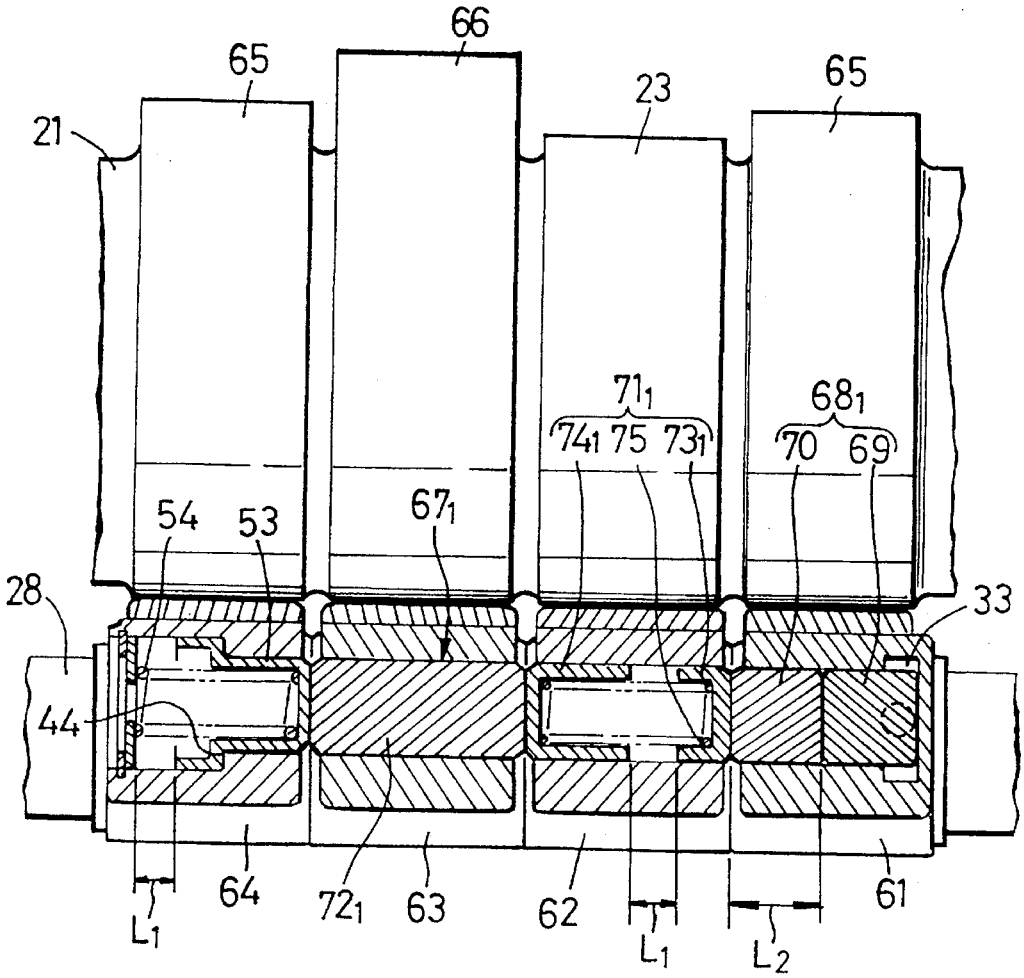
FIG. 6 is a sectional view taken along a line 6—6 in FIG. 5.

FIGS. 5 and 6 illustrate a third embodiment of the present invention, wherein portions or components corresponding to those in the above-described embodiments are designated like reference characters.

First, second, third and fourth rocker arms 61, 62, 63 and 64 are swingably carried in the named order on a rocker shaft 28, and intake valves $V_{I1}$ and $V_{I2}$ are operatively connected to the second and fourth rocker arms 62 and 64, respectively. A low-speed cam 65, a substantially stopping cam 23, a high-speed cam 66 and a low-speed cam 65 are integrally provided on a cam shaft 21 in independent correspondence to the first, second, third and fourth rocker arms 61, 62, 63 and 64, respectively.

The connection and disconnection of the first, second, third and fourth rocker arms 61, 62, 63 and 64 in combination are switched over by a connection switchover means $67_1$. The connection switchover means $67_1$ includes a switchover piston $68_1$ fitted in one of the rocker arms 61, 62, 63 and 64 on one side in a direction of adjacent arrangement of them, i.e., into the first rocker arm 61 with one end facing a hydraulic pressure chamber 33, a limiting member 53 slidably fitted into one of the rocker arms 61, 62, 63 and 64 on the other side in the direction of adjacent arrangement of them, i.e., into the fourth rocker arm 64, a return spring 54 for biasing the limiting member 53 to the one side in the direction of adjacent arrangement, toward the first rocker arm 61, and switchover pins $71_1$ and $72_1$ fitted into intermediate two of the rocker arms 61, 62, 63 and 64 on the other side in the direction of adjacent arrangement of them, i.e., into the second and third rocker arms 62 and 64, respectively.

The switchover piston $68_1$ includes a first piston member 69 with one end facing the hydraulic pressure chamber 33, and a second piston member 70 with one end facing the other end of the first piston member 69. The axial length $L_2$ of the second piston member 70 is determined so that the other end of the second piston member 70 is located at an intermediate location between the first and second rocker arms 61 and 62 in a condition in which the first piston member 69 has been moved to a position to minimize the volume of the hydraulic pressure chamber 33, as shown in FIG. 6.

The switchover pin $71_1$ includes a first bottomed cylindrical pin member $73_1$ slidably fitted in the rocker arm 62 to abut against the second piston member 70 of the switchover piston $78_1$, a second bottomed cylindrical pin member $74_1$ slidably fitted in the rocker arm 62 to abut against the switchover pin $67_1$, and a spring 75 mounted under compression between both the pin members $73_1$ and $74_1$. The spring 75 exhibits a spring force smaller than the spring force of the return spring 54 to bias both the pin members $73_1$ and $74_1$ away from each other.

Moreover, when the switchover piston $68_1$ is at the position to minimize the volume of the hydraulic pressure chamber 33 and the limiting member 53 is in abutment against the step 44, the first pin member $73_1$ in abutment against the switchover piston $68_1$ and the second pin member $74_1$ in abutment against the switchover pin $72_1$ are spaced at a distance $L_1$ one half of the distance $L_2$ apart from each other. The axial length of the second pin member $74_1$ is set larger than the distance $L_1$. The switchover pin $72_1$ is formed into a columnar shape and has an axial length corresponding to the width of the third rocker arm 63 along an axis of the rocker arm shaft 28.

The operation of the third embodiment will be described below. In a condition in which the hydraulic pressure in the hydraulic pressure chamber 33 has been released, the switchover piston $68_1$ with the first and second piston members 69 and 70 in abutment against each other is at the position to minimize the volume of the hydraulic pressure chamber 33, while the limiting member 53 is at the end of forward movement to abut against the step 44, under the spring forces of the return spring 53 and the spring 75. In this condition, the abutting surfaces of the second piston member 70 of the switchover piston $68_1$ and the first pin member $73_1$ of the switchover pin $71_1$ are between the first and second rocker arms 61 and 62, while the abutting surfaces of the second pin member $74_1$ of the switchover pin $71_1$ and the switchover pin $72_1$ are between the second and third rocker arms 62 and 63, and the abutting surfaces of the switchover pin $72_1$ and the limiting member 53 are between the third and fourth rocker arms 63 and 64. Therefore, the rocker arms 61, 62, 63 and 64 are in their disconnected states, so that the intake valve $V_{I1}$ operatively connected to the second rocker arm 62 is its substantially stopped state as a result of the action of the substantially stopping cam 23, while the intake valve $V_{I2}$ operatively connected to the fourth rocker arm 64 is opened and closed with a characteristic corresponding to a profile of the low-speed cam 65.

If a relatively low hydraulic pressure enough to overcome the spring force of the spring 75 is applied to the hydraulic pressure chamber 33, the switchover piston $68_1$ compresses the spring 75 to urge the first pin member $73_1$ of the switchover pin $71_1$, so that the first pin member $73_1$ is moved by the distance $L_1$ until it abuts against the second pin member $74_1$. In this condition, the second piston member 70 of the switchover piston $68_1$ is in a state in that substantially half thereof has been fitted into the second rocker arm 62 to connect the first and second rocker arms 61 and 62 by the second piston member 70, while the third and fourth rocker arms 63 and 64 remain in their disconnected states. Thus, the one intake valve $V_{I1}$ is driven by the first rocker arm 61, and the intake valves $V_{I1}$ and $V_{I2}$ are opened and closed with the characteristic corresponding to the profile of the low-speed cams 65, 65.

If a relatively high hydraulic pressure enough to overcome the spring forces of the return spring 53 and the spring 75 is further applied to the hydraulic pressure chamber 33, the switchover piston $68_1$ causes the first and second pin members $73_1$ and $74_1$ in abutment against each other to be moved further by the distance $L_1$, and causes the switchover pin $72_1$ to be fitted into the fourth rocker arm 64. During this time, the abutting surfaces of the first and second piston members 69 and 70 of the switchover piston $68_1$ are in the position corresponding to between the first and second rocker arms 61 and 62; the second and third rocker arms 62 and 63 are interconnected by the second pin member $74_1$ of the switchover pin $71_1$, and the third and fourth rocker arms 63 and 64 are interconnected by the switchover pin $72_1$. Thus, the second and fourth rocker arms 62 and 64 are swung along with the third rocker arm 63, and the intake valves $V_{I1}$ and $V_{I2}$ are opened and closed with the characteristic corresponding to the profile of the high-speed cam 66.

Figure 7:
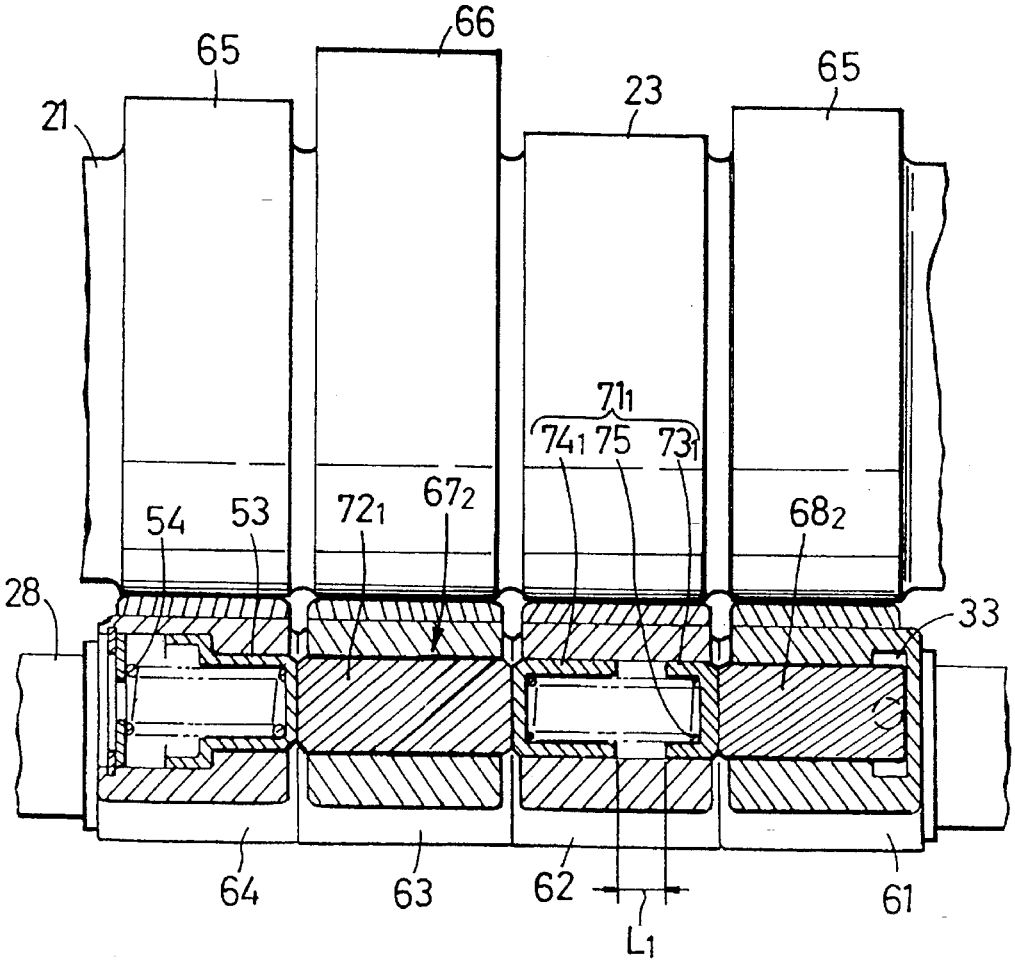
FIG. 7 is a sectional view similar to FIG. 6, but illustrating a fourth embodiment of the present invention.

FIG. 7 illustrates a fourth embodiment of the present invention, wherein portions or components corresponding to those in the above-described embodiments are designated by like reference characters.

A connection switchover means $67_2$ for switching over the connection and disconnection of the first, second, third and fourth rocker arms 61, 62, 63 and 64 in combination is of the same construction as in the third embodiment shown in FIGS. 5 and 6, except that a switchover piston $68_2$ slidably fitted in the first rocker arm 61 with one end facing the hydraulic pressure chamber 33 is formed into a non-divided columnar shape.

With the fourth embodiment, in a condition in which the hydraulic pressure in the hydraulic pressure chamber 33 has been released, the rocker arms 61, 62, 63 and 64 are in disconnected states. The intake valve $V_{I1}$ operatively connected to the second rocker arm 62 has been into its substantially stopped state by the substantially stopping cam 23, and the intake valve $V_{I2}$ operatively connected to the fourth rocker arm 64 is opened and closed with the characteristic corresponding to the profile of the low-speed cam 65. If a relatively low hydraulic pressure enough to overcome the spring force of the spring 75 is then applied to the hydraulic pressure chamber 33, the switchover piston $68_2$ compresses the spring 75 to urge the first pin member $73_1$ of the switchover pin $71_1$, so that the first pin member $73_1$ is moved by the distance $L_1$ until it abuts against the second pin member $74_1$. This causes a portion of the switchover piston $68_2$ to be fitted into the second rocker arm 62, thereby interconnecting the first and second rocker arms 61 and 62. Thus, the one intake valve $V_{I1}$ is driven by the first rocker arm 61, and the intake valves $V_{I1}$ and $V_{I2}$ are opened and closed with the characteristic corresponding to the profile of the low-speed cams 65, 65. If a relatively high hydraulic pressure enough to overcome the spring forces of the return spring 53 and the spring 75 is further applied to the hydraulic pressure chamber 33, the switchover piston $68_2$ causes the first and second pin members $73_1$ and $74_1$ in abutment against each other to be moved further by the distance $L_1$, and causes the switchover pin $72_1$ to be fitted into the fourth rocker arm 64. Thus, the first and second rocker arms 61 and 62 are interconnected by the switchover piston $68_2$; the second and third rocker arms 62 and 63 are interconnected by the second pin member $74_1$, and the third and fourth rocker arms 63 and 64 are interconnected by the switchover pin $72_1$. Therefore, all the rocker arms 61, 62, 63 and 64 are brought into their connected states, so that the intake valves $V_{I1}$ and $V_{I2}$ are opened and closed with the characteristic corresponding to the profile of the high-speed cam 66.

Figure 8:
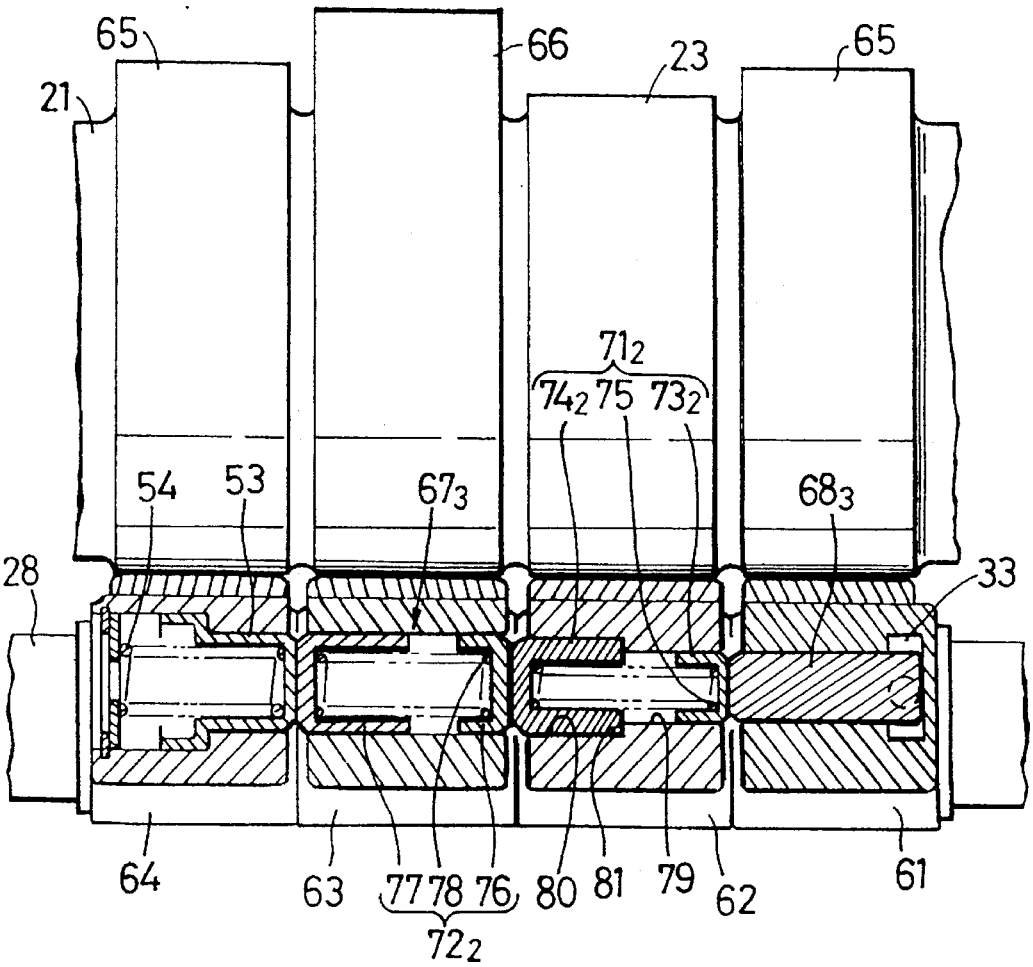
FIG. 8 is a sectional view similar to FIG. 6, but illustrating a fifth embodiment of the present invention.

FIG. 8 illustrates a fifth embodiment of the present invention, wherein portions or components corresponding to those in the above-described embodiments are designated by like reference characters.

A connection switchover means for switching over the connection and disconnection of first, second, third and fourth rocker arms 61, 62, 63 and 64 in combination includes a switchover piston $68_3$ fitted into one of the rocker arms 61, 62, 63 and 64 on one side in a direction of adjacent arrangement of them, i.e., into the first rocker arm 61 with one end facing the hydraulic pressure chamber 33, a limiting member 53 slidably fitted into one of the rocker arms 61, 62, 63 and 64 on the other side in the direction of adjacent arrangement of them, i.e., into the fourth rocker arm 64, a return spring 54 for biasing the limiting member 53 toward the one side in the direction of adjacent arrangement, i.e., toward the first rocker arm 61, and switchover pins $71_2$ and $72_2$ fitted into intermediate two of the rocker arms 61, 62, 63 and 64 in the direction of adjacent arrangement of them, i.e., into the second and third rocker arms 62 and 64, respectively.

The switchover piston $68_3$ is formed into a columnar shape of a relatively small diameter and slidably fitted into the first rocker arm 61 with one end facing the hydraulic pressure chamber 33.

The switchover pin $71_2$ includes a first pin member $73_2$ formed into a bottomed cylinder-like shape of a relatively small diameter and slidably fitted into the second rocker arm 62 to abut against the other end of the switchover piston $68_3$, a second pin member $74_2$ formed into a bottomed cylinder-like shape of a relatively large diameter and slidably fitted into the second rocker arm 62, and a spring 75 mounted under compression between the pin members $73_2$ and $74_2$. A small-diameter guide bore 79 and a large-diameter guide bore 80 are coaxially provided in the second rocker arm 62 with a step 81 interposed therebetween. The first pin member $73_2$ is slidably fitted into the small-diameter guide bore 79, and the second pin member $74_2$ is slidably fitted into the large-diameter guide bore 80. The second pin member $74_2$ is formed into a large thickness such that the first pin member $73_2$ can be brought into abutment against the second pin member $74_2$, and the length of the second pin member $74_2$ is set at a value such that with one end in abutment against the step 81, the other end is located between the second and third rocker arms 62 and 63.

The switchover pin $72_2$ includes a first bottomed cylindrical pin member 76 slidably fitted into the third rocker arm 63 to abut against the second pin member $74_2$ of the switchover pin $71_2$, a second bottomed cylindrical pin member 77 slidably fitted into the third rocker arm 63 to abut against the limiting member 53, and a spring 78 mounted under compression between both the pins 76 and 77. The spring force of the spring 78 is set at a value smaller than that of the return spring 54, but larger than that of the spring 75 of the switchover pin $71_2$.

In this connection switchover means $67_3$, the hydraulic pressure applied to the hydraulic pressure chamber 33 is controlled at three stages, thereby switching over the connection and disconnection of the rocker arms 61, 62, 63 and 64 in combination.

More specifically, in a condition in which the hydraulic pressure in the hydraulic pressure chamber 33 has been released, the abutting surfaces of the switchover pistons $68_3$ and the first pin member $73_2$ of the switchover pin $71_2$ are located between the first and second rocker arms 61 and 62; the abutting surfaces of the second pin member $74_2$ of the switchover pin $71_2$ and the first pin member 76 of the switchover pin $72_2$ are located between the second and third rocker arms 62 and 63, and the abutting surfaces of the second pin member 77 of the switchover pin $72_2$ and the limiting member 53 are located between the third and fourth rocker arms 63 and 64. Therefore, the rocker arms 61, 62, 63 and 64 are in their disconnected states, wherein the intake valve $V_{I1}$ operatively connected to the second rocker arm 62 has been brought into its substantially stopped state by the substantially stopping cam 23, and the intake valve $V_{I2}$ operatively connected to the fourth rocker arm 64 is opened and closed with the characteristic corresponding to the profile of the low-speed cam 65.

If a hydraulic pressure enough to overcome the spring force of the spring 75 is then applied to the hydraulic pressure chamber 33, the switchover piston $68_3$ is moved into the second rocker arm 62, until it compresses the spring 75 to urge the first pin member $73_2$ of the switchover pin $71_2$ into abutment against the second pin member $74_2$. This causes the first and second rocker arms 61 and 62 to be interconnected by the switchover piston $68_3$, while the third and fourth rocker arms 63 and 64 remain in their disconnected states. Thus, the one intake valve $V_{I1}$ is driven by the first rocker arm 61, and the intake valves $V_{I1}$ and $V_{I2}$ are opened and closed with the characteristic corresponding to the profile of the low-speed cams 65, 65.

If a hydraulic pressure enough to overcome the spring forces of the spring 75 and the spring 78 is applied to the hydraulic pressure chamber 33, the switchover piston $78_3$ urges the first and second pin members $73_2$ and $74_2$ abutting against each other, so that the second pin member $74_2$ of the switchover pin $71_2$ is fitted into the third rocker arm 63, until the first pin member 76 of the switchover pin $72_2$ abuts against the second pin member 77. During this time, the switchover piston $68_3$ maintains the first and second rocker arms 61 and 62 to remain connected to each other and in addition to this, the second and third rocker arms 62 and 63 are connected to each other by the second pin member $74_2$. Thus, the first, second and third rocker arms 61, 62 and 63 are connected together, so that the intake valve $V_{I1}$ operatively connected to the second rocker arm 62 is opened and closed with the characteristic corresponding to the profile of the high-speed cam 66, and the intake valve $V_{I2}$ operatively connected to the fourth rocker arm 64 maintains the opening and closing characteristic corresponding to the profile of the low-speed cam 65.

If a high hydraulic pressure enough to overcome the spring forces of the return spring 54 and the springs 75 and 78 is applied to the hydraulic pressure chamber 33, the switchover piston $68_3$ further urges the first and second pin members $73_2$ and $74_2$ of the switchover pin $71_2$ in abutment against each other as well as the first and second members 76 and 77 of the switchover pin $72_2$ in abutment against each other. Thus, the first and second rocker arms 61 and 62 are interconnected by the switchover piston $68_3$; the second and third rocker arms 62 and 63 are interconnected by the second pin member $74_2$ of the switchover pin $71_2$, and the third and fourth rocker arms 63 and 64 are interconnected by the second pin member 77 of the switchover pin $72_2$. Therefore, all the rocker arms 61, 62, 63 and 64 are brought into their connected states, so that the intake valves $V_{I1}$ and $V_{I2}$ are opened and closed with the characteristic corresponding to the profile of the high-speed cam 66.

Figure 9:
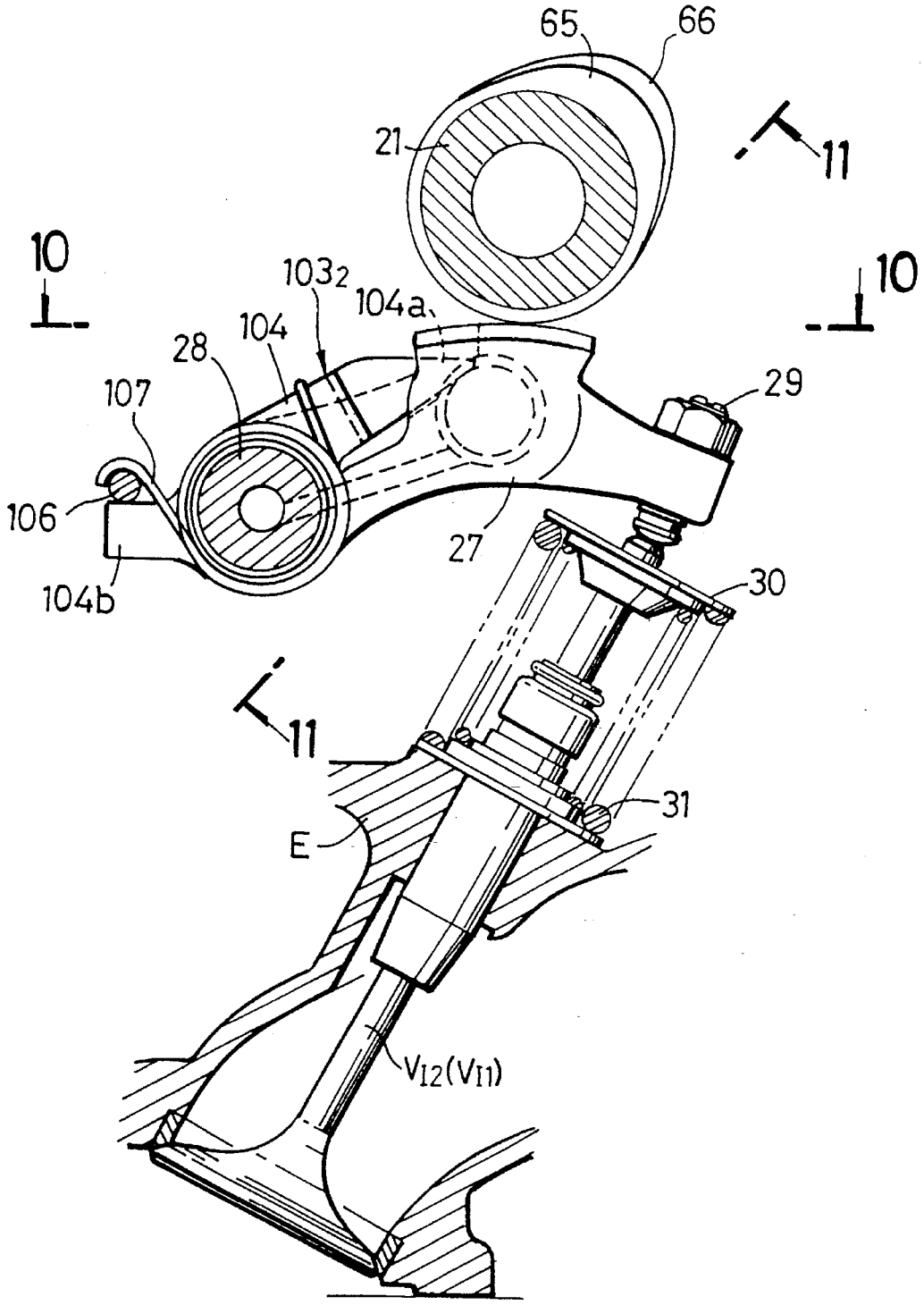
FIG. 9 is a vertical sectional side view of a sixth embodiment of the present invention.
Figure 10:
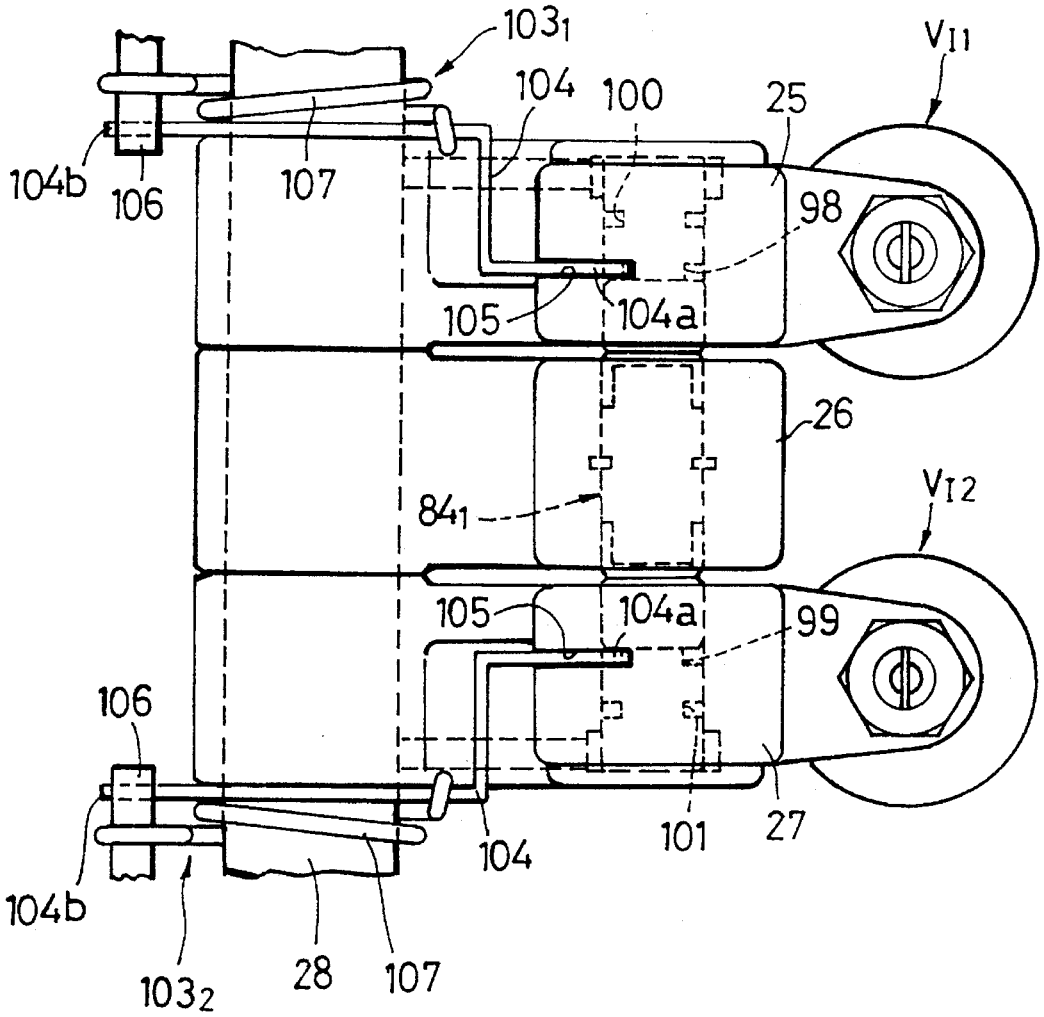
FIG. 10 is a plan view taken along a line 10—10 in FIG. 9.
Figure 11:
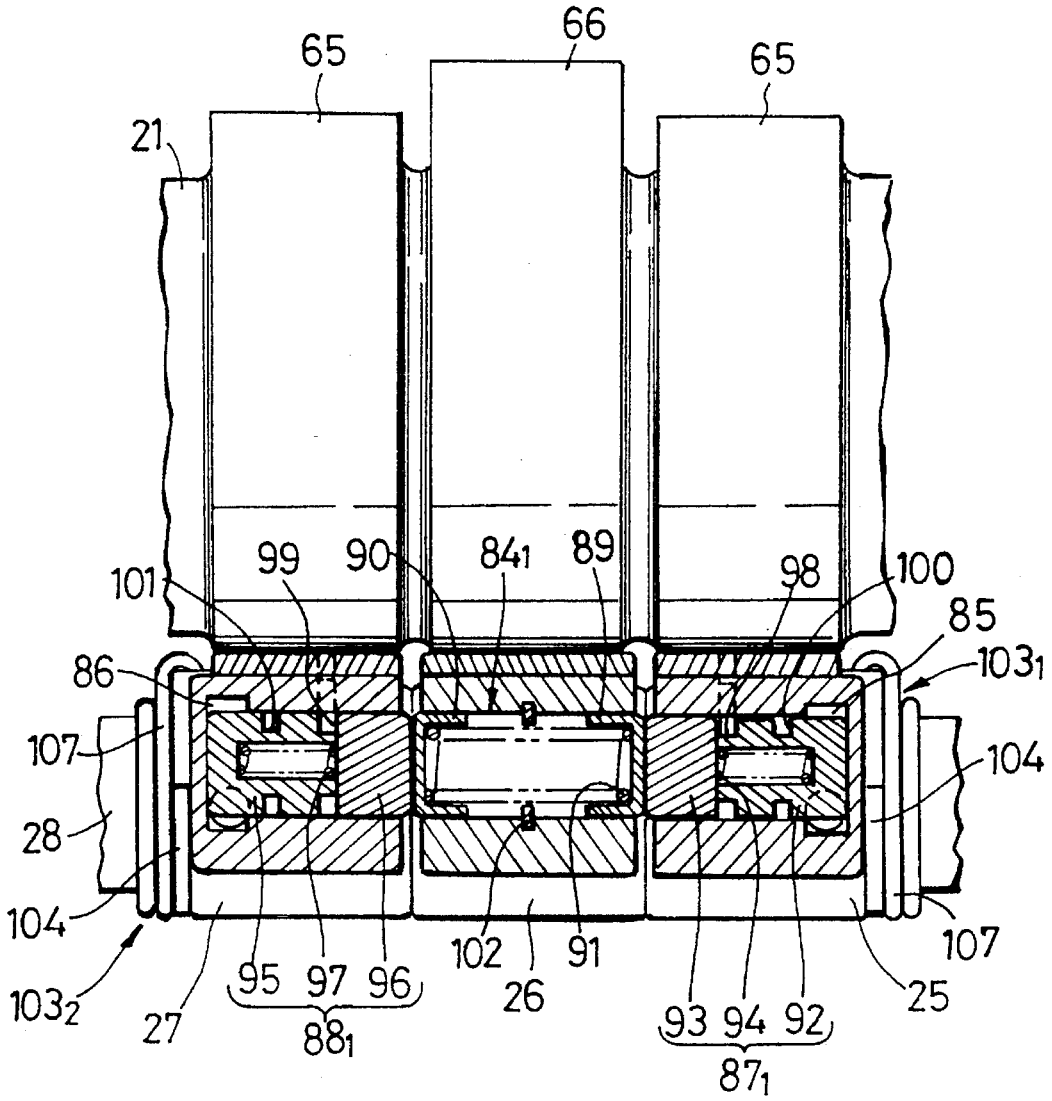
FIG. 11 is a sectional view taken along a line 11—11 in FIG. 9.

FIGS. 9, 10 and 11 illustrate a sixth embodiment of the present invention, wherein portions or components corresponding to those in the above-described embodiments are designated by like reference characters.

First, second and third rocker arms 25, 26 and 27 are swingably carried in the named order on a rocker arm shaft 28, and intake valves $V_{I1}$ and $V_{I2}$ are operatively connected to the first and third rocker arms 25 and 27, respectively. A low-speed cam 65, a high-speed cam 66 and a low-speed cam 65 are integrally provided on the first, second and third rocker arms in correspondence to these arms, respectively.

The connection and disconnection of the rocker arms 25, 26 and 27 in combination are switched over by a connection switchover means $84_1$. The connection switchover means $84_1$ includes a first switchover piston $87_1$ fitted into one of the rocker arms 25, 26 and 27 on one side in a direction of adjacent arrangement of them, i.e., into the first rocker arm 25 with its outer end facing a first hydraulic pressure chamber 85, a second switchover piston $87_1$ fitted into one of the rocker arms 25, 26 and 27 on the other side in the direction of adjacent arrangement of them, i.e., into the third rocker arm 27 with its outer end facing a second hydraulic pressure chamber 86, a first switchover member 89 fitted into intermediate one of the rocker arms 25, 26 and 27 in the direction of adjacent arrangement of them, i.e., into the second rocker arm 26 and connected to the first switchover piston $87_1$, a second switchover member 90 fitted into the second rocker arm 26 and connected to the second switchover piston $88_1$, and a return spring 91 interposed between the first and second switchover members 89 and 90.

Each of the first and second switchover pistons $87_1$ and $88_1$ is expandable and contractible by exhibiting a spring force in an expanding direction and includes a bottomed cylindrical member 92, 95 slidably fitted into corresponding one of first and third rocker arms 25 and 27, a short cylindrical member 93, 96 slidably fitted into corresponding one of the first and third rocker arms 25 and 27 to abut against corresponding one of the first and second switchover members 89 and 90, and a spring 94, 97 mounted under compression between the bottomed cylindrical member 92, 95 and the short cylindrical member 93, 96. Moreover, Each of the bottomed cylindrical members 89 and 90 has an annular notch provided in an outer surface of an open end thereof to define a first annular engage groove 98, 99 between one end face of the short cylindrical member 93, 96 and the bottomed cylindrical member 89, 90, when the open end has been brought into abutment against the one end face of the short cylindrical member 93, 96. The bottomed cylindrical members 92 and 95 have second annular engage grooves 100 and 101 provided around outer peripheries thereof, respectively. The set load of each of the springs 94 and 97 is set smaller than that of the return spring 91.

A stopping ring 102 is fitted in the second rocker arm 26 for limiting the retreat limit for the first and second switchover members 89 and 90. A hydraulic pressure can be applied independently to the first and second hydraulic pressure chambers 85 and 86.

First and second trigger mechanisms $103_1$ and $103_2$ are added to the connection switchover means $84_1$ for defining the timing of operation of the first and second switchover pistons $87_1$ and $88_1$. The trigger mechanisms $103_1$ and $103_2$ have the basically same construction and hence, only the construction of the first trigger mechanism $103_1$ will be described, and the second trigger mechanism $103_2$ will be only shown with its components designated by the same reference characters.

The first trigger mechanism $103_1$ includes a trigger plate 104 which is capable of being swung relative to the rocker arms 25, 26 and 27 about an axis of the rocker arm shaft 28 between a position in which it is engaged into the first or second engage groove 98 or 100 to limit the movement of the first switchover piston $87_1$ and a position in which it is disengaged from the first or second engage groove 98 or 100 to permit the movement of the first switchover piston $87_1$.

The first rocker arm 25 has a slit 105 provided therein so that it is opposed to the first engage groove 98 in a condition in which the bottomed cylindrical member 92 and the short cylindrical member 93 of the first switchover piston $87_1$ has been displaced to the maximum toward the first hydraulic pressure chamber 85, as shown in FIG. 11. The second engage groove 100 is provided around the outer periphery of the bottomed cylindrical member 92 in a manner that it assumes a position opposed to the slit 105 in a condition in which the bottomed cylindrical member 92 and the short cylindrical member 93 in abutment against each other have been moved to the maximum away from the first hydraulic pressure chamber 85.

The trigger plate 104 is rotatably carried on the rocker arm shaft 28. The trigger plate 104 is integrally provided with an engage plate portion which disengageably engages the first engage groove 98 or the second engage groove 100 through the slit 105.

A stopper pin 106 is fixedly mounted on an engine body E to extend toward the first rocker arm 25, and a stopper **104*b* projects from the trigger plate 104 and is capable of abutting against the stopper pin 106 from below. A torsion spring 107 is locked at one end thereof on the stopper pin 106 to surround the rocker arm shaft 28 and locked at the other end thereof on the trigger plate 104 from above. Thus, the trigger plate 104 is biased in a direction to bring the stopper 104*b* into abutment against the stopper pin 106 by the action of the torsion spring 107. When the first rocker arm 25 is in its stopped state in a condition in which the stopper 104*b* is in abutment against the stopper pin 106, the engage plate portion 104*a* of the trigger plate 104 is capable of being engaged into the engage groove 98 or 100 through the slit 105. When the first rocker arm 25 is swung in a valve-opening direction, the position of the stopper pin 106 is determined so that the engage plate portion 104*a* disengaged through the slit 105**.

The operation of the sixth embodiment will be described below. In a condition in which the hydraulic pressures in the first and second hydraulic pressure chambers 85 and 86 have been released, the abutting surfaces of the first switchover piston $87_1$ and the first switchover member 89 are located between the first and second rocker arms 25 and 26, and the abutting surfaces of the second switchover piston $88_1$ and the second switchover member 90 are located between the second and third rocker arms 26 and 27. Therefore, the first, second and third rocker arms 25, 26 and 27 are in their disconnected states, so that the intake valves $V_{I1}$ and $V_{I2}$ operatively connected to the first and third rocker arms 25 and 27 are opened and closed with the characteristic corresponding to the profile of the low-speed cams 65, 65.

If a hydraulic pressure is applied to the first hydraulic pressure chamber 85 in a condition in which the hydraulic pressure in the second hydraulic pressure chamber 86 has been released, the first switchover piston $87_1$ urges the first switchover member 89 until the latter abuts against the stopping ring 102 while compressing the return spring 91 in a manner that a portion of the short cylindrical member 93 of the first switchover piston $\mathbf{87}_1$ is fitted into the second rocker arm 26, thereby causing the first and second rocker arms 25 and 26 to be interconnected by the short cylindrical member 93, but the second and third rocker arms 26 and 27 remain disconnected from each other. Therefore, the first rocker arm 25 is swung along with the second rocker arm 26 driven by the high-speed cam 66, so that the one intake valve $V_{I1}$ is opened and closed with the characteristic corresponding to the profile of the high-speed cam 66, and the other intake valve $V_{I2}$ is opened and closed with the characteristic corresponding to the profile of the low-speed cam 65.

If a hydraulic pressure is applied to the second hydraulic pressure chamber 86 in a condition in which the hydraulic pressure in the first hydraulic pressure chamber 85 has been released, the second switchover piston $\mathbf{88}_1$ urges the second switchover member 90 until the latter abuts against the stopping ring 102 while compressing the return spring 91 in a manner that a portion of the short cylindrical member 96 of the second switchover piston $\mathbf{88}_1$ is fitted into the second rocker arm 26, thereby causing the second and third rocker arms 26 and 27 to be interconnected by the short cylindrical member 96, but the first switchover member 89 is moved so that its surface abutting against the first switchover piston $\mathbf{87}_1$ is located at a position corresponding to between the first and second rocker arms 25 and 26, thereby disconnecting the first and second rocker arms 25 and 26. Thus, the one intake valve $V_{I1}$ is opened and closed with the characteristic corresponding to the profile of the low-speed cam 65, and the other intake valve $V_{I2}$ is opened and closed with the characteristic corresponding to the profile of the high-speed cam 66 by swinging movement of the third rocker arm 27 along with the second rocker arm 26 driven by the high-speed cam 66.

If a hydraulic pressure is applied to both the first and second hydraulic pressure chambers 85 and 86, the first and second switchover pistons $\mathbf{87}_1$ and $\mathbf{88}_1$ urge the first and second switchover members 89 and 90 until the latter abut against the stopping ring 102 while compressing the return spring 91 in a manner that portions of the short cylindrical members 93 and 96 are fitted into the second rocker arm 26. This causes the first and second rocker arms 25 and 26 to be interconnected by the short cylindrical member 93, while causing the second and third rocker arms 26 and 27 to be interconnected by the short cylindrical member 96. In other words, all the rocker arms 25, 26 and 27 are brought into their connected states, so that both the intake valves $V_{I1}$ and $V_{I2}$ are opened and closed with the characteristic corresponding to the profile of the high-speed cam 66.

Figure 12:
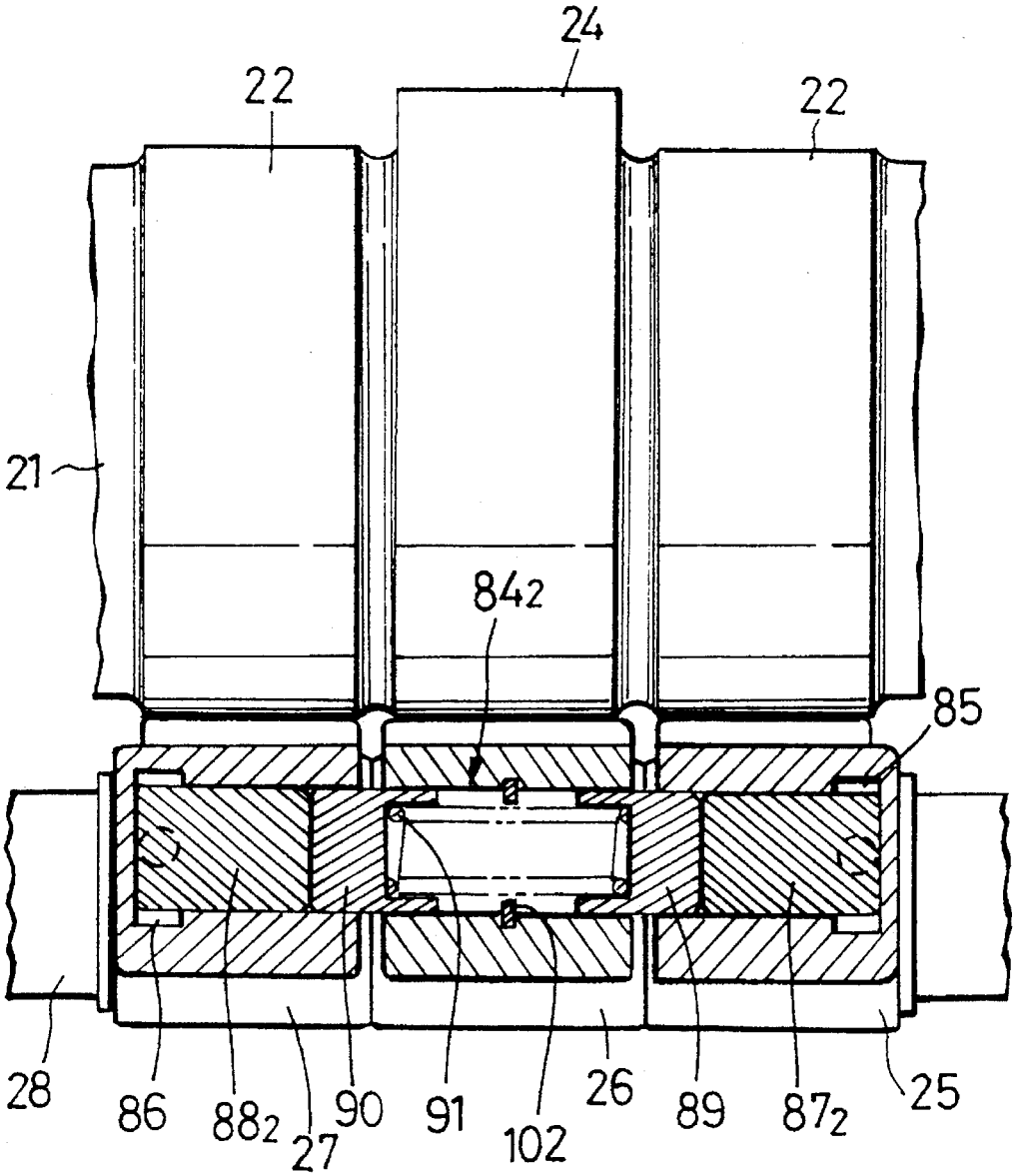
FIG. 12 is a sectional view similar to FIG. 11, but illustrating a seventh embodiment of the present invention.

FIG. 12 illustrates a seventh embodiment of the present invention, wherein portions or components corresponding to those in the above-described embodiments are designated by like reference characters.

Stopping cams 22, 22 are provided on a cam shaft 21 in correspondence to first and third rocker arms 25 and 27 operatively connected to intake valves $V_{I1}$ and $V_{I2}$ (see FIG. 10), and an operating cam 24 is provided on the cam shaft 21 in correspondence to a second rocker arm 26.

The connection and disconnection of the first, second and third rocker arms 25, 26 and 27 in combination are switched over by a connection switchover means $\mathbf{84}_2$. The connection switchover means $\mathbf{84}_2$ includes a first switchover piston $\mathbf{87}_2$ fitted into the first rocker arm 25 with its outer end facing a first hydraulic pressure chamber 85, a second switchover piston $\mathbf{88}_2$ fitted into the third rocker arm 26 with its outer end facing a second hydraulic pressure chamber 86, a first switchover member 89 fitted into the second rocker arm 26 and connected to the first switchover piston 87, a second switchover member 90 fitted into the second rocker arm 26 and connected to the second switchover piston $\mathbf{88}_2$, and a return spring 91 interposed between the first and second switchover members 89 and 90, a stopping ring 102 is fitted in the second rocker arm 26 for defining an end of movement of the first and second switchover members 89 and 90 in a direction toward each other.

Each of the first and second switchover pistons $\mathbf{87}_2$ and $\mathbf{88}_2$ is formed into a short cylindrical shape and is in a state in which it has been partially fitted into corresponding one of the first and third rocker arms 25 and 27, when the first and second switchover pistons $\mathbf{87}_2$ and $\mathbf{88}_2$ are at positions to minimize the volumes of the first and second hydraulic pressure chambers 85 and 86.

In a condition in which the hydraulic pressures in the first and second hydraulic pressure chambers 85 and 86 have been released, the first and second switchover members 89 and 90 are in their states in which they have been partially fitted into the first and third rocker arms 25 and 27, respectively, as shown in FIG. 12 to connect all the rocker arms 25, 26 and 27 together. Thus, the intake valves $V_{I1}$ and $V_{I2}$ are opened and closed with the characteristic corresponding to the profile of the operating cam 24. If a hydraulic pressure is applied to the first hydraulic pressure chamber 85 in a condition in which the hydraulic pressure in the second hydraulic pressure chamber 86 has been released, the first switchover piston $\mathbf{87}_2$ urges the first switchover member 89, so that its surface abutting against the first switchover member 89 is located between the first and second rocker arms 25 and 26, thereby disconnecting the first and second rocker arms 25 and 26 from each other. Thus, the one intake valve $V_{I1}$ is stopped by the stopping cam 22, while the other intake valve $V_{I2}$ is opened and closed with the characteristic corresponding to the profile of the operating cam 24, because the second and third rocker arms 26 and 27 are in their interconnected states. If a hydraulic pressure is applied to the second hydraulic pressure chamber 86 in a condition in which the hydraulic pressure in the first hydraulic pressure chamber 85 has been released, the second switchover piston $\mathbf{88}_2$ urges the second switchover member 90, so that its surface abutting against is located between the second and third rocker arms 26 and 27, thereby disconnecting the second and third rocker arms 26 and 27 from each other, while causing a portion of the first switchover member 89 to be fitted into the first rocker arm 25 by the spring force of the return spring 91, thereby interconnecting the first and second rocker arms 25 and 26. Thus, the one intake valve $V_{I1}$ is opened and closed with the characteristic corresponding to the profile of the operating cam 24, while the other intake valve $V_{I2}$ is stopped by the stopping cam 22. Further, when a hydraulic pressure is applied to both the first and second hydraulic pressure chambers 85 and 86, the first and second switchover pistons $\mathbf{87}_2$ and $\mathbf{88}_2$ urges and moves the first and second switchover members 89 and 90 against the spring force of the return spring 91, until they abut against the stopping ring 102. This causes the abutting surfaces of the first switchover piston 87 and the first switchover member 89 to be located between the first and second rocker arms 25 and 26, and causes the abutting surfaces of the second switchover piston $\mathbf{88}_2$ and the second switchover member 90 to be located between the second and third rocker arms 26 and 27, thereby disconnecting the rocker arms 25, 26 and 27 from one another. Thus, both the intake valves $V_{I1}$ and $V_{I2}$ are stopped by the stopping cams 22, 22.

Figure 13:
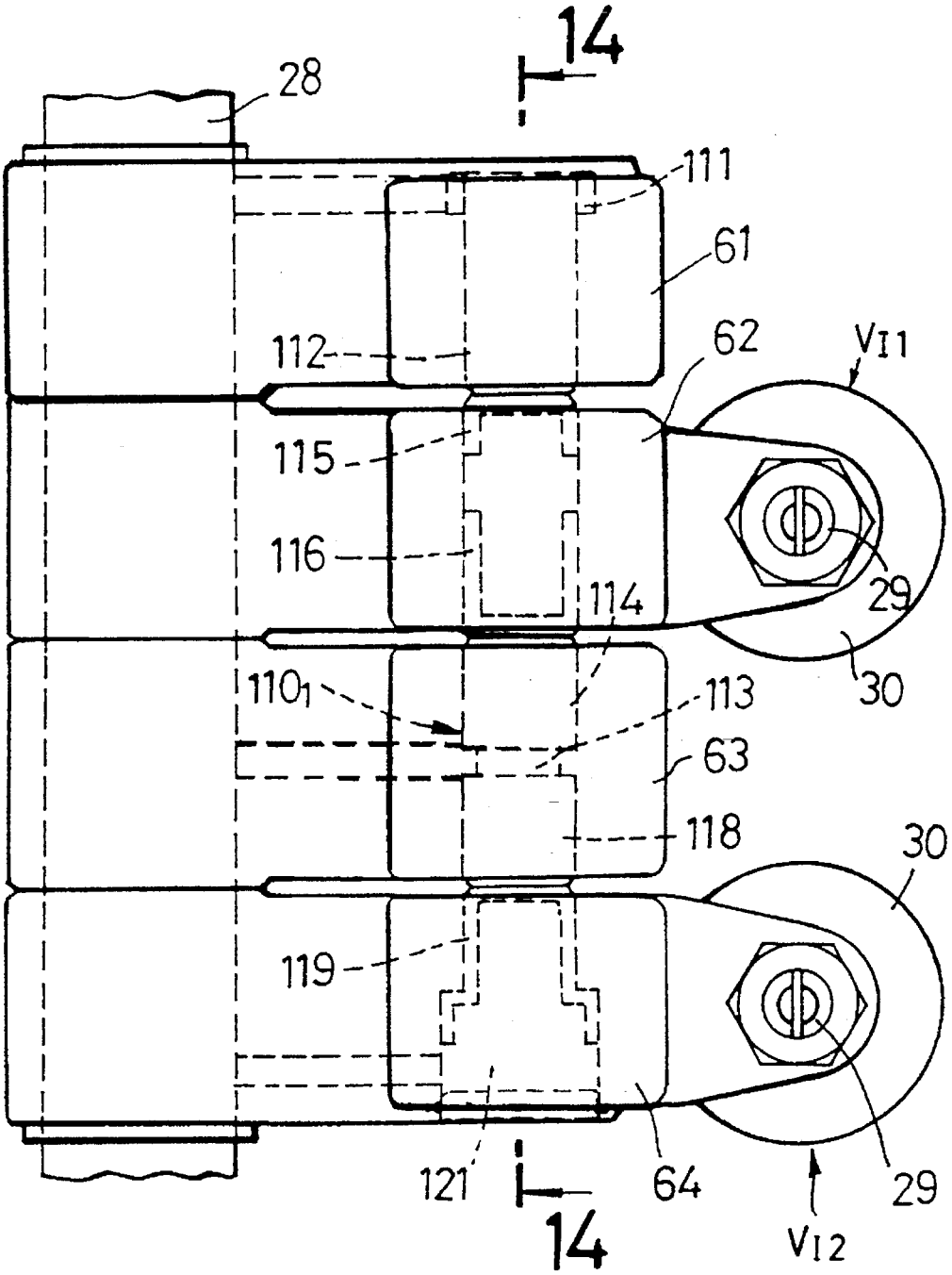
FIG. 13 is a plan view of an eighth embodiment of the present invention.
Figure 14:
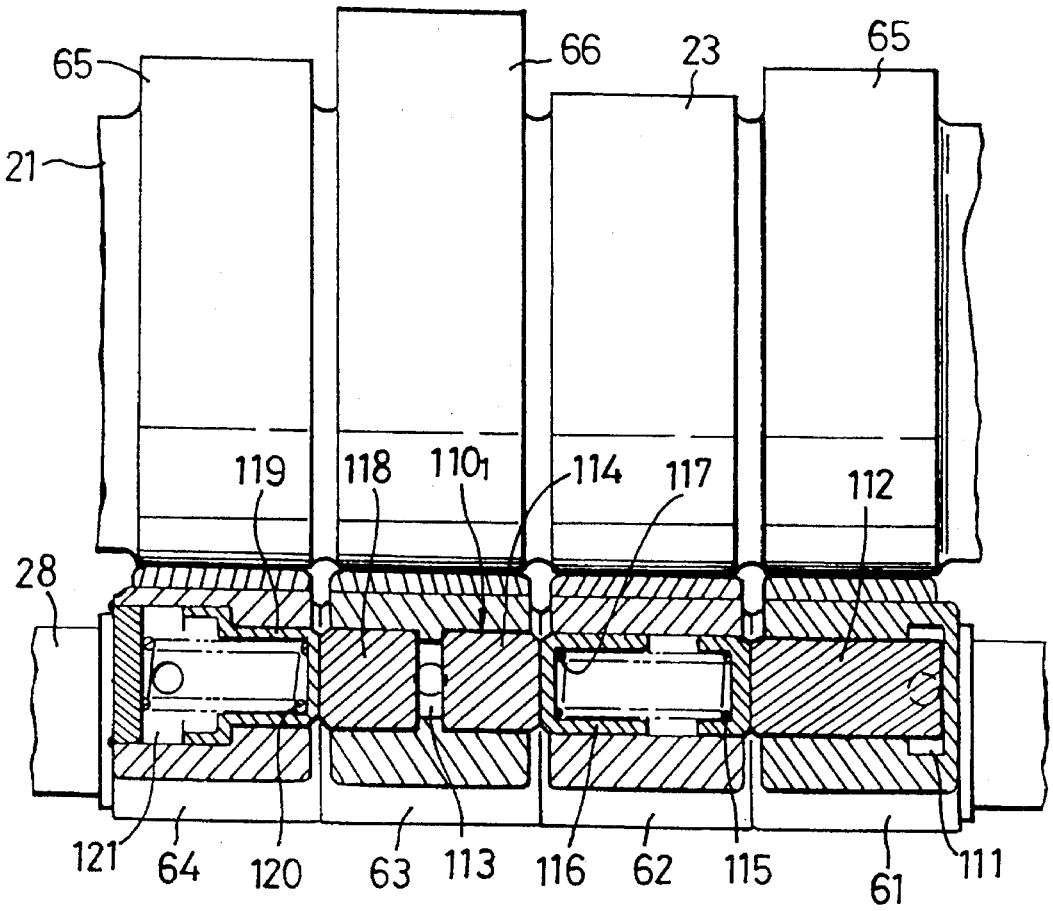
FIG. 14 is a sectional view taken along a line 14—14 in FIG. 13.

FIGS. 13 and 14 illustrate an eighth embodiment of the present invention, wherein portions or components corresponding to those in the above-described embodiments are designated by like reference characters.

First, second, third and fourth rocker arms 61, 62, 63 and 64 are swingably carried in the named order on a rocker arm shaft 28, and intake valves $V_{I1}$ and $V_{I2}$ are operatively connected to the second and fourth rocker arms 62 and 64, respectively. A low-speed cam 65, a substantially stopping cam 23, a high-speed cam 66 and a low-speed cam 65 are integrally provided on a cam shaft 21 in independent correspondence to the first, second, third and fourth rocker arms 61, 62, 63 and 64.

The connection and disconnection of the rocker arms 61, 62, 63 and 64 in combination are switched over by a connection switchover means $\mathbf{110}_1$. The connection switchover means $\mathbf{110}_1$ includes a first switchover piston 112 slidably fitted into the first rocker arm 61 with one end facing a first hydraulic pressure chamber 111, a second switchover piston 114 slidably fitted into the third rocker arm 63 sandwiching the second rocker arm 62 between the third rocker arm 63 itself and the first rocker arm 61 with its end opposite from the second rocker arm 62 facing a second hydraulic pressure chamber 113, a first bottomed cylindrical switchover member 115 slidably fitted into the second rocker arm 62 to abut against the first switchover piston 112, a second bottomed cylindrical switchover member 115 slidably fitted into the second rocker arm 62 to abut against the second switchover piston 114, a first return spring 116 interposed between the first and second switchover members 115 and 116, a third switchover piston 118 slidably fitted into the third rocker arm 63 with one end facing the second hydraulic pressure chamber 113, a limiting member 119 slidably fitted into the fourth rocker arm 64 to abut against the third switchover piston 118, and a second return spring 120 accommodated in a third hydraulic pressure chamber 121 defined between the limiting member 119 and the fourth rocker arm 64 for biasing the limiting member 119 toward the third switchover piston 118. Moreover, the application of a hydraulic pressure to the first, second and third hydraulic pressure chambers 111, 113 and 121 can be controlled independently.

The operation of the eighth embodiment will be described below. In a condition in which the hydraulic pressures in the hydraulic pressure chambers 111, 113 and 121 have been released, the connection of the rocker arms 61, 62, 63 and 64 has been released. Therefore, the intake valve $V_{I1}$ operatively connected to the second rocker arm 62 is brought into its substantially stopped state by the substantially stopping cam 23, and the intake valve $V_{I2}$ operatively connected to the fourth rocker arm 64 is opened and closed with a characteristic corresponding to a profile of the low-speed cam 65.

If a hydraulic pressure is applied to the first hydraulic pressure chamber 111 in a condition in which the hydraulic pressures in the second and third hydraulic pressure chamber 113 and 121 have been released, the first switchover piston 112 causes the first switchover member 115 to be partially fitted into the second rocker arm 62 while urging the first switchover member 115 against a spring force of the first return spring 117, thereby interconnecting the first and second rocker arms 61 and 62. The second and third rocker arms 62 and 63 remain disconnected from each other, and the third and fourth rocker arms 63 and 64 also remain disconnected from each other. Thus, one of the intake valves $V_{I1}$ is opened and closed with the characteristic corresponding to the profile of the low-speed cam 65, and the other intake valve $V_{I2}$ is maintained in its state in which it can be operated by the low-speed cam 65.

If a hydraulic pressure is applied to the second and third hydraulic pressure chambers 113 and 121 in a condition in which the hydraulic pressure in the first hydraulic pressure chamber 111 has been released, the second switchover piston 114 causes the second switchover member 116 to be partially fitted into the second rocker arm 62 while urging the second switchover member 116 against the spring force of the first return spring 117, thereby causing the first switchover member 115 to be moved by the spring force of the first return spring 115, until its surface abutting against the first switchover piston 112 is located between the first and second rocker arms 61 and 62. The third switchover piston 118 and the limiting member 119 remain at positions in which their surfaces abutting against each other are located between the third and fourth rocker arms 63 and 64. Thus, the second rocker arm 62 is connected to the third rocker arm 63, so that the one intake valve $V_{I1}$ is opened and closed with a characteristic corresponding to a profile of the high-speed cam 66, while the other intake valve $V_{I2}$ is maintained at a state in which it can be opened and closed by the low-speed cam 65.

Further, if a hydraulic pressure is applied to the second hydraulic pressure chamber 113 in a condition in which the hydraulic pressure in the first and third hydraulic pressure chambers 111 and 121 have been released, the second switchover piston 114 causes the second rocker arm 62 to be partially fitted into the second rocker arm 62 while urging the second rocker arm 62 against the spring force of the first return spring 117, and at the same time, the third switchover piston 118 causes the limiting member 119 to be partially fitted into the fourth rocker arm 64 while urging the limiting member 119 against a spring force of the second return spring 120, thereby connecting the second and fourth rocker arms 62 and 64 to the third rocker arm 63. Thus, the second and fourth rocker arms 62 and 64 are swung along with the third rocker arm 63, so that the intake valves $V_{I1}$ and $V_{I2}$ are opened and closed with the characteristic corresponding to the profile of the high-speed cam 66.

Figure 15:
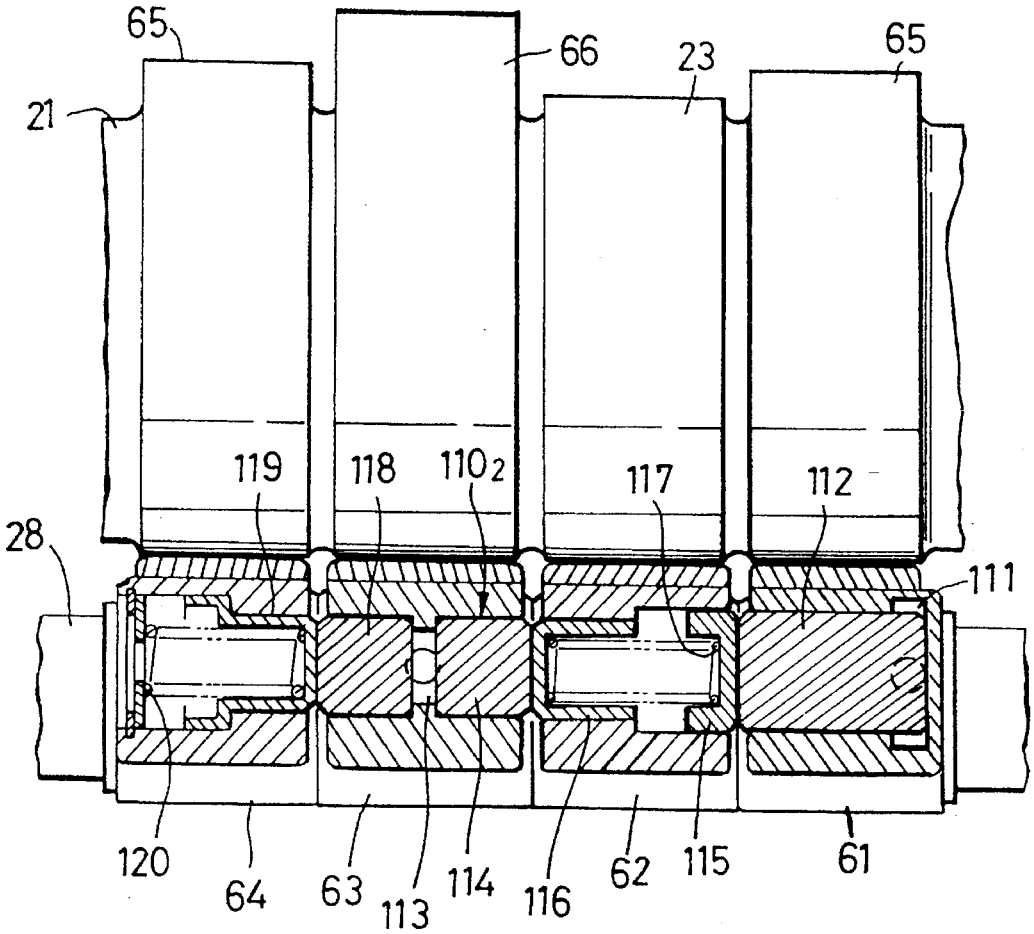
FIG. 15 is a sectional view similar to FIG. 14, but illustrating a ninth embodiment of the present invention.

FIG. 15 illustrates a ninth embodiment of the present invention, wherein portions or components corresponding to those in the above-described embodiments are designated by like reference characters.

A connection switchover means $\mathbf{110}_2$ capable of switching over the connection and disconnection of first, second, third and fourth rocker arms 61, 62, 63 and 64 in combination includes a first switchover piston 112, a second switchover piston 114, a first switchover member 115, a second switchover member 116, a first return spring 117, a third switchover piston 118, a limiting member 119 and a second return spring 120, as in the eighth embodiment, but the ninth embodiment is different from the eighth embodiment in that the pressure receiving area of the first switchover piston 112 facing the first hydraulic pressure chamber 111 is set larger than the pressure receiving area of the second switchover piston 114 facing the second hydraulic pressure chamber 113, and a back of the limiting member 119 opens to the outside.

With the ninth embodiment, in a condition in which the hydraulic pressures in the first and second hydraulic pressure chambers 111 and 113 have been released, the connection of the rocker arms 61, 62, 63 and 64 has been released, as shown in FIG. 15, wherein the intake valve $V_{I1}$ operatively connected to the second rocker arm 62 is brought into a substantially stopped state by the substantially stopping cam 23, and the intake valve $V_{I2}$ operatively connected to the fourth rocker arm 64 is opened and closed with the characteristic corresponding to the profile of the low-speed cam 65.

If a hydraulic pressure is applied to the first hydraulic pressure chamber 111 in a condition in which the hydraulic pressure in the second hydraulic pressure chamber 113 has been released, the first switchover piston 112 causes the first switchover member 115 to be partially fitted into the second rocker arm 62 while urging the first switchover member 115 against the spring force of the first return spring 117, thereby interconnecting the first and second rocker arms 61 and 62, whereas the second and third rocker arms 62 and 63 remain disconnected from each other, and the third and fourth rocker arms 63 and 64 remain disconnected from each other. Thus, the intake valves $V_{I1}$ and $V_{I2}$ are opened and closed with the characteristic corresponding to the profiles of the low-speed cam 65, 65.

If a hydraulic pressure is applied to both the first and second hydraulic pressure chambers 111 and 113, a hydraulic pressure force is applied to the second switchover piston 114 in a direction to urge the second switchover member 116 against the spring force of the return spring 117, but a hydraulic pressure force is also applied to the first switchover piston 112 in a direction to urge the first switchover member 115 against the spring force of the first return spring 117. Because the pressure receiving area of the first switchover piston 112 facing the first hydraulic pressure chamber 111 is larger than the pressure receiving area of the second switchover piston 112 facing the second hydraulic pressure chamber 113, the hydraulic pressure force applied to the first switchover piston 112 is larger than that applied to the second switchover piston 114. As a result, only the first switchover piston 112 is fitted into the second rocker arm 62, so that the abutting surfaces of the second switchover piston 114 and the second switchover member 116 are located between the second and third rocker arms 62 and 63. In addition, the third switchover piston 118 is partially fitted into the fourth rocker arm 64 against the spring force of the second return spring 120. Thus, the first and second rocker arms 61 and 62 are interconnected, and the third and fourth rocker arms 63 and 64 are interconnected, so that the one intake valve $V_{I1}$ is opened and closed with the characteristic corresponding to the profile of the low-speed cam 65, while the other intake valve $V_{I2}$ is opened and closed with the characteristic corresponding to the profile of the high-speed cam 66.

Further, if a hydraulic pressure is applied to the second hydraulic pressure chamber 113 in a condition in which the hydraulic pressure in the first hydraulic pressure chamber 111 has been released, the second switchover piston 114 is partially fitted into the second rocker arm 62, and the third switchover piston 118 is partially fitted into the fourth rocker arm 64. Thus, the second, third and fourth rocker arms 62, 63 and 64 are connected together, so that both the intake valves $V_{I1}$ and $V_{I2}$ are opened and closed with the characteristic corresponding to the profile of the high-speed cam 66.

Figure 16:
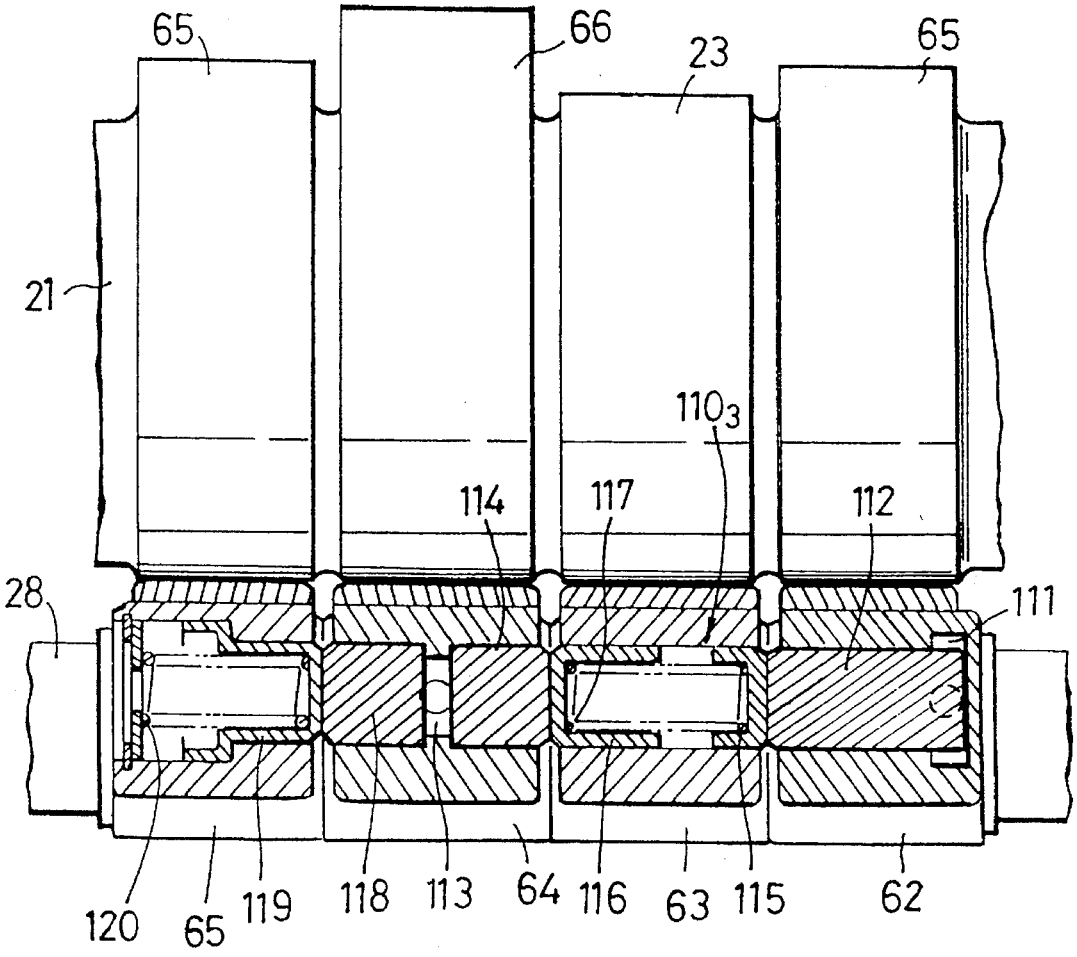
FIG. 16 is a sectional view similar to FIG. 14, but illustrating a tenth embodiment of the present invention.

FIG. 16 illustrates a tenth embodiment of the present invention, wherein portions or components corresponding to those in the above-described embodiments are designated by like reference characters.

A connection switchover means $\mathbf{110_3}$ capable of switching over the connection and disconnection of first, second, third and fourth rocker arms 61, 62, 63 and 64 in combination includes a first switchover piston 112, a second switchover piston 114, a first switchover member 115, a second switchover member 116, a first return spring 117, a third switchover piston 118, a limiting member 119 and a second return spring 120, as in the eighth embodiment, but the tenth embodiment is different from the eighth embodiment in that a back of the limiting member 119 opens to the outside, and the hydraulic pressure applied to the first hydraulic pressure chamber 111 is larger than that applied to the second hydraulic pressure chamber 113.

With the tenth embodiment, the connection and disconnection of the first, second, third and fourth rocker arms 61, 62, 63 and 64 in combination can be switched over in the same manner as in ninth embodiment.

Figure 17:
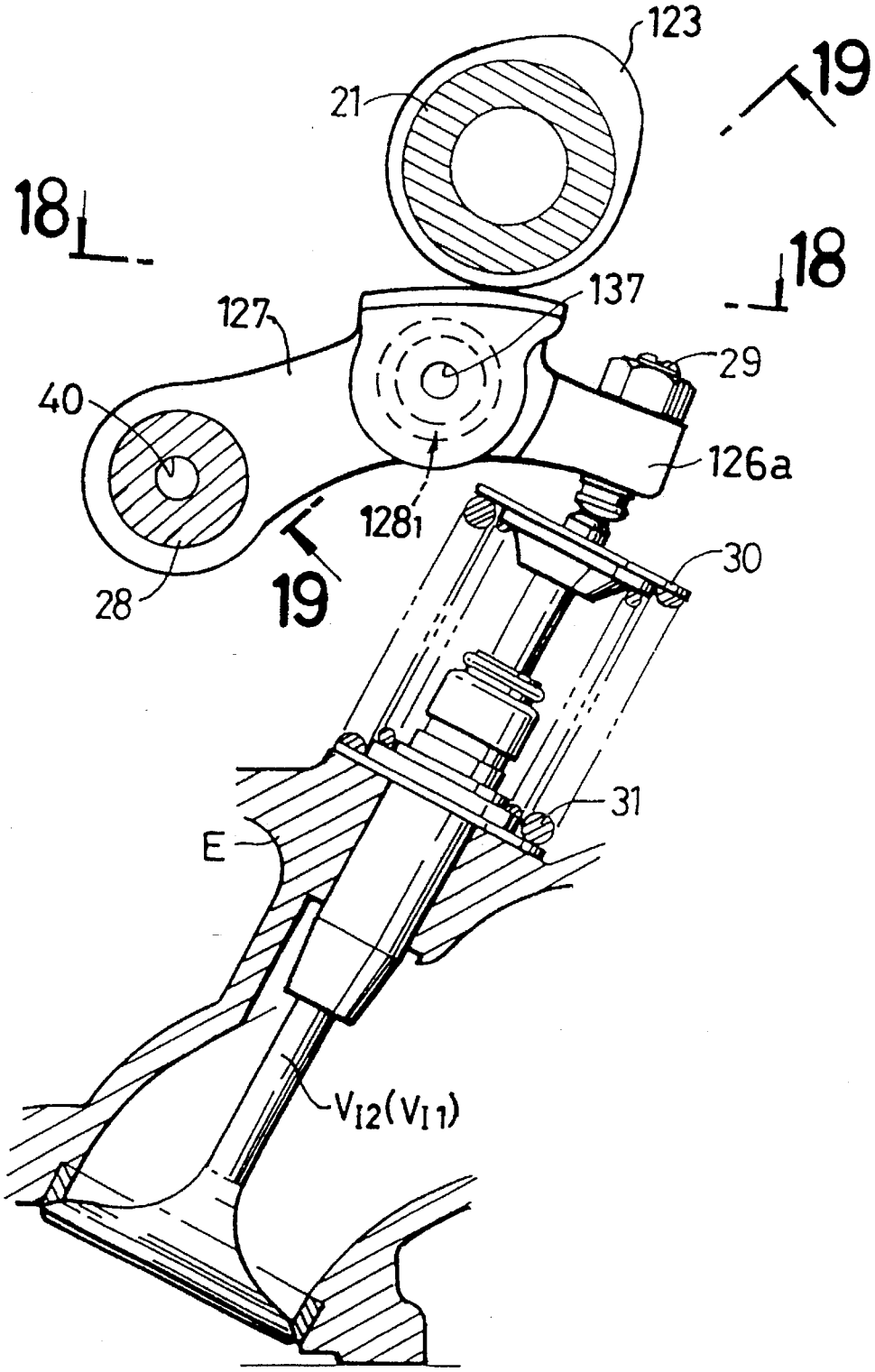
Figure 18:
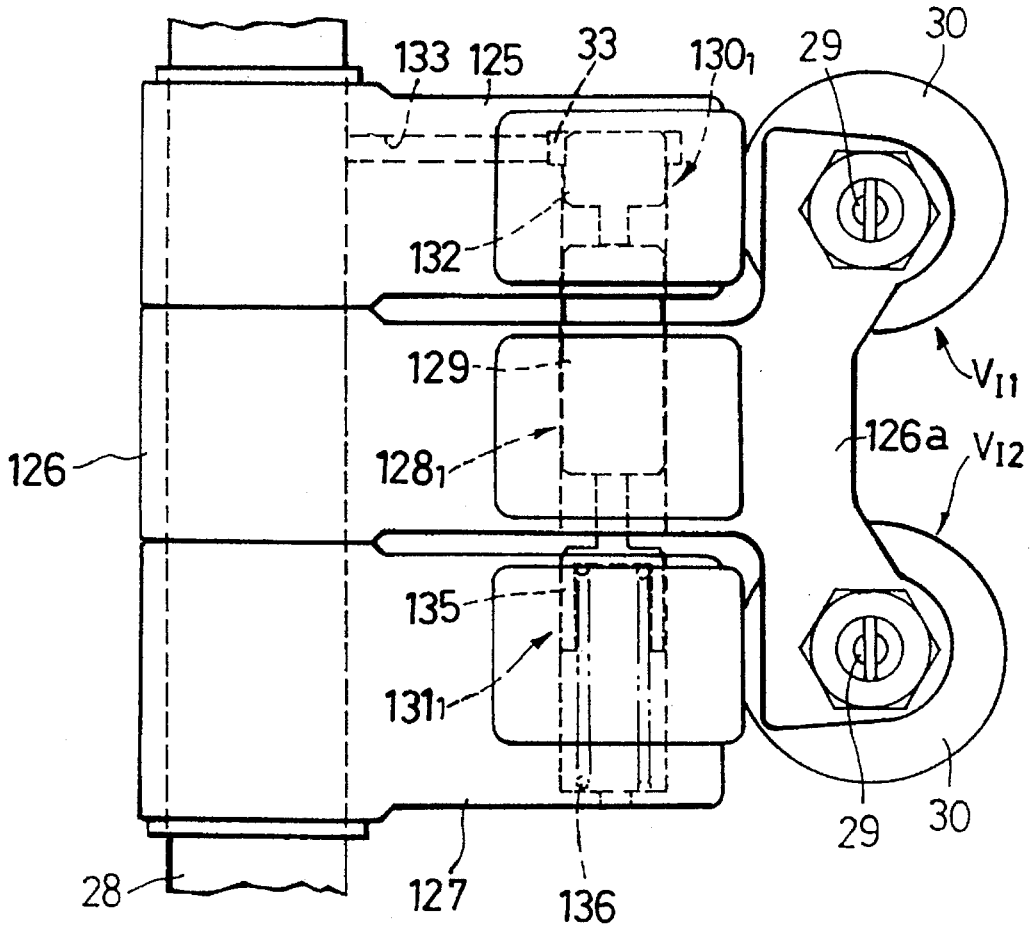
Figure 19:
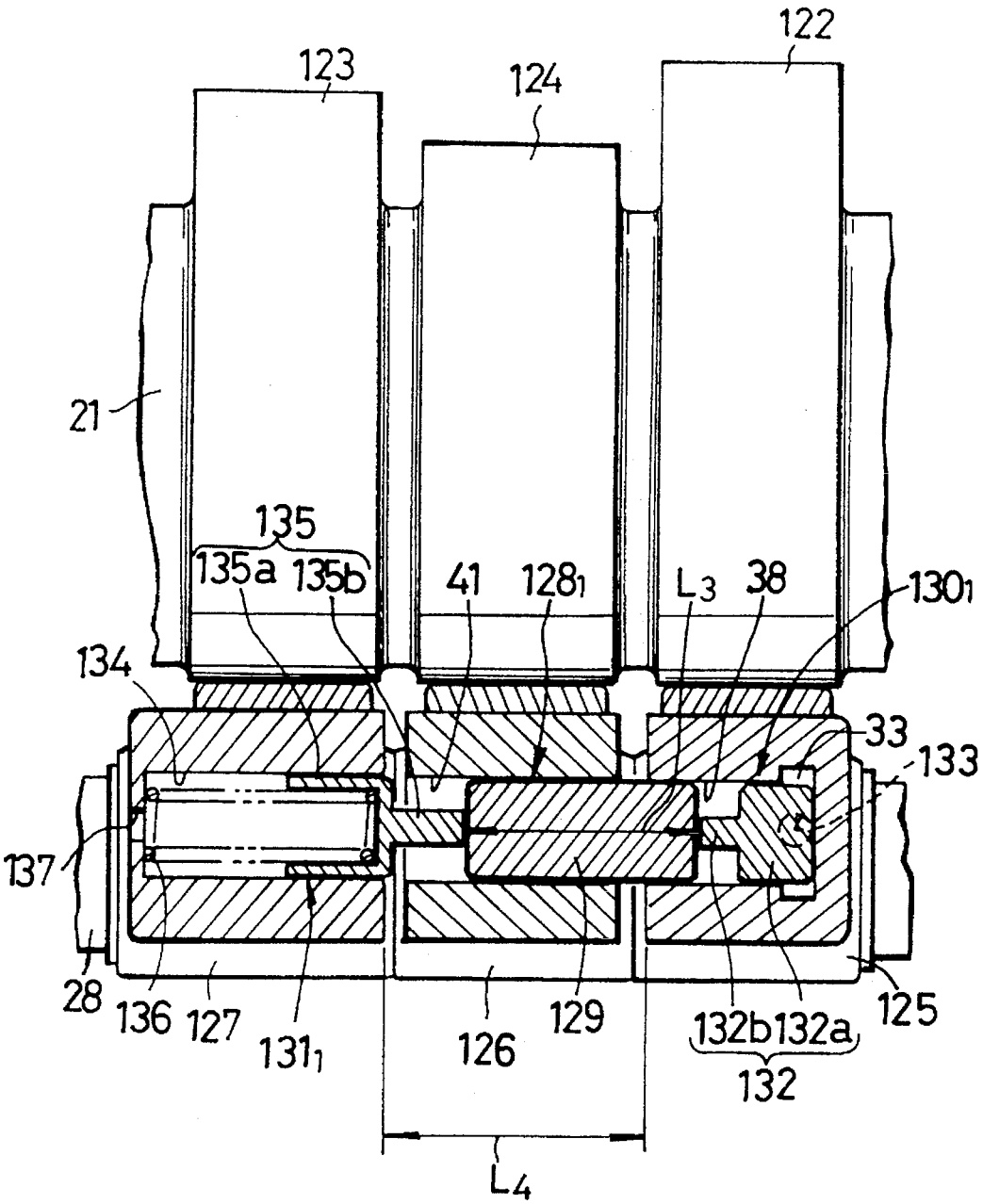
Figure 20:
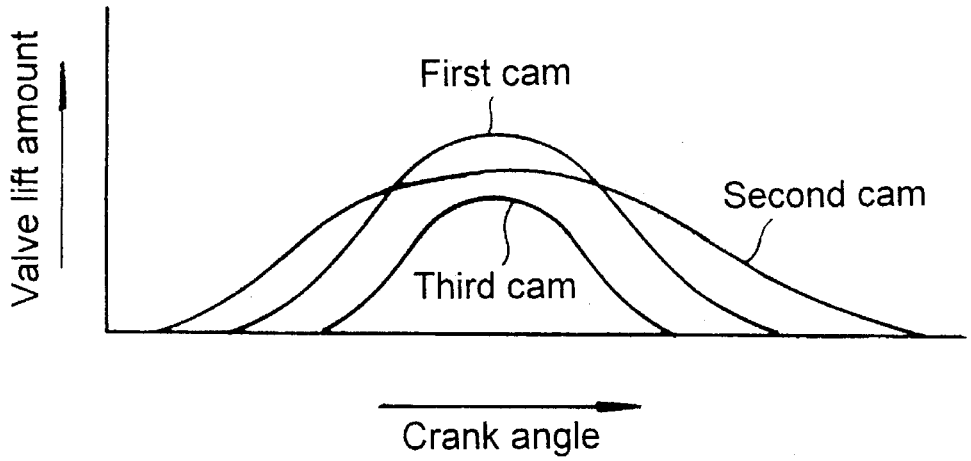

FIGS. 17 to 20 illustrate an eleventh embodiment of the present invention. FIG. 17 is a vertical sectional side view; FIG. 18 is a plan view taken along a line $\mathbf{18_1 8}$ in FIG. 17; FIG. 19 is a sectional view taken along a line $\mathbf{19_1 9}$ in FIG. 17; and FIG. 20 illustrates cam profiles.

A pair of intake valves $V_{I1}$ and $V_{I2}$ are opened and closed by the actions of first, second and third cams 122, 123 and 124 integrally provided on a cam shaft 21 and by the actions of a driving rocker arm 126 and first and second free rocker arms 125 and 127 which are adjacently arranged for swinging movement about a common axis parallel to the cam shaft 21.

First, second and third cams 122, 123 and 124 are integrally provided on a cam shaft 21, so that the third cam 124 is sandwiched between the first and second cams 122 and 123. The first, second and third cams 122, 123 and 124 have cam profiles, respectively, as shown in FIG. 20. More specifically, the first and second cams 122 and 123 have cam profiles intersecting each other, and the third cam 124 has a cam profile in which the valve lift amount and opening angle are smaller than those provided by the first and second cams 122 and 123.

The driving rocker arm 126 and the free rocker arms 125 and 127 are arranged adjacent one another with the driving rocker arm 126 being sandwiched between the first and second free rocker arms 125 and 127, and are swingably carried on a common rocker arm shaft 28 which is rotatably carried on an engine body E below the cam shaft 21. Moreover, the first and second cams 122 and 123 are provided on the cam shaft 21 in independent correspondence to the first and second free rocker arms 125 and 127, and the third cam 124 is provided on the cam shaft 21 in correspondence to the driving rocker arm 126.

The driving rocker arm 126 is integrally provided with a bifurcated connecting arm portion **126*a* extending toward the intake valves $V_{I1}$ and $V_{I2}$. Tappet screws 29, 29 are threadedly inserted into the connecting arm portion 126*a*** for advancing and retreating movements and capable of abutting against upper ends of the intake valves $V_{I1}$ and $V_{I2}$.

The connection and disconnection of the rocker arms 125, 126 and 127 in combination are switched over by a connection switchover means $\mathbf{128_1}$. The connection switchover means $\mathbf{128_1}$ includes a switchover pin 129 slidably fitted into the driving rocker arm 126, a first biasing mechanism $\mathbf{130_1}$ disposed in the first free rocker arm 125 and capable of exhibiting a biasing force for biasing the switchover pin 129 in an axially one direction, and a second biasing mechanism $\mathbf{131_1}$ disposed in the second free rocker arm 127 and capable of exhibiting a biasing force for biasing the switchover pin 129 in the axially other direction.

The driving rocker arm 126 has a guide bore 41 provided therein, which opens at opposite ends and which is parallel to the rocker arm shaft 28, and the columnar switchover pin 129 is slidably fitted into the guide bore 41. The axial length $L_3$ of the switchover pin 129 is set smaller than the distance $L_4$ between those sides of the first and second free rocker arms 125 and 127 which are opposed to the driving rocker arms 126.

The first free rocker arm 125 has a bottomed guide hole 38 provided therein in parallel to the rocker arm shaft 28 and in an opposed relation to the guide bore 41. The first biasing mechanism $\mathbf{130}_1$ includes a switchover piston 132 slidably fitted into the guide hole 38 with one end facing a hydraulic pressure chamber 33 which is defined between the switchover piston 132 and a closed end of the guide hole 38. The switchover piston 132 includes a large-diameter portion 132*a* slidably fitted in the guide hole 38, and a small-diameter portion 132*b* coaxially and integrally connected to a side of the large-diameter portion 132*a* opposite from the hydraulic pressure chamber 33 to abut against the switchover pin 129. The axial length of the switchover piston 132 is set such that the other end of the switchover piston 132 is located at a position retracted from between the first free rocker arm 125 and the driving rocker arm 126 toward the guide hole 38 in a condition in which the switchover piston 132 has been slid to a position to minimize the volume of the hydraulic pressure chamber 33, as shown in FIG. 19. The first free rocker arm 125 also has a communication passage 133 provided therein to communicate with the hydraulic pressure chamber 33, and an oil passage 40 (see FIG. 17) is provided in the rocker arm shaft 28 to normally communicate with the communication passage 133 and thus to the hydraulic pressure chamber 33, irrespective of the swung state of the first free rocker arm 125.

The second free rocker arm 127 has a bottomed guide hole 134 provided therein in parallel to the rocker arm shaft 28 and in an opposed relation to the guide bore 41. The second biasing mechanism $\mathbf{131}_1$ includes a limiting member 135 slidably fitted into the guide hole 134, and a return spring 136 mounted under compression between a closed end of the guide hole 134 and the limiting member 135. The limiting member 135 includes a bottomed cylindrical portion 135*a* slidably fitted into the guide hole 134, and a small-diameter shaft portion 135*b* coaxially connected to a closed end of the bottomed cylindrical portion 135*a* to abut against the switchover pin 129. An opening bore 137 is provided in the closed end of the guide hole 134.

The operation of the eleventh embodiment will be described below. In a condition in which the hydraulic pressure in the hydraulic pressure chamber 33 has been released, i.e., the first biasing mechanism $\mathbf{130}_1$ exhibits no biasing force, the limiting member 135, the switchover pin 129 and the switchover piston 132 are in their states in which they have been moved to the maximum toward the hydraulic pressure chamber 33, with one end of the switchover pin 129 being fitted into the guide hole 38 in the first free rocker arm 125, and with the other end of the switchover pin 129 being in abutment against the small-diameter shaft portion 135*b* of the limiting member 135 within the guide hole 41 in the driving rocker arm 126. In this condition, the first free rocker arm 125 and the driving rocker arm 126 are interconnected by the switchover pin 129, but the small-diameter shaft portion 135*b* inserted into the guide bore 41 permits a relatively swinging movement of the driving rocker arm 126 and the second free rocker arm 127 and hence, the driving rocker arm 126 and the second free rocker arm 127 are in their disconnected states. Thus, the intake valves $V_{I1}$ and $V_{I2}$ are opened and closed with the characteristic corresponding to the cam profile of the first cam 122.

If a relatively low hydraulic pressure enough to overcome the spring force of the return spring 136 of the second biasing mechanism $\mathbf{131}_1$ is applied to the hydraulic pressure chamber 33, the switchover piston 132 urges the switchover pin 129 to interconnect the driving rocker arm 126 and the second free rocker arm 127, while compressing the return spring 136. Because the axial length $L_3$ of the switchover pin 129 is set smaller than the distance $L_4$ between those sides of the first and second free rocker arms 125 and 127 which are opposed to the driving rocker arm 126, the switchover pin 129 is moved in response to the first biasing mechanism $\mathbf{130}_1$ exhibiting the biasing force from a state in which it interconnects the first free rocker arm 125 and the driving rocker arm 126 via a state in which it does not connect the driving rocker arm 126 to any of the first and second free rocker arms 125 and 127 to a state in which it interconnects the driving rocker arm 126 and the second free rocker arm 127. When the movement of the switchover pin 129 is not completed while the rocker arms 125, 126 and 127 are in their stopped states under the action of base circle portions of the cams 122, 123 and 124, a condition in which the driving rocker arm 126 is not connected to any of the first and second rocker arms 125 and 127 is generated only during one rotation of each of the cams 122, 123 and 124, so that the intake valves $V_{I1}$ and $V_{I2}$ are opened and closed with a characteristic corresponding to the cam profile of the third cam 124.

When the switchover pin 129 is then fitted into the guide hole 134 in the second free rocker arm 127, the driving rocker arm 126 and the second free rocker arm 127 are interconnected, so that the intake valves $V_{I1}$ and $V_{I2}$ are opened and closed with a characteristic corresponding to the cam profile of the second cam 123.

In this way, during switching over between the connection and disconnection by the connection switchover means $\mathbf{128}_1$, the generation of a condition in which both the first and second free rocker arms 125 and 127 are connected to the driving rocker arm 126 is avoided and hence, even if the first and second cams 122 and 123 have the cam profiles intersecting each other, an abnormal behavior such as a jumping cannot be produced in the intake valves $V_{I1}$ and $V_{I2}$. Moreover, when a condition in which the driving rocker arm 126 is not connected to any of the first and second free rocker arms 125 and 127 is generated in the middle of the switching-over between the connection and disconnection by the connection switchover means $\mathbf{128}_1$, the intake valves $V_{I1}$ and $V_{I2}$ are driven by the third cam 124 and therefore, they cannot be stopped.

Figure 21:
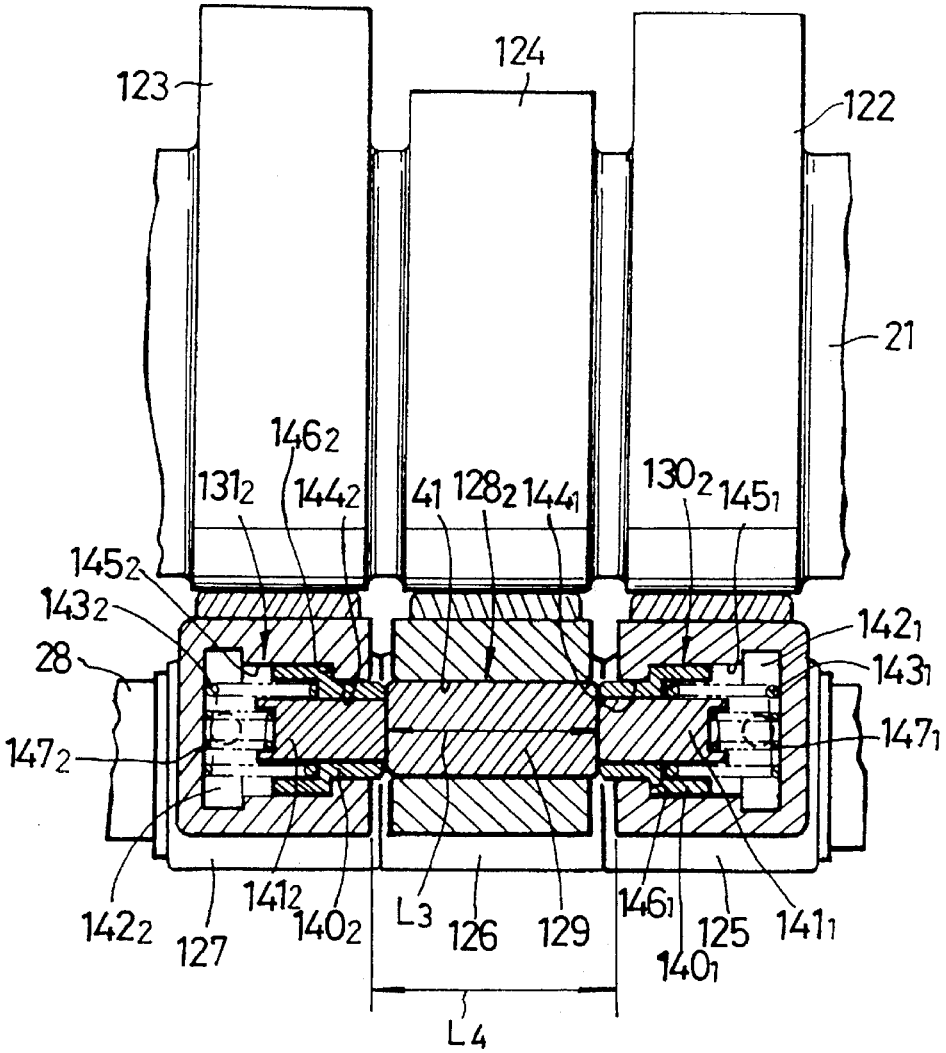
Figure 22:
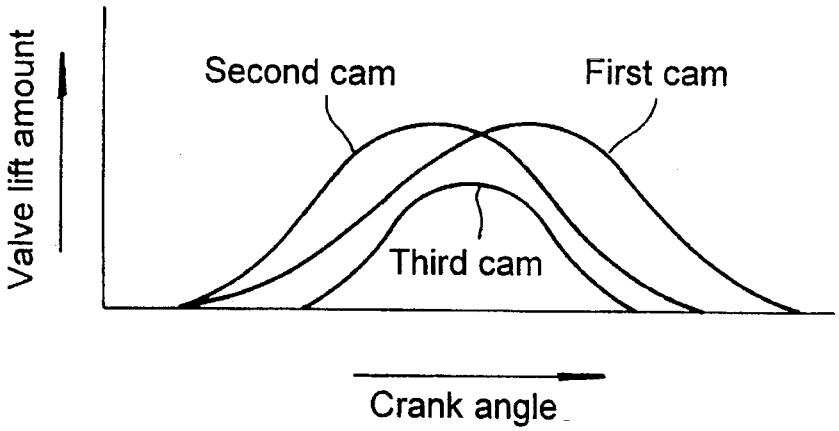

FIGS. 21 and 22 illustrate a twelfth embodiment of the present invention, wherein portions or components corresponding to those in the eleventh embodiment are designated by like reference characters.

First and second free rocker arms 125 and 127 are disposed on opposite sides of a driving rocker arms 126. A first cam 122 corresponding to the first free rocker arm 125, a second cam 123 corresponding to the second free rocker arm 127 and a third cam 124 corresponding to the driving free rocker arm 126 are provided on a cam shaft 21. Moreover, the first and second cams 122 and 123 have cam profiles intersecting each other, as shown in FIG. 22, and the third cam 124 has a cam profile such that the valve lift amount and opening angle are smaller than those provided by the first and second cams 122 and 123.

The connection and disconnection of the rocker arms 125, 126 and 127 in combination are switched over by a connection switchover means $\mathbf{128}_2$. The connection switchover means $\mathbf{128}_2$ includes a switchover pin 129 slidably fitted into the driving rocker arm 126, a first biasing mechanism $\mathbf{130}_2$ disposed in the first free rocker arm 125 and capable of exhibiting a biasing force for biasing the switchover pin 129 in an axially one direction, and a second biasing mechanism $\mathbf{131}_2$ disposed in the second free rocker arm 127 and capable of exhibiting a biasing force for biasing the switchover pin 129 in an axially other direction.

The axial length $L_3$ of the switchover pin 129 slidably fitted in the driving rocker arm 126 is set smaller than the distance $L_4$ between those sides of the first and second free rocker arms 125 and 127 which are opposed to the driving rocker arm 126.

The first biasing mechanism $\mathbf{130}_2$ includes a sleeve $\mathbf{140}_1$ slidably fitted into the first free rocker arm 125, a piston $\mathbf{141}_1$ relatively slidably fitted into the sleeve $\mathbf{140}_1$ to define a hydraulic pressure chamber $\mathbf{142}_1$ between the piston $\mathbf{141}_1$ itself and the first free rocker arm 125 by cooperation with the sleeve $\mathbf{140}_1$, and a return spring $\mathbf{143}_1$ mounted under compression between the sleeve $\mathbf{140}_1$ and the first free rocker arm 125 and accommodated in the hydraulic pressure chamber $\mathbf{142}_1$.

The first free rocker arm 125 is provided with a small-diameter bore $\mathbf{144}_1$ which opens into a side of the first free rocker arm 125 adjacent the driving rocker arm 126 with a diameter corresponding to the guide bore 41 in the driving rocker arm 126, and a bottomed large-diameter guide hole $\mathbf{145}_1$ coaxially connected to the small-diameter bore $\mathbf{144}_1$. A step $\mathbf{146}_1$ is formed between the small-diameter guide bore $\mathbf{144}_1$ and the large-diameter guide hole $\mathbf{145}_1$. The sleeve $\mathbf{140}_1$ is formed into a stepped cylindrical shape and slidably fitted into the small-diameter guide bore $\mathbf{144}_1$ and the large-diameter guide hole $\mathbf{145}_1$ in such a manner that the end of movement thereof toward the driving rocker arm 126 is provided by the step $\mathbf{146}_1$. In a condition in which the movement end has been provided by the step $\mathbf{146}_1$, the end of the sleeve $\mathbf{140}_1$ adjacent the driving rocker arm 126 is located between the first free rocker arm 125 and the driving rocker arm 126. A retaining spring $\mathbf{147}_1$ having a relatively weak spring force is interposed between the piston $\mathbf{141}_1$ and the first free rocker arm 125 for inhibiting an axial chattering of the piston $\mathbf{141}_1$.

The second biasing mechanism $\mathbf{131}_2$ has the basically same construction as the first biasing mechanism $\mathbf{130}_2$ and hence, is only shown with portions corresponding to those in the first biasing mechanism $\mathbf{130}_2$ being designated by reference characters suffixed with "2".

The operation of the twelfth embodiment will be described below. In a condition in which both of the hydraulic pressures in the hydraulic pressure chambers $\mathbf{142}_1$ and $\mathbf{142}_2$ in the first and second biasing mechanisms $\mathbf{130}_2$ and $\mathbf{131}_2$ have been released, one end of the switchover pin 129 is in abutment against the sleeve $\mathbf{140}_1$ and the piston $\mathbf{141}_1$ between the first free rocker arm 125 and the driving rocker arm 126 and the other end the switchover pin 129 is in abutment against the sleeve $\mathbf{140}_2$ and the piston $\mathbf{141}_2$ between the second free rocker arm 127 and the driving rocker arm 126, as a result of application of the spring forces of the return springs $\mathbf{143}_1$ and $\mathbf{143}_2$ to the switchover pin 129 from opposite sides. Thus, the rocker arms 125, 126 and 127 are in their relatively swingable states, so that the intake valve operatively connected to the driving rocker arm 126 is opened and closed with a characteristic corresponding to the cam profile of the third cam 124.

If a hydraulic pressure is applied to the hydraulic pressure $\mathbf{142}_1$ in the first biasing mechanism $\mathbf{130}_2$ in a condition in which the hydraulic pressure in the hydraulic pressure $\mathbf{142}_2$ in the second biasing mechanism $\mathbf{131}_2$ has been released, the piston $\mathbf{141}_1$ in the first biasing mechanism $\mathbf{130}_2$ urges the switchover pin 129 while compressing the return spring $\mathbf{143}_2$ and the retaining spring $\mathbf{147}_2$ in the second biasing mechanism $\mathbf{131}_2$, so that the switchover pin 129 is fitted into the small-diameter guide bore $\mathbf{144}_2$ in the second free rocker arm 127. During this time, the piston $\mathbf{141}_1$ in the first biasing mechanism $\mathbf{130}_2$ is inserted into the driving rocker arm 126, but because the piston $\mathbf{141}_1$ is smaller in diameter than the guide bore 41 in the driving rocker arm 126, the first free rocker arm 125 cannot be connected to the driving rocker arm 126. Thus, the intake valve operatively connected to the driving rocker arm 126 is opened and closed with a characteristic corresponding to the cam profile of the first cam 122.

Further, if a hydraulic pressure is applied to the hydraulic pressure chamber $\mathbf{142}_2$ in the second biasing mechanism $\mathbf{131}_2$ in a condition in which the hydraulic pressure in the hydraulic pressure chamber $\mathbf{142}_1$ in the first biasing mechanism $\mathbf{130}_2$ has been released, the piston $\mathbf{141}_2$ in the second biasing mechanism $\mathbf{131}_2$ urges the switchover pin 129 while compressing the return spring $\mathbf{143}_1$ and the retaining spring $\mathbf{147}_1$ in the first biasing mechanism $\mathbf{130}_2$, so that the switchover pin 129 is fitted into the small-diameter guide bore $\mathbf{144}_1$ in the first free rocker arm 125. During this time, the piston $\mathbf{141}_2$ of the second biasing mechanism $\mathbf{131}_2$ is inserted into the driving rocker arm 126, but because the piston $\mathbf{141}_2$ is smaller in diameter than the guide bore 41 in the driving rocker arm 126, the second free rocker arm 127 cannot be connected to the driving rocker arm 126. Thus, the intake valve operatively connected to the driving rocker arm 126 is opened and closed with a characteristic corresponding to the cam profile of the second cam 123.

Even in this connection switchover means $\mathbf{128}_2$, a condition in which both the first and second free rocker arms 125 and 127 are connected to the driving rocker arm 126 cannot be generated. Therefore, even if the first and second cams 122 and 123 have the profiles intersecting each other, an abnormal behavior such as a valve jumping cannot be produced in the intake valve.

Figure 23:
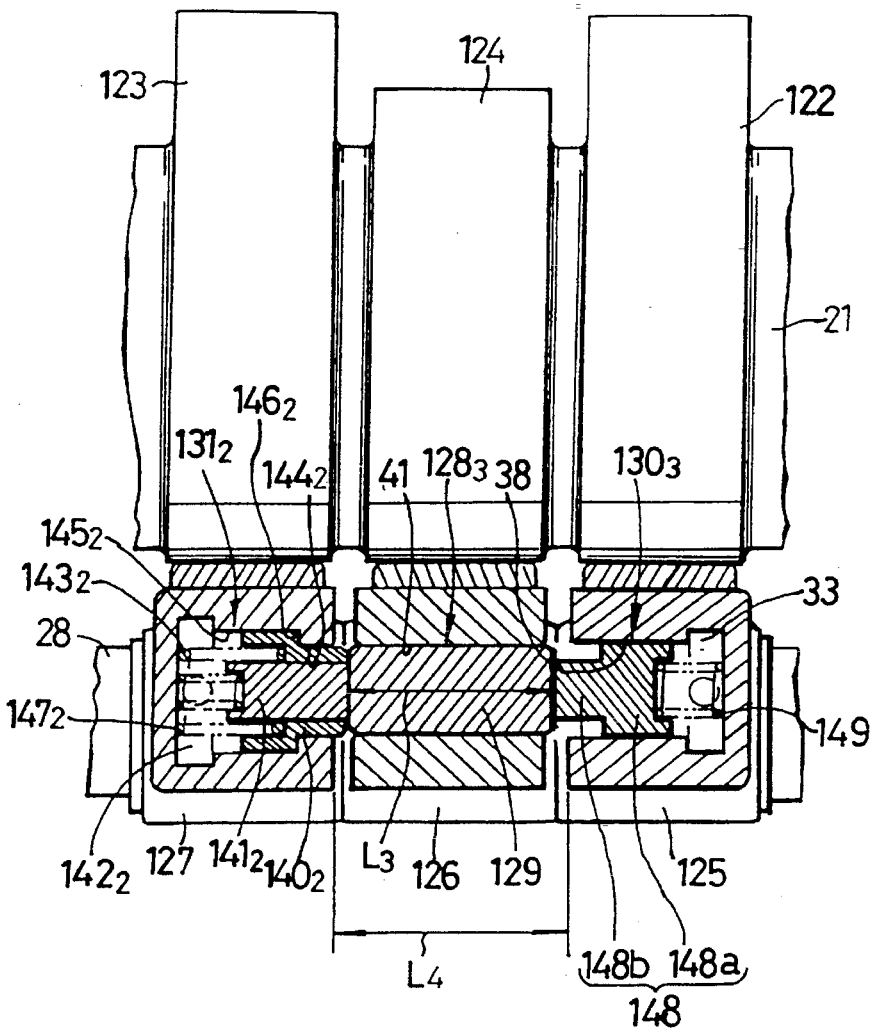
FIG. 23 is a sectional view similar to FIG. 19, but illustrating a thirteenth embodiment of the present invention.

FIG. 23 illustrates a thirteenth embodiment of the present invention, wherein portions or components corresponding to those in the above-described embodiments are designated by like reference characters.

The connection and disconnection of rocker arms 125, 126 and 127 in combination are switched over by a connection switchover means $\mathbf{128}_3$. The connection switchover means $\mathbf{128}_3$ includes a switchover pin 129 slidably fitted into the driving rocker arm 126, a first biasing mechanism $\mathbf{130}_2$ disposed in the first free rocker arm 125 and capable of exhibiting a biasing force for biasing the switchover pin 129 in an axially one direction, and a second biasing mechanism $\mathbf{131}_2$ disposed in the second free rocker arm 127 and capable of exhibiting a biasing force for biasing the switchover pin 129 in an axially other direction.

The axial length $L_3$ of the switchover pin 129 slidably fitted in the driving rocker arm 126 is set smaller than the distance $L_4$ between those sides of the first and second free rocker arms 125 and 127 which are opposed to the driving rocker arm 126.

The first biasing mechanism $\mathbf{130}_2$ includes a piston 148 slidably fitted into a bottomed guide hole 38 provided in the first free rocker arm 125, and a return spring 149 mounted under compression between a closed end of the guide hole 38 and the piston 148. A hydraulic pressure chamber 33 is defined between the closed end of the guide hole 38 and the piston 148, and the return spring 149 is accommodated in the hydraulic pressure chamber 33.

The piston 148 includes a large-diameter portion 148*a* slidably fitted into the guide hole 38, and a small-diameter portion 148*b* coaxially and integrally connected to a side of the large-diameter portion 148*a* opposite from the hydraulic pressure chamber 33 to abut against the switchover pin 129.

Moreover, the spring forces of the return spring 149 of the first biasing mechanism $\mathbf{130}_3$ and the return spring $\mathbf{143}_2$ and the retaining spring $\mathbf{147}_2$ of the second biasing mechanism $\mathbf{131}_2$ are set so that a relation, spring forces of return spring $\mathbf{143}_2$ and retaining spring $\mathbf{147}_2$ >spring force of return spring 149 >spring force of return spring $\mathbf{143}_2$ is established.

According to the thirteenth embodiment, in a condition in which both the hydraulic pressures in the first and second biasing mechanisms $\mathbf{130}_3$ and $\mathbf{131}_3$ have been released, one end of the switchover pin 129 is in abutment against the piston 148 between the first free rocker arm 125 and the driving rocker arm 126 and the other end of the switchover pin 129 is in abutment against the sleeve $\mathbf{140}_2$ and the piston 148 between the driving rocker arm 126 and the second free rocker arm 127, as a result of application of the spring forces of the return springs 149 and $\mathbf{143}_2$ to the switchover pin 129 from opposite sides. Therefore, the rocker arms 125, 126 and 127 are in their relatively swingable states, so that the intake valve operatively connected to the driving rocker arm 126 can be opened and closed with a characteristic corresponding to the cam profile of the third cam 124.

If a hydraulic pressure is applied to the hydraulic pressure chamber 33 in the first biasing mechanism $\mathbf{130}_3$ in a condition in which the hydraulic pressure in the hydraulic pressure chamber $\mathbf{142}_2$ in the second biasing mechanism $\mathbf{131}_2$ has been released, the piston 148 of the first biasing mechanism $\mathbf{130}_3$ urges the switchover pin 129 while compressing the return spring $\mathbf{143}_2$ and the retaining spring $\mathbf{147}_2$ in the second biasing mechanism $\mathbf{131}_2$, so that the switchover pin 129 is fitted into the small-diameter guide bore $\mathbf{144}_2$ in the second free rocker arm 127. During this time, the small-diameter portion 148*b* of the piston 148 is inserted into the driving rocker arm 126, but because the small-diameter portion 148*b* is smaller in diameter than the guide bore 41 in the driving rocker arm 126, the first free rocker arm 125 cannot be connected to the driving rocker arm 126. Thus, the intake valve operatively connected to the driving rocker arm 126 is opened and closed with a characteristic corresponding to the cam profile of the first cam 122.

Further, if a hydraulic pressure is applied to the hydraulic pressure chamber $\mathbf{142}_2$ in the second biasing mechanism $\mathbf{131}_2$ in a condition in which the hydraulic pressure in the hydraulic pressure chamber 33 in the first biasing mechanism $\mathbf{130}_3$ has been released, the piston $\mathbf{141}_2$ of the second biasing mechanism $\mathbf{131}_2$ urges the switchover pin 129 while compressing the return spring 149 in the first biasing mechanism $\mathbf{130}_3$, so that the switchover pin 129 is fitted into the guide hole 38 in the first free rocker arm 125. During this time, the piston $\mathbf{141}_2$ of the second biasing mechanism $\mathbf{131}_2$ is inserted into the driving rocker arm 126, but because the piston $\mathbf{141}_2$ is smaller in diameter than the guide bore 41 in the driving rocker arm 126, the second free rocker arm 127 cannot be connected to the driving rocker arm 126. Thus, the intake valve operatively connected to the driving rocker arm 126 is opened and closed with a characteristic corresponding to the cam profile of the second cam 123.

Even in this connection switchover means $\mathbf{128}_3$, a condition in which both the first and second free rocker arms 125 and 127 are connected to the driving rocker arm 126 cannot be generated. Therefore, even if the first and second cams 122 and 123 have the cam profiles intersecting each other, an abnormal behavior such as a valve jumping cannot be produced in the intake valve.

The pressure receiving area of the piston 148 facing the hydraulic pressure chamber 33 is larger than the pressure receiving area of the piston $\mathbf{141}_2$ of the second biasing mechanism $\mathbf{131}_2$ facing the hydraulic pressure chamber $\mathbf{142}_2$. Therefore, when the same hydraulic pressure is applied simultaneously to the both the hydraulic pressure chambers 33 and $\mathbf{137}_2$, it is possible to prevent the switchover pin 129 from being urged and driven by the piston $\mathbf{141}_2$ in a direction to be fitted into the first free rocker arm 125.

Figure 24:
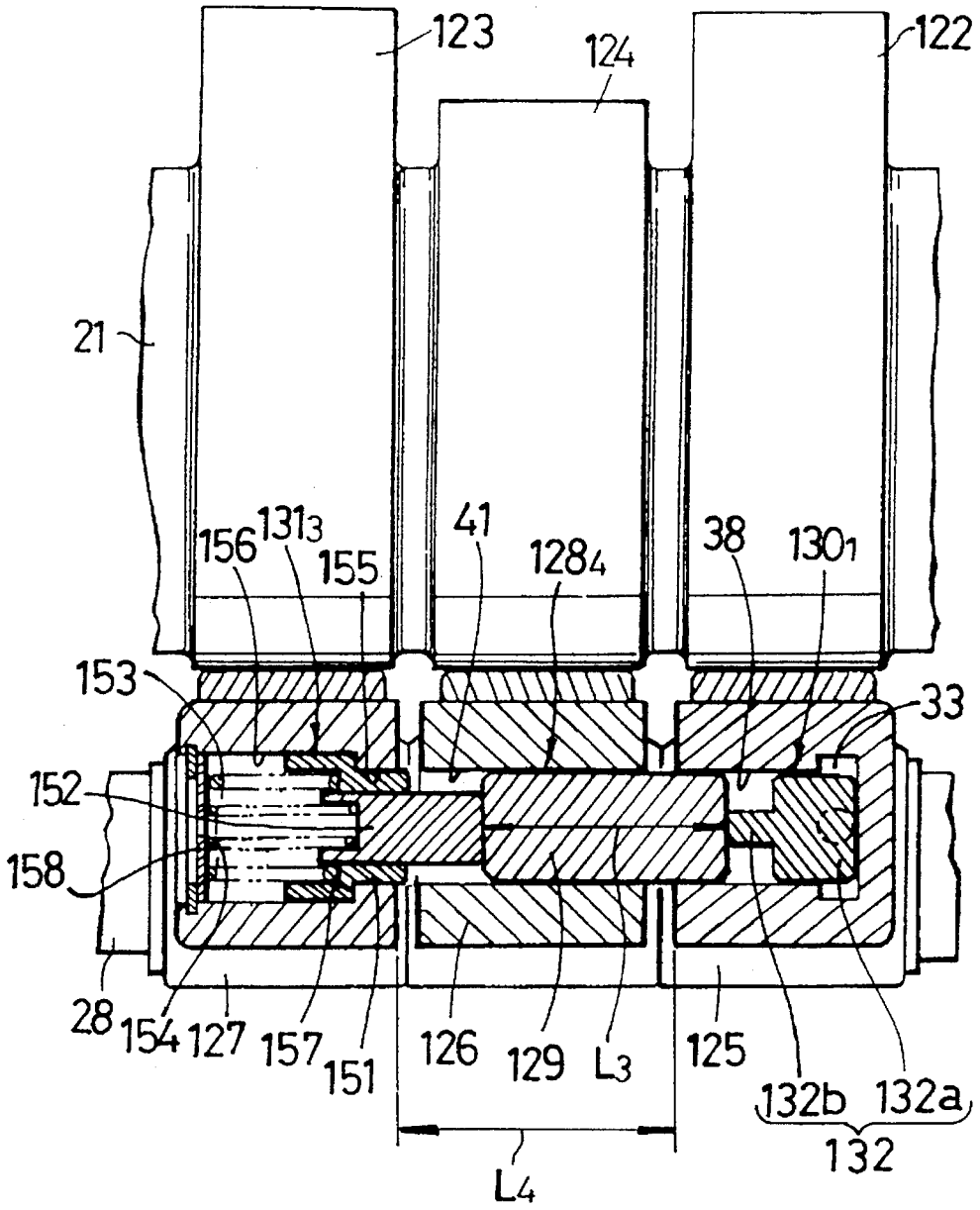
FIG. 24 is a sectional view similar to FIG. 19, but illustrating a fourteenth embodiment of the present invention.

FIG. 24 illustrates a fourteenth embodiment of the present invention, wherein portion or components corresponding to those in the above-described embodiments are designated by like reference characters.

The connection and disconnection of rocker arms 125, 126 and 127 in combination are switched over by a connection switchover means $\mathbf{128}_4$. The connection switchover means $\mathbf{128}_4$ includes a switchover pin 129 slidably fitted into the driving rocker arm 126, a first biasing mechanism $\mathbf{130}_1$ disposed in the first free rocker arm 125 and capable of exhibiting a biasing force for biasing the switchover pin 129 in an axially one direction, and a second biasing mechanism $\mathbf{131}_3$ disposed in the second free rocker arm 127 and capable of exhibiting a biasing force for biasing the switchover pin 129 in an axially other direction.

The axial length $L_3$ of the switchover pin 129 slidably fitted in the driving rocker arm 126 is set smaller than the distance $L_4$ between those sides of the first and second free rocker arms 125 and 127 which are opposed to the driving rocker arm 126.

The second biasing mechanism $\mathbf{131}_3$ includes a first limiting member 151 slidably fitted into the second free rocker arm 127, a second short columnar limiting member 152 relatively slidably fitted into the first limiting member 151, a first return spring 153 mounted under compression between the first limiting member 151 and the second free rocker arm 127, and a second return spring 154 mounted under compression between the second limiting member 152 and the second free rocker arm 127.

The second free rocker arm 127 is provided with a small-diameter guide bore 155 which opens into a side of the second free rocker arm 127 adjacent the driving rocker arm 126 and has a diameter corresponding to the guide bore 41 in the driving rocker arm 126, and a large-diameter guide bore 156 coaxially connected to the small-diameter guide bore 155. A step 157 is formed between the small-diameter guide bore 155 and the large-diameter guide bore 156. A retainer 158 is fixedly disposed at an outer end of the large-diameter guide bore 156. The first limiting member 151 is formed into a stepped cylindrical shape and slidably fitted into the small-diameter guide bore 155 and the large-diameter guide bore 156 in such a manner that the end of movement thereof toward the driving rocker arm 126 is provided by the step 157. Thus, in a condition in which the movement end has been provided by the step 157, an end of the first limiting member 151 adjacent the driving rocker arm 126 is located at a position intermediate between the second free rocker arm 127 and the driving rocker arm 126. The first return spring 153 is mounted under compression between the first limiting member 151 and the retainer 158, and the second return spring 154 is mounted under compression between the second limiting member 152 and the retainer 158. The spring force of the first return spring 153 is set larger than the spring force of the second return spring 154.

According to the fourteenth embodiment, in a condition in which the hydraulic pressure in the hydraulic pressure chamber 33 has been released, i.e., in a condition in which the first biasing mechanism $\mathbf{130_1}$ exhibits no biasing force, the second limiting member 152, the switchover pin 129 and the switchover piston 132 are in their states in which they have been moved to the maximum toward the hydraulic pressure chamber 33 by a biasing force of the first return spring 154 of the second biasing mechanism $\mathbf{131_3}$, with one end of the switchover pin 129 being fitted into the guide hole 38 in the first free rocker arm 125 and the other end of the switchover pin 129 being in abutment against the second limiting member 152 within the guide bore 41 in the driving rocker arm 126. In such condition, the first free rocker arm 125 and the driving rocker arm 126 are interconnected by the switchover pin 129, but the second limiting member 152 inserted into the guide bore 41 permits a relatively swinging movement of the driving rocker arm 126 and the second free rocker arm 127 and hence, the driving rocker arm 126 and the second free rocker arm 127 are in their disconnected states. Thus, the intake valve operatively connected to the driving rocker arm 126 is opened and closed with a characteristic corresponding to the cam profile of the first cam 122.

If a relatively low hydraulic pressure enough to overcome the spring force of the second return spring 154 of the second biasing mechanism $\mathbf{131_3}$ is applied to the hydraulic pressure chamber 33, the switchover piston 132 urges the switchover pin 129 toward the second free rocker arm 127 while compressing the second return spring 154. When the switchover pin 129 abuts against the first and second limiting members 151 and 152 of the second biasing mechanism $\mathbf{131_3}$, i.e., when the abutting surfaces of the first and second limiting members 151 and 152 and the switchover pin 129 are located between the driving rocker arm 126 and the second free rocker arm 127, the abutting surfaces of the switchover pin 129 and the switchover piston 132 are located between the driving rocker arm 126 and the first free rocker arm 125, so that the connection of the rocker arms 125, 126 and 127 is released. Thus, the intake valve operatively connected to the driving rocker arm 126 is opened and closed with a characteristic corresponding to the cam profile of the third cam 124.

Further, if a relatively high hydraulic pressure enough to overcome the spring forces of the first and second return springs 153 and 154 of the second biasing mechanism $\mathbf{131_3}$ is applied to the hydraulic pressure chamber 33, the switchover piston 132 urges the switchover pin 129 while compressing both the return springs 153 and 154 of the second biasing mechanism $\mathbf{131_3}$, so that the switchover pin 129 is fitted into the small-diameter guide bore 155 in the second free rocker arm 127. During this time, the small-diameter portion **132*b* of the switchover piston 132 is inserted into the driving rocker arm 126, but because the small-diameter portion 132*b* is smaller in diameter than the guide bore 41 in the driving rocker arm 126, the first free rocker arm 125 cannot be connected to the driving rocker arm 126. Thus, the intake valve operatively connected to the driving rocker arm 126 is opened and closed with the characteristic corresponding to the cam profile of the second cam 122**.

Even in this connection switchover means $\mathbf{128_4}$, a condition in which both the first and second free rocker arms 125 and 127 are connected to the driving rocker arm 126 cannot be generated. Therefore, even if the first and second cams 122 and 123 have the cam profiles intersecting each other, an abnormal behavior such as a valve jumping cannot be produced in the intake valve.

Figure 25:
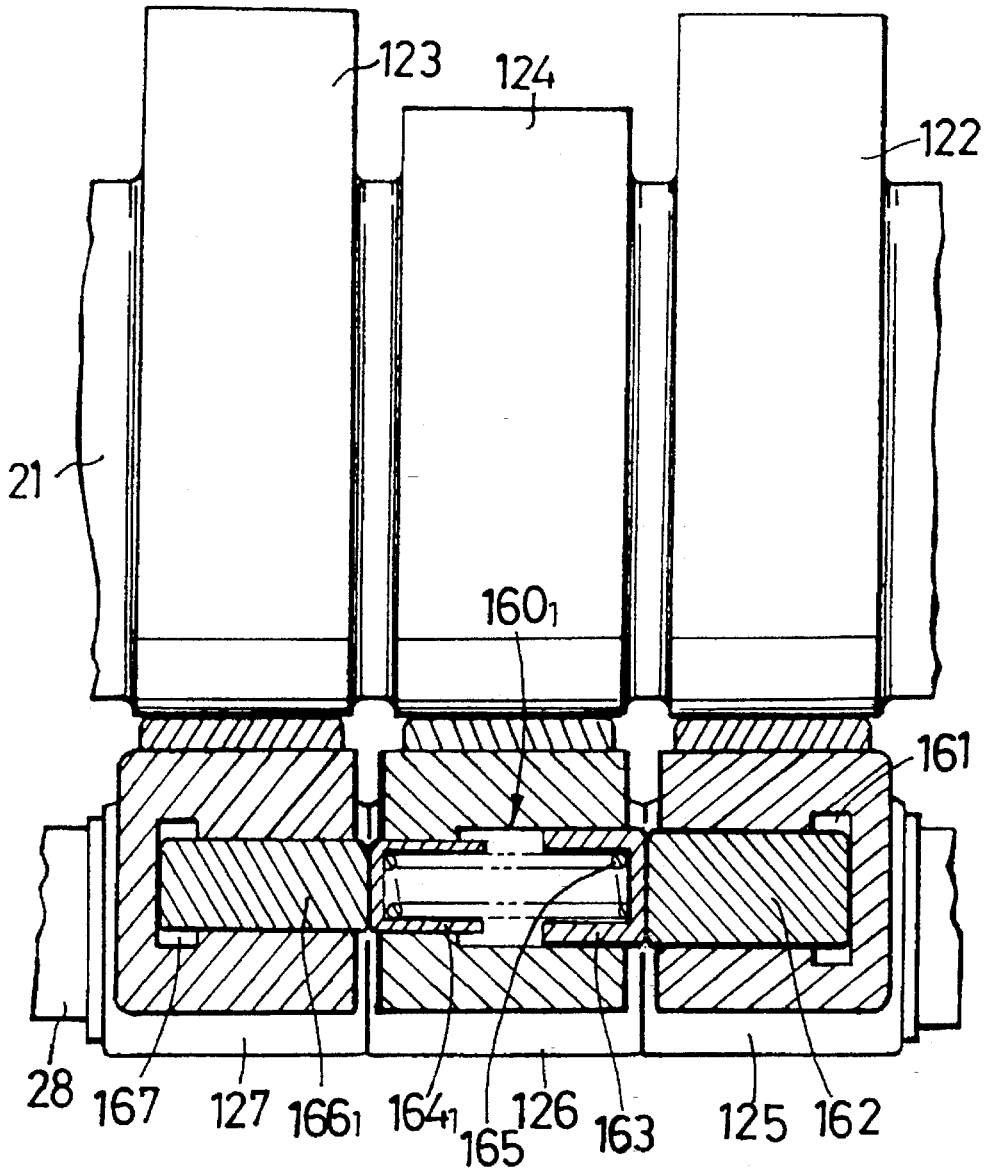
FIG. 25 is a sectional view similar to FIG. 19, but illustrating a fifteenth embodiment of the present invention.

FIG. 25 illustrates a fifteenth embodiment of the present invention, wherein portions or components corresponding to those in the above-described embodiments are designated by like reference characters.

The connection and disconnection of a driving rocker arm 126 operatively connected to an intake valve (not shown) and first and second free rocker arms 125 and 127 adjacently disposed on opposite sides of the driving rocker arm 126 in combination are switched over by a connection switchover means $\mathbf{160_1}$. First and second cams 122 and 123 having cam profiles intersecting each other are provided on a cam shaft 21 in correspondence to the first and second free rocker arms 125 and 127, respectively, and a third cam 124 is provided on the cam shaft 21 in correspondence to the driving rocker arm and has a cam profile such that the valve lift amount and opening angle are smaller than those provided by the first and second cams 122 and 123.

The connection switchover means $\mathbf{160_1}$ includes a first switchover piston 162 slidably fitted into the first free rocker arm 125 with one end facing a first hydraulic pressure chamber 161 and with the other end capable of being fitted into the driving rocker arm 126, a first limiting member 163 slidably fitted into the driving rocker arm 126 to abut against the other end of the first switchover piston 162, a second limiting member $\mathbf{164_1}$ slidably fitted into the driving rocker arm 126 and capable of abutting against the first limiting member 163, a return spring 165 interposed between both the limiting members 163 and $\mathbf{164_1}$ for exhibiting a spring force for biasing the first and second limiting members 163 and $\mathbf{164_1}$ away from each other, and a second switchover piston $\mathbf{166_1}$ slidably fitted into the second free rocker arm 127, with one end capable of being fitted into the driving rocker arm 126 and abutting against the second limiting member $\mathbf{164_1}$ and with the other end facing a second hydraulic pressure chamber 167.

Moreover, each of the first switchover piston 162 and the first limiting member 163 is formed with a diameter larger than those of the second switchover piston $\mathbf{166_1}$ and the second limiting member $\mathbf{164_1}$. The pressure receiving area of the first switchover piston 162 facing the first hydraulic pressure chamber 161 is set larger than the pressure receiving area of the second switchover piston $\mathbf{166_1}$ facing the second hydraulic pressure chamber 167.

According to the fifteenth embodiment, in a condition in which both the hydraulic pressures in the first and second hydraulic pressure chambers 161 and 167 have been released, the abutting surfaces of the first switchover piston 162 and the first limiting members 163 are located between the first free rocker arm 125 and the driving rocker arm 126, and the abutting surfaces of the second switchover piston $\mathbf{166_1}$ and the second limiting member $\mathbf{164_1}$ are located between the driving rocker arm 126 and the second free rocker arm 127, by the spring force of the return spring 165. Therefore, the rocker arms 125, 126 and 127 are in their disconnected states, so that the intake valve operatively connected to the driving rocker arm 126 can be opened and closed with a characteristic corresponding to the cam profile of the third cam 124.

If a hydraulic is then pressure applied to the first hydraulic pressure chamber 161 in a condition in which the hydraulic pressure in the second hydraulic pressure chamber 167 has been released, the first switchover piston 162 urges the first limiting member 163 against the spring force of the return spring 165, until the first limiting member 163 abuts against the second limiting member $\mathbf{164_1}$, whereby the first free rocker arm 125 and the driving rocker arm 126 are interconnected by the first switchover piston 162, so that the intake valve operatively connected to the driving rocker arm 126 is opened and closed with a characteristic corresponding to the cam profile of the first cam 122.

Further, if a hydraulic pressure is applied to the second hydraulic pressure chamber 167 in a condition in which the hydraulic pressure in the first hydraulic pressure chamber 161 has been released, the second switchover piston $\mathbf{166_1}$ urges the second limiting member $\mathbf{164_1}$ against the spring force of the return spring 165, until the second limiting member $\mathbf{164_1}$ abuts against the first limiting member 163, whereby the second free rocker arm 127 and the driving rocker arm 126 are interconnected by the second switchover piston $\mathbf{166_1}$, so that the intake valve operatively connected to the driving rocker arm 126 is opened and closed with a characteristic corresponding to the cam profile of the second cam 123.

Suppose that a hydraulic pressure has been applied to both the first and second hydraulic pressure chambers 161 and 167 in such connection switchover means $\mathbf{160_1}$, hydraulic pressure forces intended to move the first and second switchover pistons 162 and $\mathbf{166_2}$ in directions to increase the volumes of the hydraulic pressure chambers 161 and 167 are applied to the first and second switchover pistons 162 and $\mathbf{166_2}$. However, because the pressure receiving area of the first switchover piston 162 facing the first hydraulic pressure chamber 161 is larger than the pressure receiving area of the second switchover piston $\mathbf{166_1}$ facing the second hydraulic pressure chamber 167, the hydraulic pressure force applied to the first switchover piston 162 from the side of the first hydraulic pressure chamber 161 is larger than that applied to the second switchover piston $\mathbf{166_1}$, and hence, the first free rocker arm 125 and the driving rocker arm 127 are interconnected, but the driving rocker arm 126 and the second free rocker arm 127 are not interconnected. Therefore, it is possible to avoid the generation of a condition in which both the first and second free rocker arms 125 and 127 are connected to the driving rocker arm 126, thereby reliably preventing an abnormal behavior such as a valve jumping from being produced in the intake valve.

Figure 26:
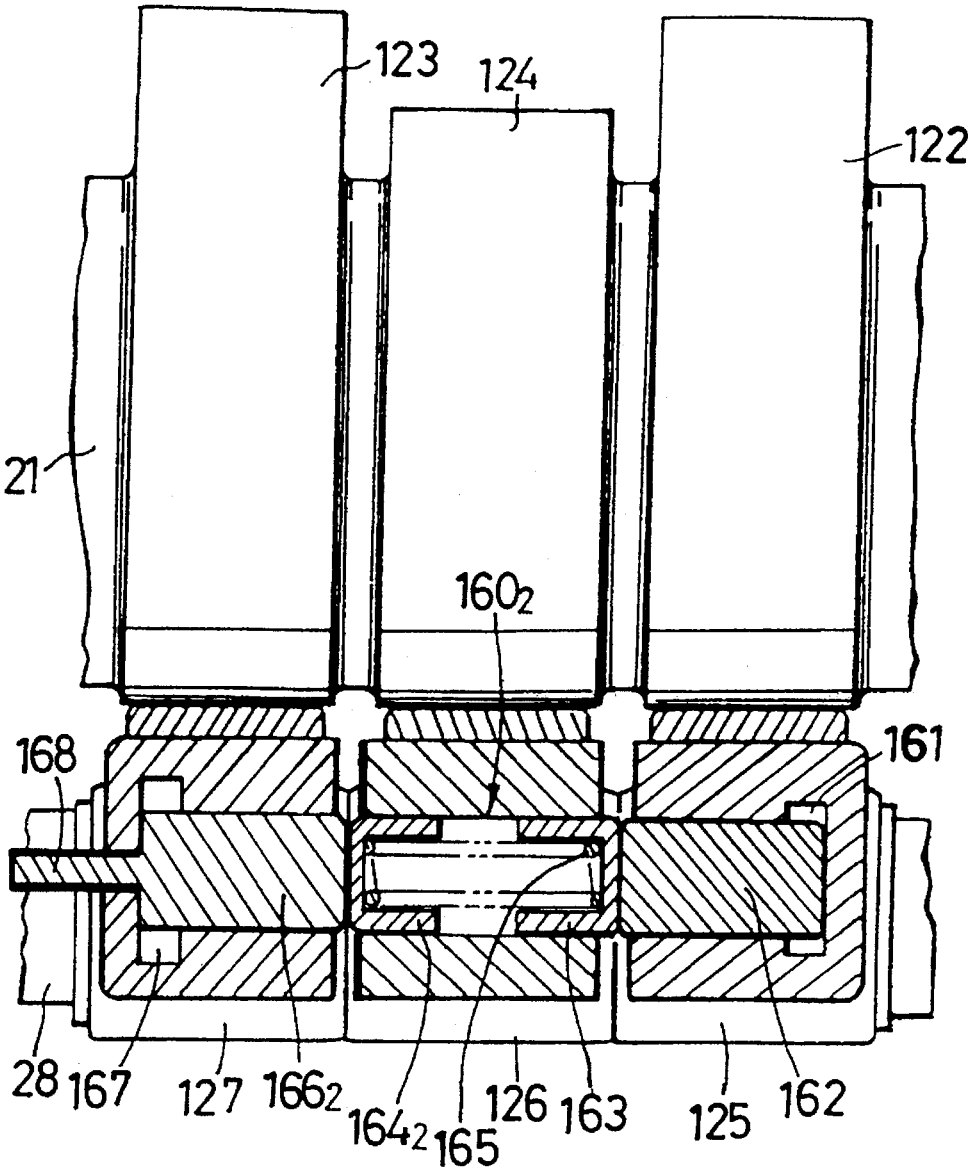
FIG. 26 is a sectional view similar to FIG. 19, but illustrating a sixteenth embodiment of the present invention.

FIG. 26 illustrates a sixteenth embodiment of the present invention, wherein portions or components corresponding to those in the above-described fifteenth embodiment are designated by like reference characters.

The connection of disconnection of driving rocker arm 126 and first and second free rocker arms 125 and 126 adjacently disposed on opposite sides of the driving rocker arm 126 in combination are switched over by a connection switchover means $\mathbf{160_2}$. The connection switchover means $\mathbf{160_2}$ includes a first switchover piston 162 slidably fitted into the driving rocker arm 126 with one end facing a first hydraulic pressure chamber 161 and with the other end capable of being fitted into the driving rocker arm 126, a first limiting member 163 slidably fitted into the driving rocker arm 126 to abut against the other end of the first switchover piston 162, a second limiting member $\mathbf{164_2}$ slidably fitted into the driving rocker arm 126 and capable of abutting against the first limiting member 163, a return spring 165 interposed between both the limiting members 163 and $\mathbf{164_2}$ for exhibiting a spring force for biasing the first and second limiting members 163 and $\mathbf{164_2}$ away from each other, and a second switchover piston $\mathbf{166_2}$ slidably fitted into the second free rocker arm 127 with one end fittable into the driving rocker arm 126 and abutting against the second limiting member $\mathbf{164_2}$ and with the other end facing a second hydraulic pressure chamber 167.

The first switchover piston 162, the first limiting member 163, the second limiting member $\mathbf{164_2}$ and the second switchover piston $\mathbf{166_2}$ are formed into the same diameter. The second switchover piston $\mathbf{166_2}$ has a small-diameter shaft portion 168 coaxially and integrally connected thereto and oil-tightly and slidably passed through the second free rocker arm 127 to protrude to the outside. As a result of provision of the small-diameter shaft portion 168, the pressure receiving area of the second switchover piston $\mathbf{166_2}$ facing the second hydraulic pressure chamber 167 is smaller than the pressure receiving area of the first switchover piston 162 facing the first hydraulic pressure chamber 161.

Even according to the sixteenth embodiment, a function and an effect similar to those in the above-described fifteenth embodiment can be provided.

Alternatively, the pressure receiving area of the first switchover piston 162 facing the first hydraulic pressure chamber 161 and the pressure receiving area of the second switchover piston $\mathbf{166_2}$ facing the second hydraulic pressure chamber 167 may be equal to each other, and hydraulic pressures applied to the first and second hydraulic pressure chamber 167 may be different from each other.

Figure 27:
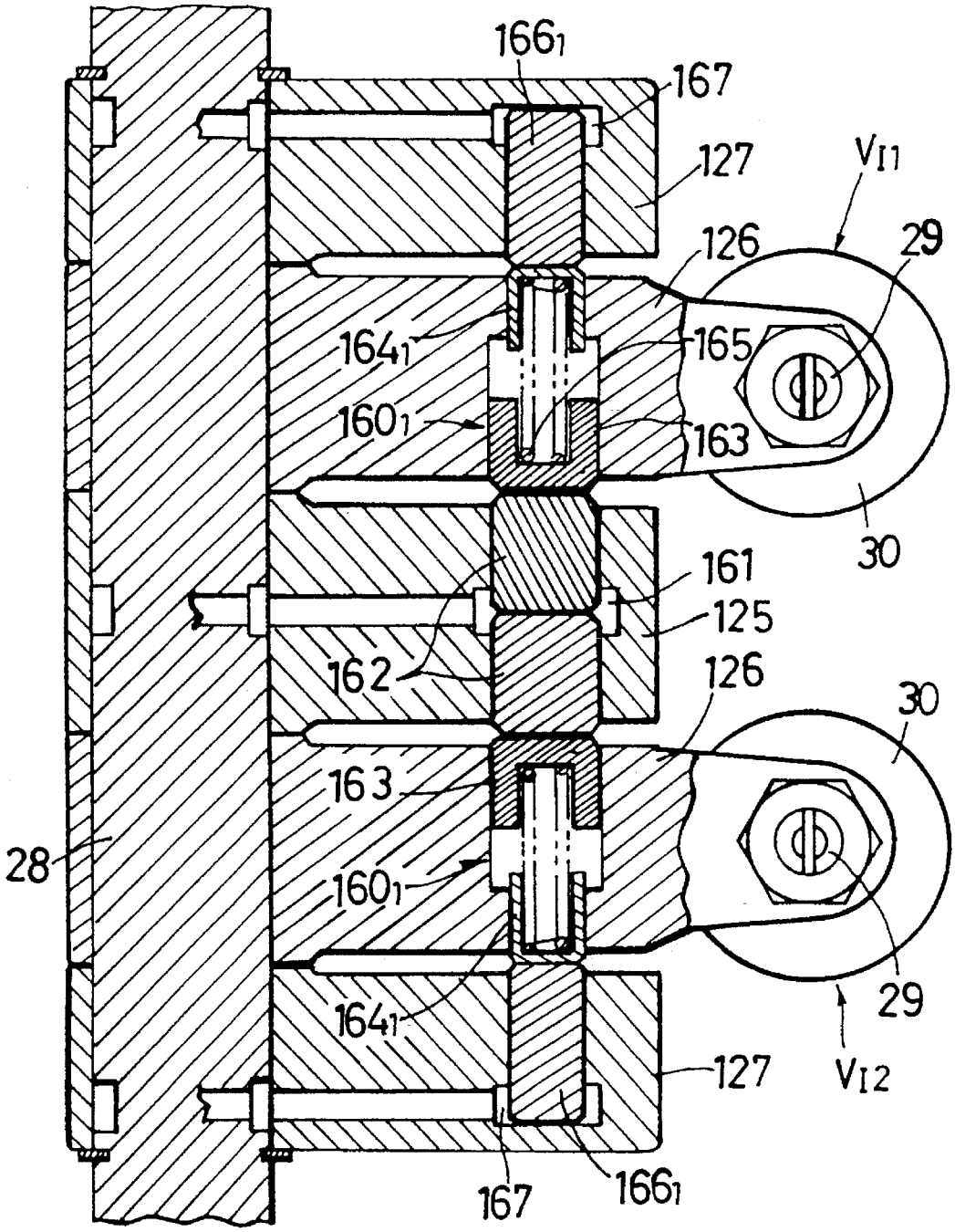
FIG. 27 is a cross-sectional plan view of a seventeenth embodiment of the present invention.
Figure 28:
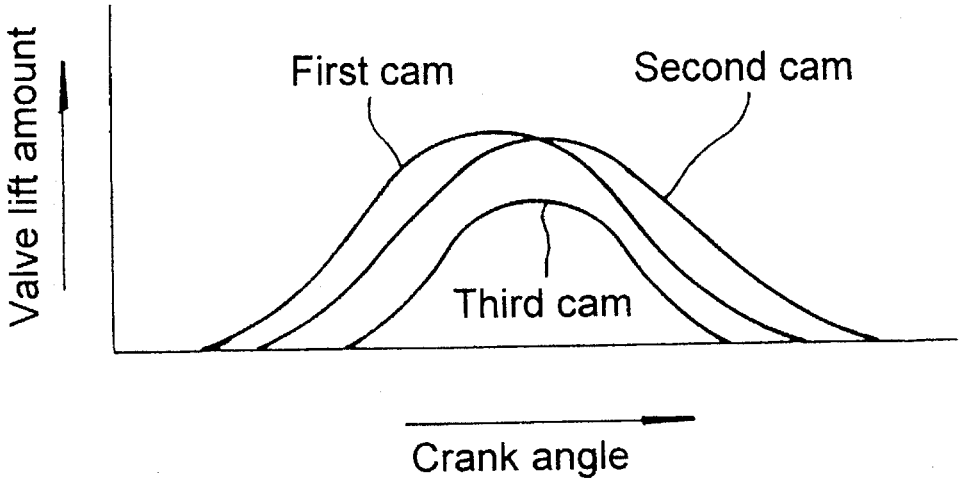
FIGS. 28, 29, 30 and 31 are diagrams each illustrating a modification of a combination of cam profiles.
Figure 29:
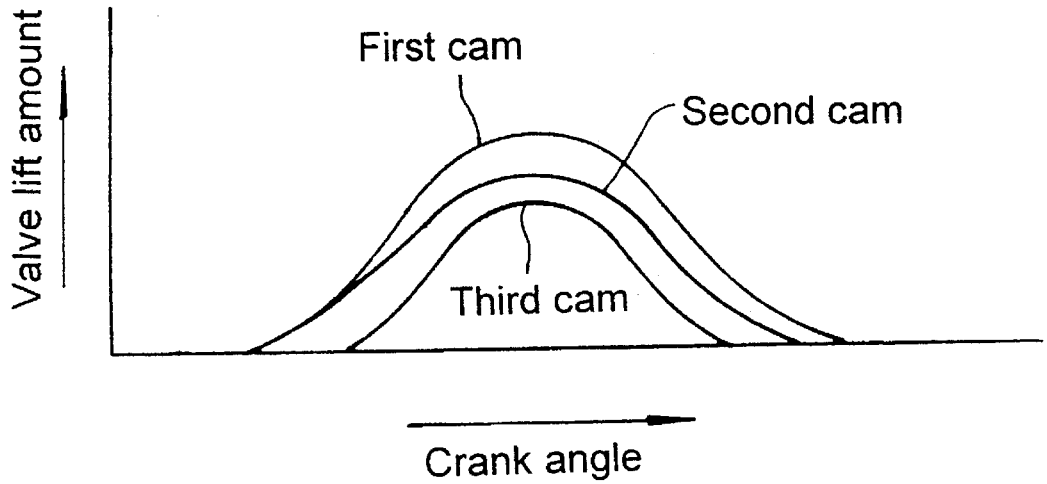
Figure 30:
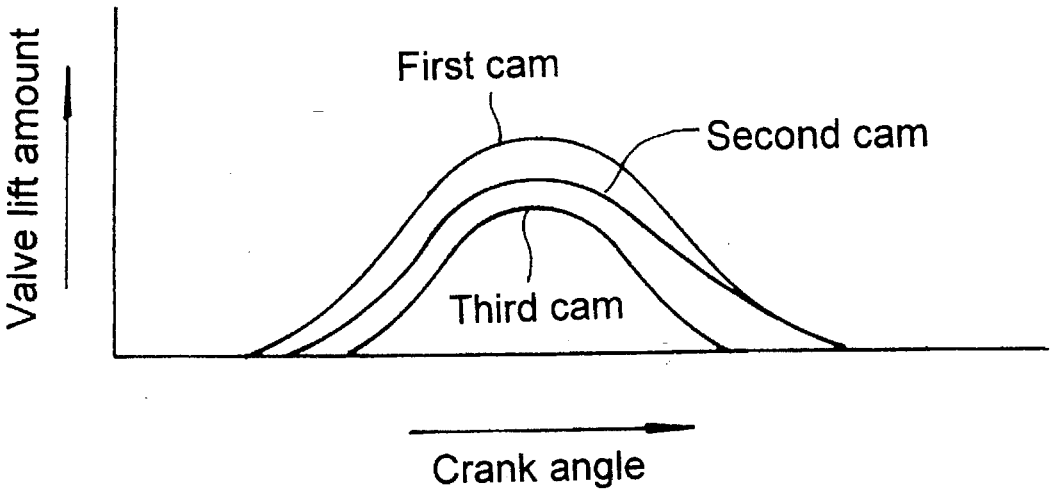
Figure 31:
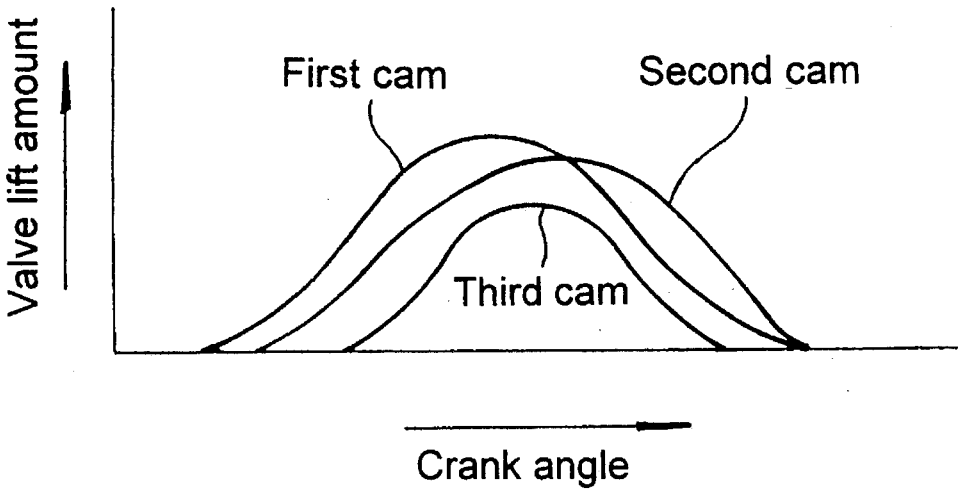

In a seventeenth embodiment of the present invention, driving rocker arms 126, 126 may be disposed adjacently on opposite sides of a first free rocker arm 125, and second free rocker arms 127, 127 may be disposed adjacently on the opposite sides of the driving rocker arms 126, 126 from the first free rocker arm 125, respectively, as shown in FIG. 27. In this case, two sets of connection switchover means $\mathbf{160_1}$, $\mathbf{160_1}$ may be disposed in such a manner that first switchover pistons 162, 162 associated with a common hydraulic pressure chamber 161 may be slidably fitted into central one of the rocker arms in a direction of adjacent arrangement of them, i.e., into the first free rocker arm 125.

A combination of cam profiles of first, second and third cams 122, 123 and 124 may be such as shown in FIGS. 28, 29, 30 and 31.

Figure 32:
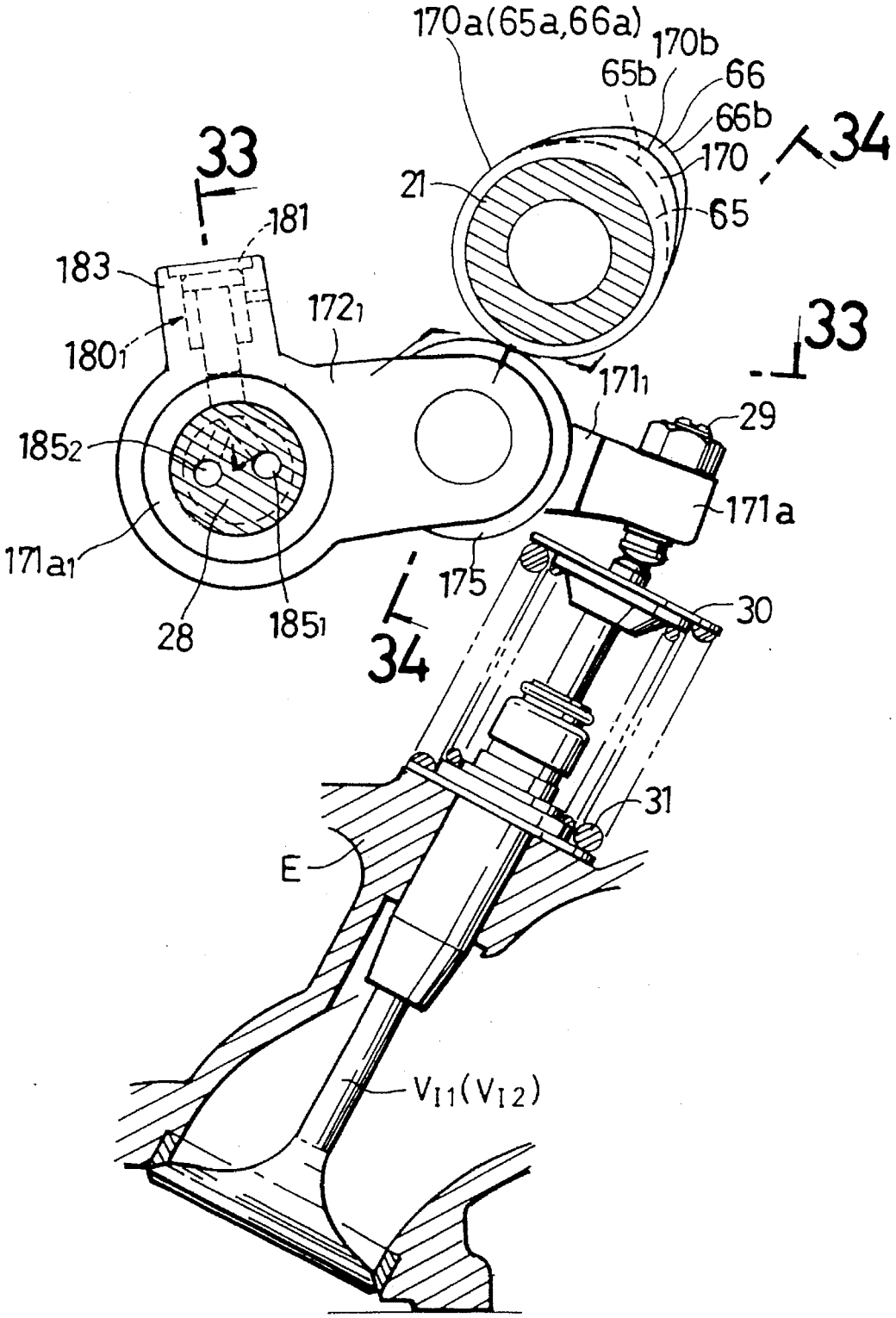
Figure 33:
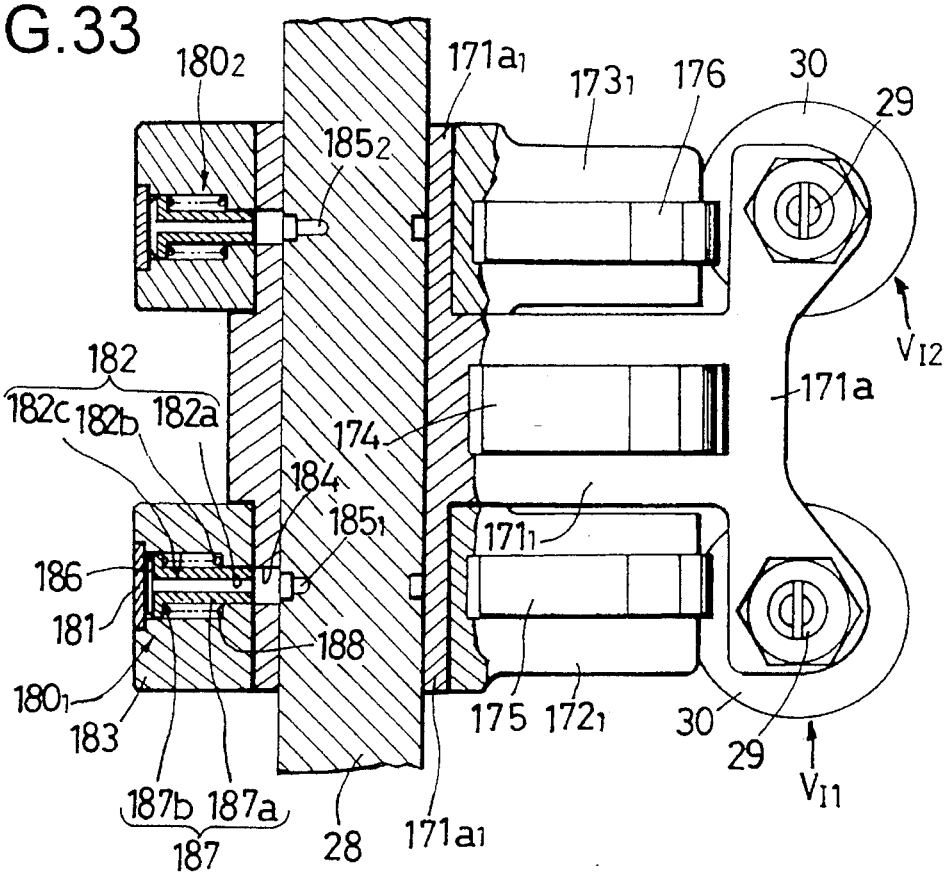
Figure 34:
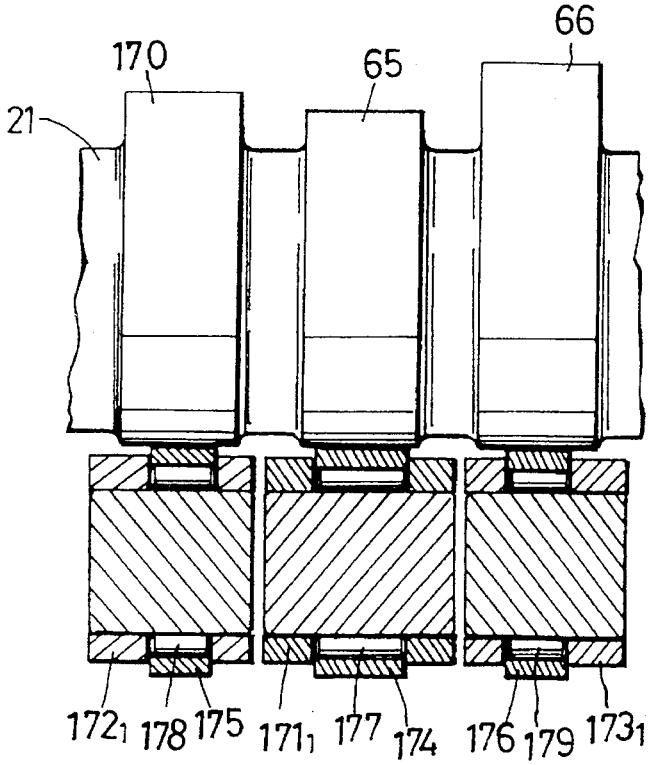

FIGS. 32 to 34 illustrate a eighteenth embodiment of the present invention. FIG. 32 is a vertical sectional side view; FIG. 33 is a sectional view taken along a line 33—33 in FIG. 32; and FIG. 34 is a sectional view taken along a line 34—34 in FIG. 32.

A pair of intake valves $V_{I1}$ and $V_{I2}$ are opened and closed by the actions of a low-speed cam 65, a medium-speed cam 170 and a high-speed cam 66 which are integrally provided on a cam shaft 21, and by the action of first, second and third rocker arms $\mathbf{171_1}$, $\mathbf{172_1}$ and $\mathbf{173_1}$ which are adjacently disposed for swinging movement about a common swinging axis parallel to the cam shaft 21.

The low-speed cam 65, the medium-speed cam 170 and the high-speed cam 66 are integrally provided on the cam shaft 21 in a manner that the low-speed cam 65 is sandwiched between the medium-speed cam 170 and the high-speed cam 66. The low-speed cam 65 has a profile such that a cam lobe **65*b* protrudes radially outwardly from a base circle portion 65*a* spaced at a constant distance apart from an axis of the cam shaft 21. The medium-speed cam 170 has a profile such that a cam lobe 170*b* protrudes radially outwardly from a base circle portion 170*a* of the same radius as the base circle portion 65*a* of the low-speed cam 65 with the amount of protrusion in the radially outward direction of the cam shaft 21 and the center angle range being larger than those of the cam lobe 65*b* of the low-speed cam 65. The high-speed cam 66 has a profile such that a cam lobe 66*b* protrudes radially outwardly from a base circle portion 66*a* corresponding to the base circle portions 65*a* and 170*a* of the low-speed and medium-speed cams 65 and 170 with the amount of protrusion in the radially outward direction of the cam shaft 21 and the center angle range being larger than those of the cam lobe 170***b* of the medium-speed cam 170.

The first rocker arm $\mathbf{171}_1$ is swingably carried on a rocker arm shaft 28. Support sleeves $\mathbf{171}a_1$, $\mathbf{171}a_1$ are integrally provided on the first rocker arm $\mathbf{171}_1$ to extend opposite sideways with their inner surfaces in sliding contact with an outer surface of the rocker arm shaft 28, and the second and third rocker arms $\mathbf{172}_1$ and $\mathbf{173}_1$ adjacently disposed on the opposite sides of the first rocker arm $\mathbf{171}_1$ are swingably carried on the support sleeves $\mathbf{171}a_1$, $\mathbf{171}a_1$.

Moreover, the low-speed cam 65 is provided on the cam shaft 21 in correspondence to the first rocker arm $\mathbf{171}_1$; the medium-speed cam 170 is provided on the cam shaft 21 in correspondence to the second rocker arm $\mathbf{172}_1$, and the high-speed cam 66 is provided on the cam shaft 21 in correspondence to the third rocker arm $\mathbf{173}_1$. Rollers 174, 175 and 176 are rotatably carried on the rocker arms $\mathbf{171}_1$, $\mathbf{172}_1$ and $\mathbf{173}_1$ through needle bearings 177, 178 and 179 to come into rolling contact with the corresponding cams 65, 170 and 66, respectively.

The first rocker arm $\mathbf{171}_1$ has a bifurcated connection arm portion 171*a* integrally provided thereon to extend to a location above the intake valves $V_{I1}$ and $V_{I2}$, and tappet screws 29, 29 are threadedly inserted advanceably and retreatably into the connection arm portion 171*a* and capable of abutting against upper ends of the intake valves $V_{I1}$ and $V_{I2}$. On the other hand, valve springs 31 are interposed between collars 30, 30 provided at upper portions of the intake valves $V_{I1}$ and $V_{I2}$ and an engine body E, so that the intake valves $V_{I1}$ and $V_{I2}$ are biased in a valve-closing direction i.e., upwardly by the actions of the valve springs 31. Further, the second and third rocker arms $\mathbf{172}_1$ and $\mathbf{173}_1$ are resiliently biased in directions to bring the rollers 175 and 176 into rolling contact with the medium-speed cam 170 and the high-speed cam 66 by a lost motion mechanism (not shown) provided between the second and third rocker arms $\mathbf{172}_1$ and $\mathbf{173}_1$ and the engine body E.

Connection switchover means $\mathbf{180}_1$ and $\mathbf{180}_2$ are provided between the support sleeves $\mathbf{171}a_1$, $\mathbf{171}a_1$ integral with the first rocker arm $\mathbf{171}_1$ and the second and third rocker arms $\mathbf{172}_1$ and $\mathbf{173}_1$ swingably carried on the support sleeves $\mathbf{171}a_1$, $\mathbf{171}a_1$.

The second rocker arm $\mathbf{172}_1$ swingably carried on one of the support sleeves $\mathbf{171}a_1$ is provided with a guide portion 183 having a guide bore 182 which has an axis perpendicular to an axis of the rocker arm shaft 28 and which is closed at its outer end by a closing plate 181. The support sleeve $\mathbf{171}a_1$ is provided with an engage bore 184 which is coaxially connected to an inner end of the guide bore 182 when the first and second rocker arms $\mathbf{171}_1$ and $\mathbf{172}_1$ are in their stopped states.

The connection switchover means $\mathbf{180}_1$ provided between the one support sleeve $\mathbf{171}a_1$ and the second rocker arm $\mathbf{172}_1$ includes a switchover piston 187 which is slidably fitted into the guide bore 182 with one end facing a hydraulic pressure chamber 816 leading to an oil passage $\mathbf{185}_1$ provided in the rocker arm shaft 28 and which is slidable between a connecting position in which the other end is fitted into the engage bore 184 and a disconnecting position in which the other end is disengaged from the engage bore 184, and return a spring 188 mounted between the switchover piston 187 and the guide portion 183 for exhibiting a spring force for biasing the switchover piston 187 toward the disconnecting position.

The guide bore 182 includes an axially inner small-diameter bore portion 182*a* having the same diameter as the engage bore 184 provided in the support sleeve $\mathbf{171}a_1$ to lead the oil passage $\mathbf{185}_1$ in the rocker arm shaft 28, and a large-diameter bore portion 182*c* which is coaxially connected to the small-diameter bore portion 182*a* through a step 182*b* and closed at its outer end by the closing plate 181. The switchover piston 187 is formed into a hollow cylinder-like configuration and comprised of a small-diameter cylindrical portion 187*a* slidably fitted into the small-diameter bore portion 182*a*, and a larger diameter cylindrical portion 187*b* which is slidably fitted into the large-diameter bore portion 182*c* to define the hydraulic pressure chamber 196 between the larger diameter cylindrical portion 187*b* itself and the closed outer end portion of the guide bore 182, i.e., the closing plate 181 and which is coaxially connected to an outer end of the small-diameter cylindrical portion 187*a*. Thus, the oil passage $\mathbf{185}_1$ is in communication with the hydraulic pressure chamber 186 through the switchover piston 187. Further, the return spring 188 is mounted under compression between the step 182*b* and the large-diameter cylindrical portion 187*b* to surround the small-diameter cylindrical portion 187*a* of the switchover piston 187.

In such connection switchover means $\mathbf{180}_1$, in a condition in which the hydraulic pressure in the oil passage $\mathbf{185}_1$, i.e., in the hydraulic pressure chamber 186 has been released, the switchover piston 187 is in the disconnecting position in which it has been disengaged from the engage bore 184, thereby disconnecting the support sleeve $\mathbf{171}a_1$, i.e., the first rocker arm $\mathbf{171}_1$ and the second rocker arm $\mathbf{172}_1$ from each other. If a hydraulic pressure is applied to the oil passage $\mathbf{185}_1$, i.e., to the hydraulic pressure chamber 186, the switchover piston 187 is moved against the spring force of the return spring 188 to the connecting position in which it is fitted into the engage bore 184, thereby interconnecting the support sleeve $\mathbf{171}a_1$, i.e., the first rocker arm $\mathbf{171}_1$ and the second rocker arm $\mathbf{172}_1$.

The connection switchover means $\mathbf{180}_2$ provided between the other support sleeve $\mathbf{171}a_1$ and the third rocker arm $\mathbf{173}_1$ has the same construction as the above-described connection switchover means $\mathbf{180}_1$. In a condition in which the hydraulic pressure in an oil passage $\mathbf{185}_2$ provided in the rocker arm shaft 28 and isolated from the oil passage $\mathbf{185}_1$ has been released, the connection of the support sleeve $\mathbf{171}a_1$, i.e., the first rocker arm $\mathbf{171}_1$ and the third rocker arm $\mathbf{173}_1$ has been released. If a hydraulic pressure is applied to the oil passage $\mathbf{185}_2$, the support sleeve $\mathbf{171}a_1$, i.e., the first rocker arm $\mathbf{171}_1$ and the third rocker arm $\mathbf{173}_1$ are interconnected by the connection switchover means $\mathbf{180}_2$.

The operation of the eighteenth embodiment will be described below. In a low-speed operating range of an engine, both the connection switchover means $\mathbf{180}_1$ and $\mathbf{180}_2$ are in their disconnecting states, in which the rocker arms $\mathbf{171}_1$, $\mathbf{172}_1$ and $\mathbf{173}_1$ can be swung independently. Therefore, the first rocker arm $\mathbf{171}_1$ operatively connected to the intake valves $V_{I1}$ and $V_{I2}$ is swung by the low-speed cam 65, so that the intake valves $V_{I1}$ and $V_{I2}$ are opened and closed with a characteristic corresponding to the profile of the low-speed cam 65.

In a medium-speed operating range of the engine, one of the connection switchover means $\mathbf{180}_1$ is in its connecting state, while the other connection switchover means $\mathbf{180}_2$ is in its disconnecting state. If so, the first and second rocker arms $\mathbf{171}_1$ and $\mathbf{172}_1$ are interconnected, and the first rocker arm $\mathbf{171}_1$ is swung by the medium-speed cam 170, so that the intake valves $V_{I1}$ and $V_{I2}$ are opened and closed with a characteristic corresponding to the profile of the medium-speed cam 170.

In a high-speed operating range of the engine, both the connection switchover means $\mathbf{180}_1$ and $\mathbf{180}_2$ are in their connecting states, in which the first rocker arm $171_1$ is swung by the high-speed cam 66, so that the intake valves $V_{I1}$ and $V_{I2}$ are opened and closed with a characteristic corresponding to the profile of the high-speed cam 66.

In such valve operating device, when the rocker arms $171_1$, $172_1$ and $173_1$ are swung in the disconnecting states of the connection switchover means $180_1$ and $180_2$, a centrifugal force is applied to the switchover piston 187 outwardly in a radial direction of the rocker arm shaft 28, i.e., in a direction away from the support sleeve $171a_1$. Therefore, the switchover piston 187 cannot be urged against the support sleeve $171a_1$ by the centrifugal force and hence, a wearing cannot be produced between the switchover piston 187 and the support sleeve $171a_1$.

When the rocker arms $171_1$, $172_1$ and $173_1$ are swung even if the connection switchover means $180_1$ and $180_2$ are in their connecting states, a centrifugal force is applied to the switchover piston 187 outwardly in the radial direction of the rocker arm shaft 28. However, the switchover piston 188 is in its state in which one end thereof is in engagement with the second and third rocker arms $172_1$ and $173_1$ and the other end thereof is in engagement with the support sleeve $171a_1$, i.e., with the first rocker arm $171_1$ and therefore, the valve springs 31 and a shearing force corresponding to an equivalent inertial gravity weight act on the switchover piston 187 and thus, the switchover piston 187 cannot be moved to the disconnecting state by the centrifugal force produced during swinging movements of the rocker arms $171_1$, $172_1$ and $173_1$. When the rocker arms $171_1$, $172_1$ and $173_1$ are maintained in their stopped states by the base circle portions 65*a*, 170*a* and 66*a* of the corresponding cams 65, 170 and 66, such centrifugal force cannot be applied to the switchover piston 187 and thus, the switchover piston 187 is moved smoothly to the disconnecting position in response to releasing of the hydraulic pressure.

Further, each of the support sleeves $171a_1$, $171a_1$ may have a wall thickness enough to permit the switchover piston 187 to be partially fitted into the support sleeve $171a_1$ during connecting operation of the connection switchover means $180_1$, $180_2$. Therefore, each of the support sleeves $171a_1$, $171a_1$ can be formed into a relatively small thickness, thereby correspondingly reducing the weight of the first rocker arm $171_1$ and reducing the sizes of the second and third rocker arms $172_1$ and $173_1$. Moreover, the guide portion 183 provided on each of the second and third rocker arms $172_1$ and $173_1$ for disposition of each of the connection switchover means $180_1$ and $180_2$ may be provided with a diameter permitting the accommodate of the switchover piston 187 and the return spring 188 to project from each of the second and third rocker arms $172_1$ and $173_1$ in the radial direction of the rocker arm shaft 28. Therefore, it is possible to minimize the increase in weight, and in cooperation with the relatively small outside diameter of the support sleeves $171a_1$, $171a_1$, it is possible to provide a reduction in sizes of the second and third rocker arms $172_1$ and $173_1$ and to reduce the inertial moment to provide an increase in speed of rotation.

Since the hydraulic pressure chamber 186 and the oil passages $185_1$ and $185_2$ are in communication with each other through the hollow cylindrical switchover piston 187, oil passages connecting the oil passages $185_1$ and $185_2$ and the hydraulic pressure chamber 186 need not be provided in the guide portion 183, and therefore, it is possible to simplify the construction to reduce the number of machining steps.

Moreover, the oil passages $185_1$ and $185_2$ connected to the connection switchover means $180_1$ and $180_2$ are provided in the rocker arm shaft 28 supported on the engine body E and hence, even in a multi-cylinder internal combustion engine, it is unnecessary to provide hydraulic pressure circuits in a cylinder head in correspondence to every cylinders, thereby enabling a simplification of a hydraulic pressure circuit.

Figure 35:
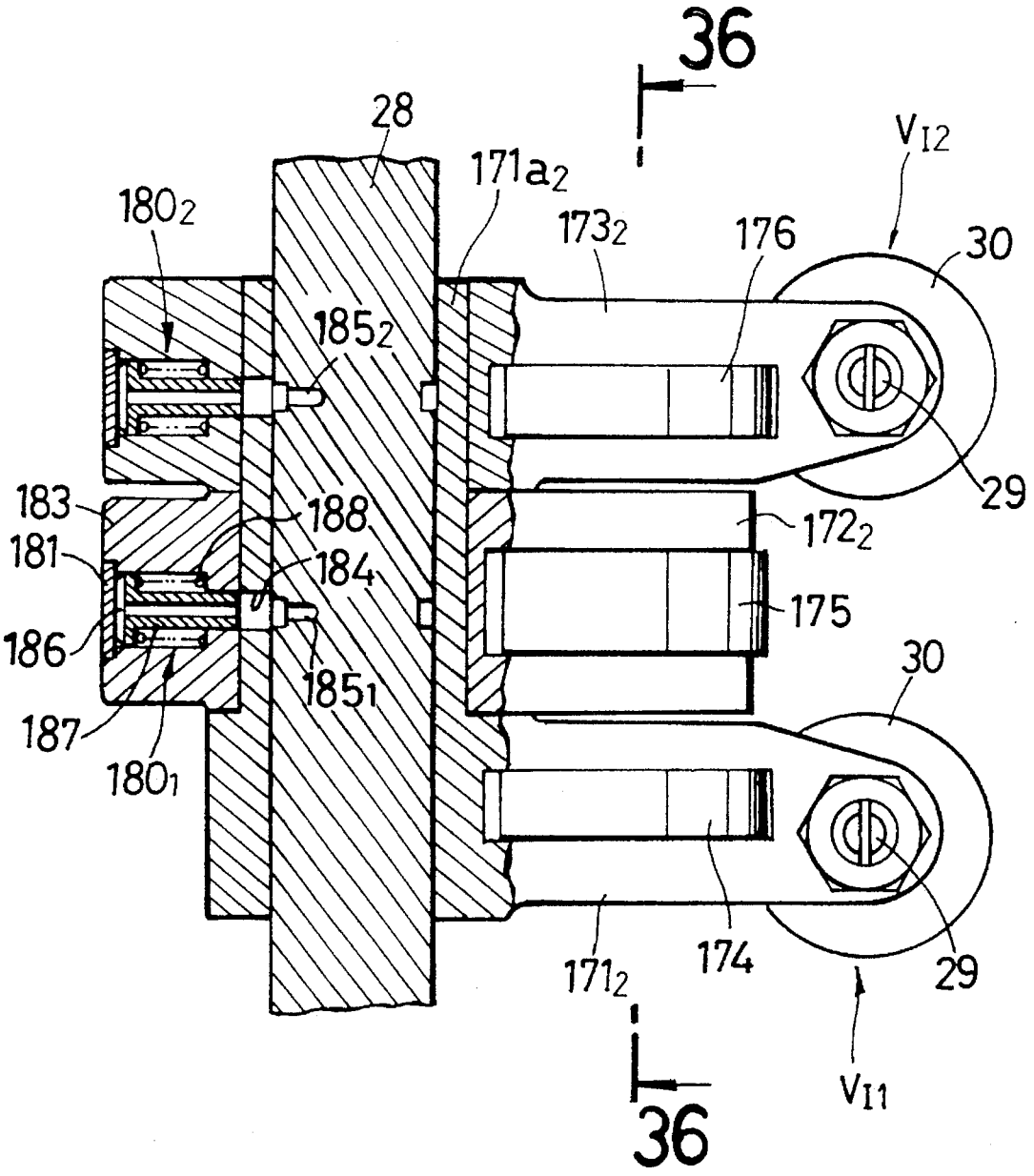
Figure 36:
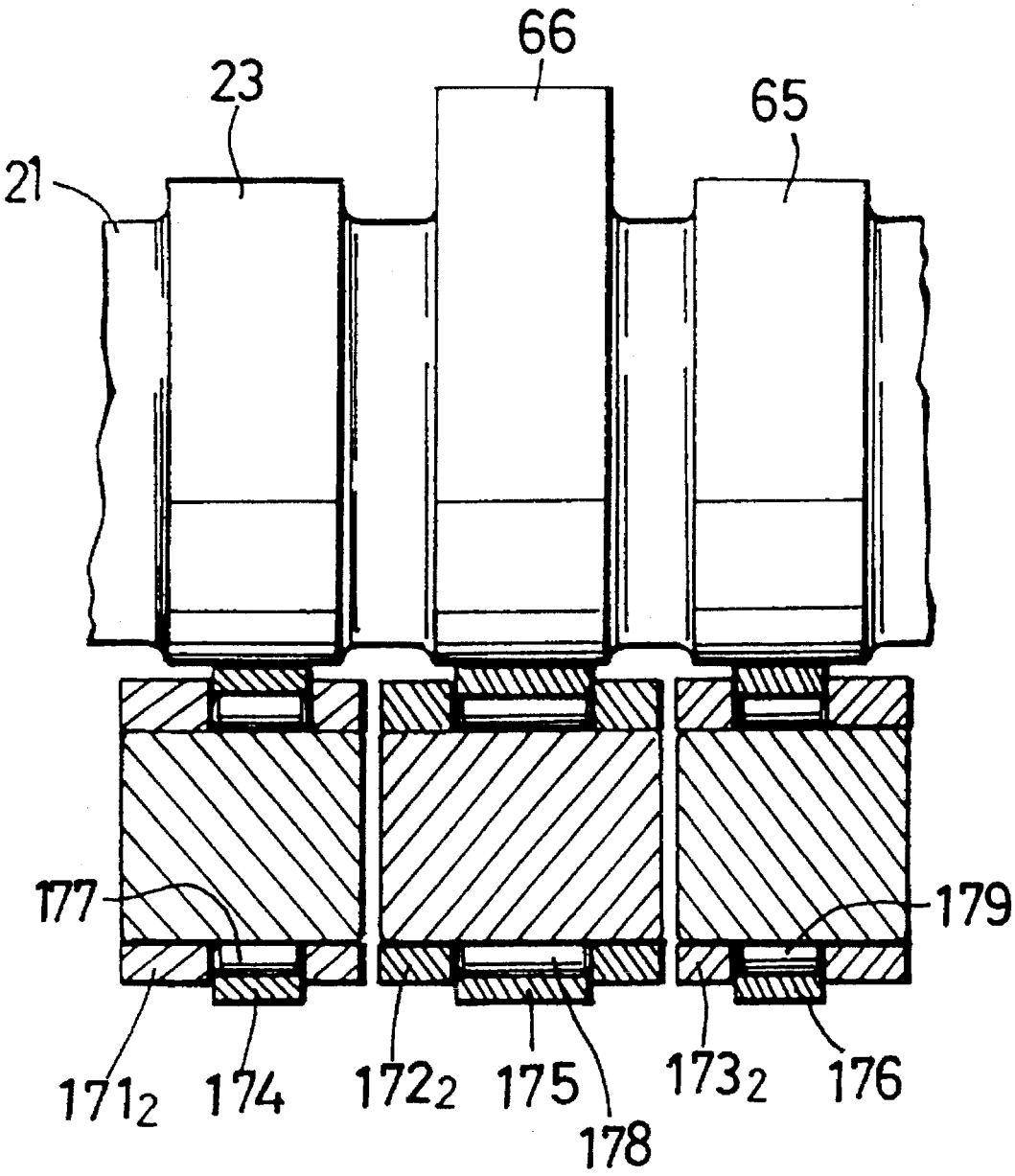
FIG. 36 is a sectional view taken along a line 36—36 in FIG. 35.

FIGS. 35 and 36 illustrate a nineteenth embodiment of the present invention, wherein portions or components corresponding to those in the above-described eighteenth embodiment are designated by like reference characters.

A first rocker arm $171_2$ swingably carried on a rocker arm shaft 28 has a support sleeve $171a_2$ integrally provided thereon to extend sideways with its inner surface in sliding contact with an outer surface of the rocker arm shaft 28. A second rocker arm $172_2$ disposed adjacently on one side of the first rocker arm $171_2$ and a third rocker arm $173_2$ disposed adjacently on the opposite side of the second rocker arm $172_2$ from the first rocker arm $171_2$ are swingably carried on the support sleeve $171a_2$.

A roller 174 is supported on the first rocker arm $171_2$ by a pin (not shown) to come into rolling contact with a substantially stopping cam 23 which is provided on a cam shaft 21. A roller 175 is also supported on the second rocker arm $172_2$ by a pin (not shown) to come into rolling contact with a high-speed cam 66 which is also provided on the cam shaft 21. Further, a roller 176 is supported on the third rocker arm $173_2$ by a pin (not shown) to come into rolling contact with a low-speed cam 65 which is also provided on the cam shaft 21. The substantially stopping cam 23 is formed into a substantially circular shape in correspondence to base circle portions 65*a* and 66*a* (see FIG. 32) of the low-speed and high-speed cams 65 and 66, but has a slightly raised portion at a location corresponding to cam lobes 65*b* and 66*b* (see FIG. 32) of the low-speed and high-speed cams 65 and 66.

One of intake valves $V_{I1}$ is operatively connected to the first rocker arm $171_2$, and the other intake valves $V_{I2}$ is operatively connected to the third rocker arm $173_2$.

Connection switchover means $180_1$ and $180_2$ are provided between the support sleeve $171a_2$ integral with the first rocker arm $171_2$ and the second and third rocker arms $172_2$ and $173_2$ swingably carried on the support sleeve $171a_2$, respectively.

According to the nineteenth embodiment, in a low-speed operating range of the engine, one of the intake valves $V_{I1}$ and $V_{I2}$ can be substantially stopped and at the same time, the other intake valves $V_{I2}$ can be opened and closed with a characteristic corresponding to the profile of the low-speed cam 65, by bringing the connection switchover means $180_1$ and $180_2$ into their disconnecting states. In a medium-speed operating range of the engine, the one intake valve $V_{I1}$ can be opened and closed with a characteristic corresponding to the profile of the high-speed cam 66 and at the same time, the other intake valves $V_{I2}$ can be opened and closed with the characteristic corresponding to the profile of the low-speed cam 65, by bringing one of the connection switchover means $180_1$ into its connecting state and bringing the other connection switchover means $180_2$ into its disconnecting state. Further, in a high-speed operating range of the engine, all the rocker arms $171_2$, $172_2$ and $173_2$ can be connected together by bringing both the connection switchover means $180_1$ and $180_2$ into their disconnecting states, so that both the intake valves $V_{I1}$ and $V_{I2}$ can be opened and closed with the characteristic corresponding to the profile of the high-speed cam 66.

Figure 37:
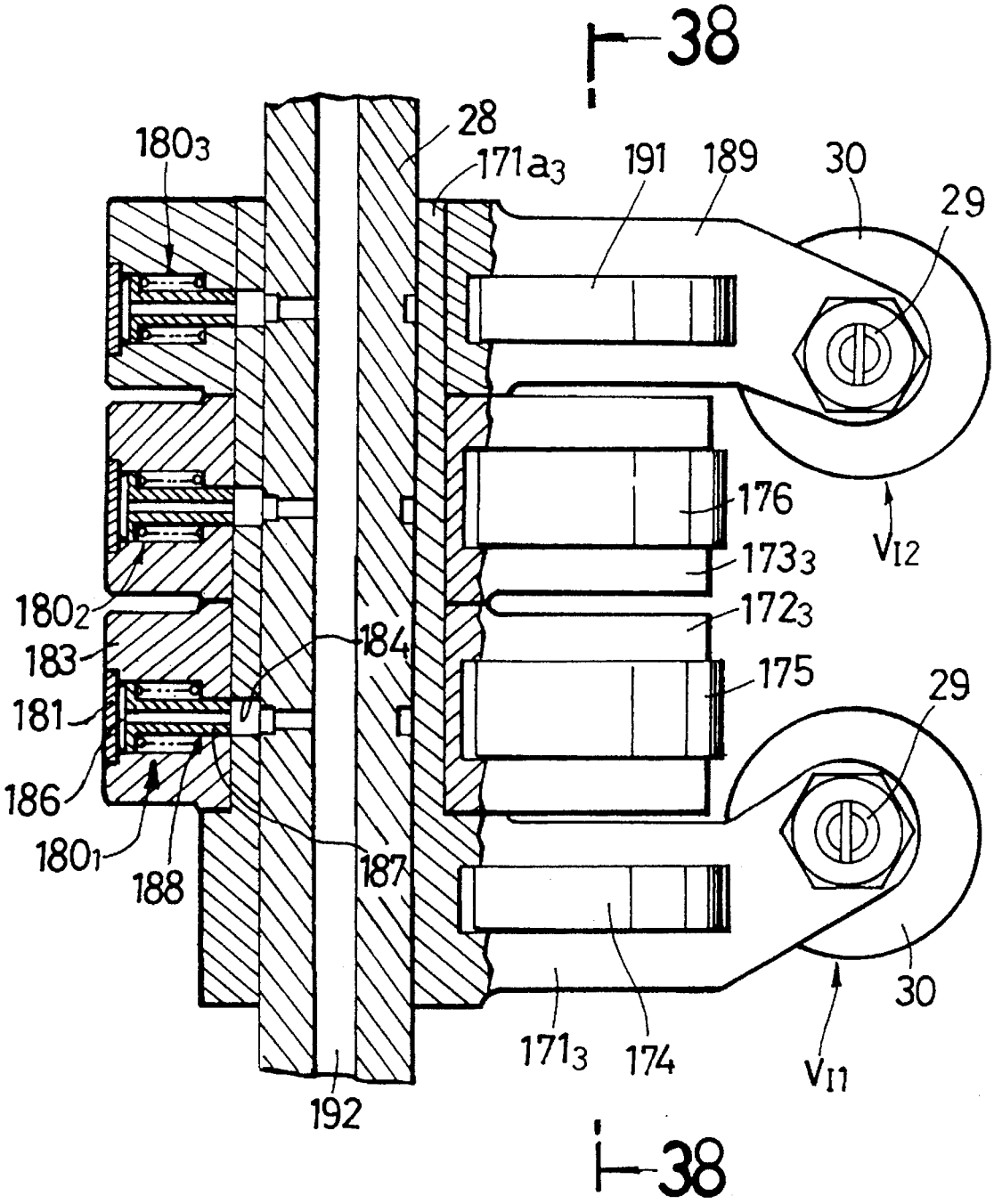
Figure 38:
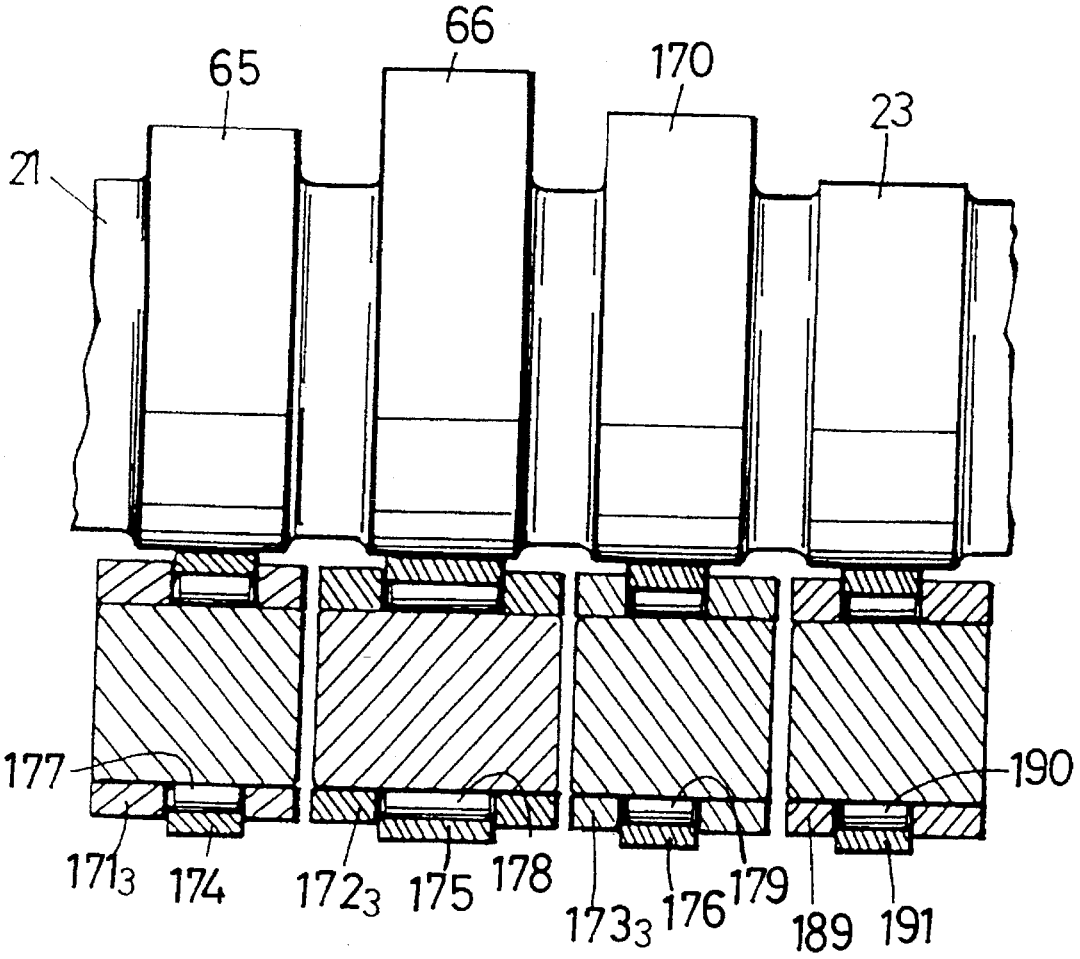
FIG. 38 is a sectional view taken along a line 38—38 in FIG. 37.

FIGS. 37 and 38 illustrate a twentieth embodiment of the present invention, wherein portions or components corresponding to those in the above-described embodiments are designated by like reference characters.

A first rocker arm $171_3$ swingably carried on a rocker arm shaft 28 has a support sleeve $171a_3$ integrally provided thereon to extend sideways with its inner surface in sliding contact with an outer surface of the rocker arm shaft 28. Second, third and fourth rocker arms $172_3$, $173_3$ and 189 are adjacently disposed in the named order on one side of the first rocker arm $171_2$ and swingably carried on the support sleeve $171a_3$.

A roller 174 is provided on the first rocker arm $171_3$ to come into rolling contact with a low-speed cam 65 which is provided on a cam shaft 21. A roller 175 is provided on the second rocker arm $172_3$ to come into rolling contact with a high-speed cam 66 also provided on the cam shaft 21. A roller 176 is provided on the third rocker arm $173_3$ to come into rolling contact with a medium-speed cam 170 also provided on the cam shaft 21. A roller 191 is rotatably carried on the fourth rocker arm 189 through a needle bearing 190 to come into rolling contact with a substantially stopping cam 23 provided on the cam shaft 21.

One of intake valves $V_{I1}$ is operatively connected to the first rocker arm $171_3$, and the other intake valves $V_{I2}$ is operatively connected to the fourth rocker arm 189.

Connection switchover means $180_1$, $180_2$ and $180_3$ are provided between the support sleeve $171a_3$ integral with the first rocker arm $171_3$ and the second, third and fourth rocker arms $172_3$, $173_3$ and 189 swingably carried on the support sleeve $171a_3$, respectively.

An oil passage 192 common to the connection switchover means $180_1$, $180_2$ and $180_3$ is provided in the rocker arm shaft 28. The spring forces of return springs 188 in the connection switchover means $180_1$, $180_2$ and $180_3$ are set, for example, such that a relation, spring force in connection switchover means $180_3$ <spring force in connection switchover means $180_1$ <spring force in connection switchover means $180_2$, is established.

According to the twentieth embodiment, the combination of operating characteristics of the intake valves $V_{I1}$ and $V_{I2}$ can be varied at four stages by stepwise varying the hydraulic pressure applied to the oil passage 192. More specifically, in a condition in which the hydraulic pressure in the oil passage 192 has been released, the rocker arms $171_3$, $172_3$, $173_3$ and 189 are in their disconnected states, so that the one intake valve $V_{I1}$ is opened and closed with the characteristic corresponding to a profile of the low-speed cam 65, while the other intake valve $V_{I2}$ is in its substantially stopped state as a result of the action of the substantially stopping cam 23. If a lower hydraulic pressure is applied to the oil passage 192, the connection switchover means $180_3$ is operated to interconnect the first and fourth rocker arms $171_3$ and 189, so that the intake valves $V_{I1}$ and $V_{I2}$ are opened and closed with the characteristic corresponding to the profile of the low-speed cam 65. If a medium hydraulic pressure is applied to the oil passage 192, the connection switchover means $180_2$ and $180_3$ are operated to connect the first, third and fourth rocker arms $171_3$, $173_3$ and 189 to one another, so that the intake valves $V_{I1}$ and $V_{I2}$ are opened and closed with the characteristic corresponding to the profile of the medium-speed cam 170. Further, if a higher hydraulic pressure is applied to the oil passage 192, the connection switchover means $180_1$, $180_2$ and $180_3$ are operated to connect all the rocker arms $171_3$, $172_3$, $173_3$ and 189 to one another, so that the intake valves $V_{I1}$ and $V_{I2}$ are opened and closed with the characteristic corresponding to the profile of the high-speed cam 66.

Figure 39:
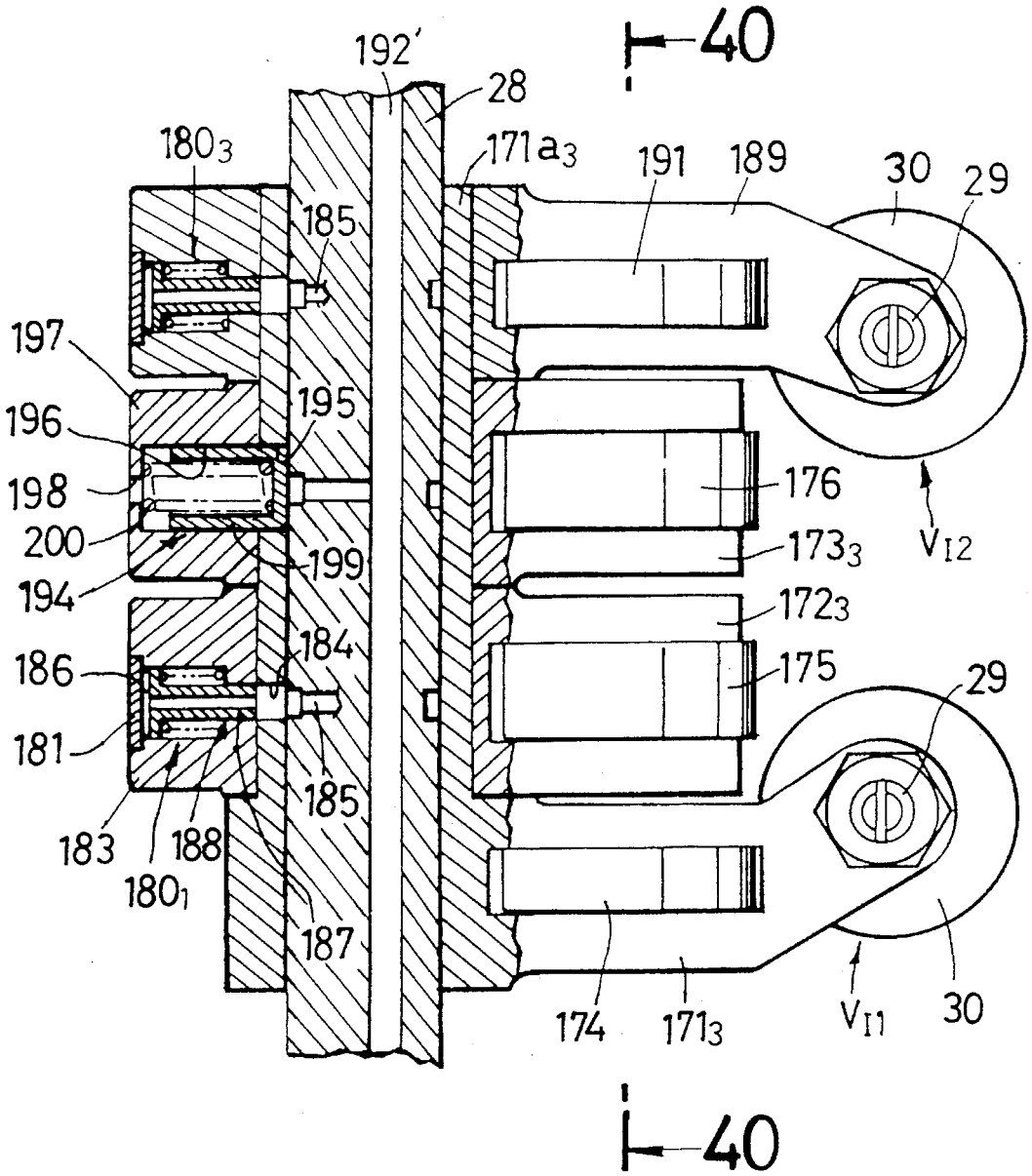
Figure 40:
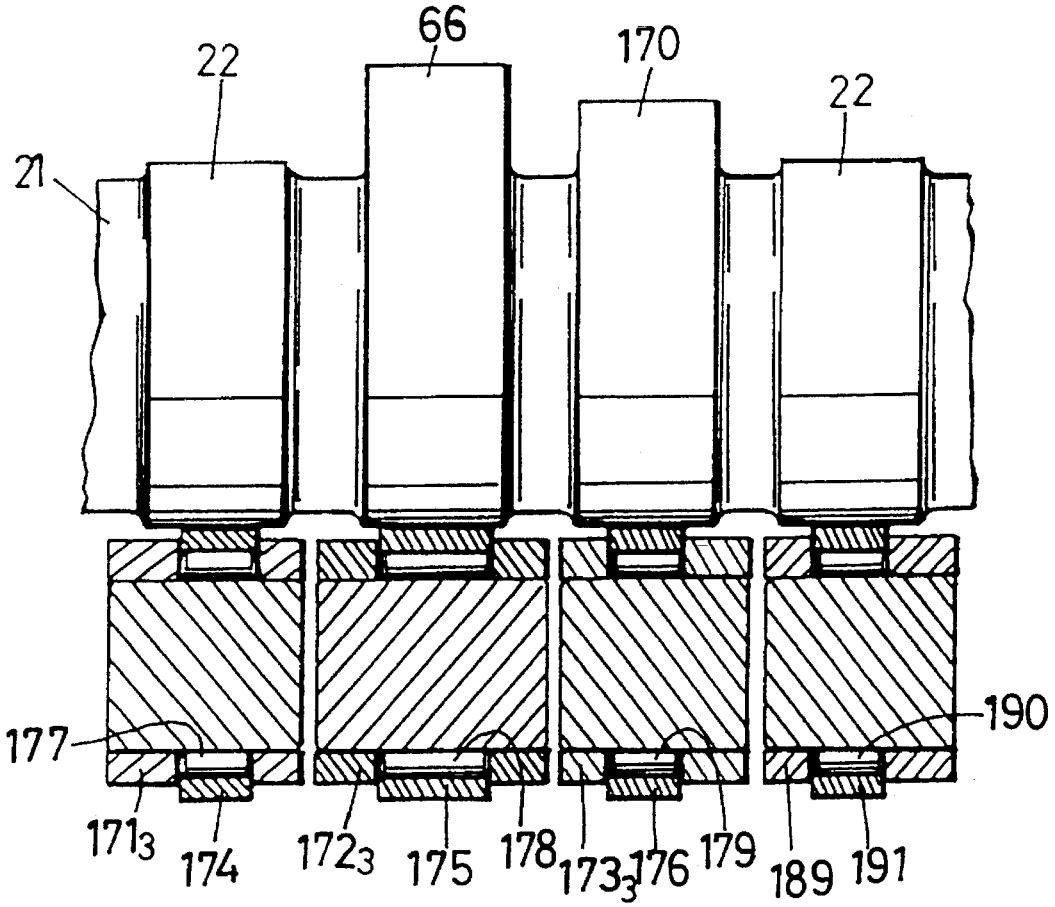
FIG. 40 is a sectional view taken along a line 40—40 in FIG. 39.

FIGS. 39 and 40 illustrate a 21st embodiment of the present invention, wherein portions or components corresponding to those in the above-described twentieth embodiment are designated by like reference characters.

A first rocker arm $171_3$ is swingably carried on a rocker arm shaft 28, and second, third and fourth rocker arms $172_3$, $173_3$ and 189 are swingably carried on a support sleeve $171a_3$ integral with the first rocker arm $171_3$. One of intake valves $V_{I1}$ is operatively connected to the first rocker arm $171_3$, and the other intake valve $V_{I2}$ is operatively connected to the fourth rocker arm 189.

A roller 174 is provided on the first rocker arm $171_3$ to come into rolling contact with a stopping cam 22 provided on a cam shaft 21. A roller 175 is provided on the second rocker arm $172_3$ to come into rolling contact with a high-speed cam 66 also provided on the cam shaft 21. A roller 176 is provided on the third rocker arm $173_3$ to come into rolling contact with a medium-speed cam 170 also provided on the cam shaft 21. A roller 191 is provided on the fourth rocker arm 189 to come into rolling contact with a stopping cam 22 also provided on the cam shaft 21. The stopping cam 22 is formed into a circular shape in correspondence to the base circle portions 170*a* and 66*a* (see FIG. 32) of the medium-speed cam 170 and the high-speed cam 66.

Connection switchover means $180_1$, 194 and $180_3$ are provided between the support sleeve $171a_3$ integral with the first rocker arm $171_3$ and the second, third and fourth rocker arms $172_3$, $173_3$ and 189, respectively. The connection switchover means $180_1$ and $180_3$ are constructed in the same manner as in the twentieth embodiment. An oil passage 185 common to the connection switchover means $180_1$ and $180_3$ is provided in the rocker arm shaft 28. The spring forces of return springs 188 in the connection switchover means $180_1$ and $180_3$ are set, for example, such that a relation, spring force in connection switchover means $180_3$ <spring force in connection switchover means $180_1$, is established.

The connection switchover means 194 is arranged so that it permits the connection between the support sleeve $171a_3$, i.e., the first rocker arm $171_3$ and the third rocker arm $173_3$ to be released by applying a hydraulic pressure to an oil passage 192' which is provided in the rocker arm shaft 28.

The support sleeve $171a_3$ is provided with an engage bore 195 which has an axis perpendicular to an axis of the rocker arm shaft 28 and which leads to the oil passage 192' provided in the rocker arm shaft 28. The third rocker arm $173_3$ is provided with a guide portion 197 having a guide bore 196 which is coaxially connected to the engage bore 195 when the third rocker arm $173_3$ is in its stopped state. An outer end of the guide bore 196 is in communication with the outside through an open bore 198 provided in the guide portion 196.

The connection switchover means 194 includes a bottomed cylindrical switchover piston 199 slidably fitted into the guide bore 196 for sliding movement between a connecting position in which one end thereof is fitted into the engage bore 195 so that it can be subjected to a hydraulic pressure from the oil passage 192' and a disconnecting position in which the one end is disengaged from the engage bore 195, and a return spring 200 mounted between the switchover piston 199 and the guide portion 197 for exhibiting a spring force for biasing the switchover piston 199 toward the connecting position.

According to the 21st embodiment, if a hydraulic pressure is applied to the oil passage 192' to bring the connection switchover means 194 into its disconnecting state, and the hydraulic pressure in the oil passage 185 is released to bring the connection switchover means $180_1$ and $180_3$ into their disconnecting states, all the rocker arms $171_3$, $172_3$, $173_3$ and 189 are relatively swingable, so that both the intake valves $V_{I1}$ and $V_{I2}$ can be stopped (the cylinder can be stopped).

If the hydraulic pressure in the oil passage 192' is released to bring the connection switchover means 194 into its connecting state to connect the first and third rocker arms $\mathbf{171_3}$ and $\mathbf{173_3}$ to each other, and the hydraulic pressure in the oil passage 185 is released to bring the connection switchover means $\mathbf{180_1}$ and $\mathbf{180_3}$ into their disconnecting states, one of the intake valves $V_{I1}$ is opened and closed with a characteristic corresponding to the profile of the medium-speed cam 170, and the other intake valve $V_{I2}$ is stopped by the stopping cam 22.

If a relatively low hydraulic pressure is then applied to the oil passage 185 with the hydraulic pressure in the oil passage 192' remaining released, thereby bringing the connection switchover means $\mathbf{180_3}$ into its connecting state, both the intake valves $V_{I1}$ and $V_{I2}$ are opened and closed with the characteristic corresponding to the profile of the medium-speed cam 170.

Further, if a relatively high hydraulic pressure is applied to the oil passage 185 with the hydraulic pressure in the oil passage 192' remaining released, thereby bringing the connection switchover means $\mathbf{180_1}$ and $\mathbf{180_3}$ into their connecting states, both the intake valves $V_{I1}$ and $V_{I2}$ are opened and closed with a characteristic corresponding to the profile of the high-speed cam 66.

In such valve operating device, when the rocker arms $\mathbf{171_3}$ and $\mathbf{173_3}$ are swung in the disconnecting state of the connection switchover means 194, a centrifugal force is applied to the switchover piston 199 outwardly in a radial direction of the rocker arm shaft 28, i.e., in a direction away from the support sleeve $\mathbf{171a_3}$. Therefore, the switchover piston 199 cannot be urged against the rocker arm shaft 28 by the centrifugal force, and a wearing cannot be produced between the switchover piston 199 and the rocker arm shaft 28.

The support sleeve $\mathbf{171a_3}$ may have a wall thickness which permits the switchover piston 199 to be partially fitted into the support sleeve $\mathbf{171a_3}$ during connecting operation of the connection switchover means 194. Therefore, it is possible to form the support sleeve $\mathbf{171a_3}$ into a relatively thin wall thickness, thereby correspondingly reducing the weight of the first rocker arm $\mathbf{171_3}$ and the size of the third rocker arm $\mathbf{173_3}$. Moreover, the guide portion 197 provided in the third rocker arm $\mathbf{173_3}$ in order to disposed the connection switchover means 194 may be provided with a diameter permitting the accommodation of the switchover piston 199 and the return spring 200 to protrude from the third rocker am $\mathbf{173_3}$ in the radial direction of the rocker arm shaft. Therefore, it is possible to minimize the increase in weight, and in cooperation with the relatively small outside diameter of the support sleeve $\mathbf{171a_3}$, it is possible to provide a reduction in size of the third rocker arm $\mathbf{173_3}$ and to reduce the inertial moment to provide an increase in speed of rotation.

Moreover, the oil passage 192' connected to the connection switchover means 194 is provided in the rocker arm shaft 28 supported on the engine body and hence, even in a multi-cylinder internal combustion engine, it is unnecessary to provide hydraulic pressure circuits in a cylinder head in correspondence to every cylinders, thereby enabling a simplification of a hydraulic pressure circuit.

Although the 11th to 21st embodiments have been described as the present invention has been applied to the DOHC type valve operating device, the present invention is also applicable to an SOHC type valve operating device. An embodiment applied to the SOHC type valve operating device will be described, wherein portions or components corresponding to those in the above-described embodiments are designated by like reference characters.

Figure 41:
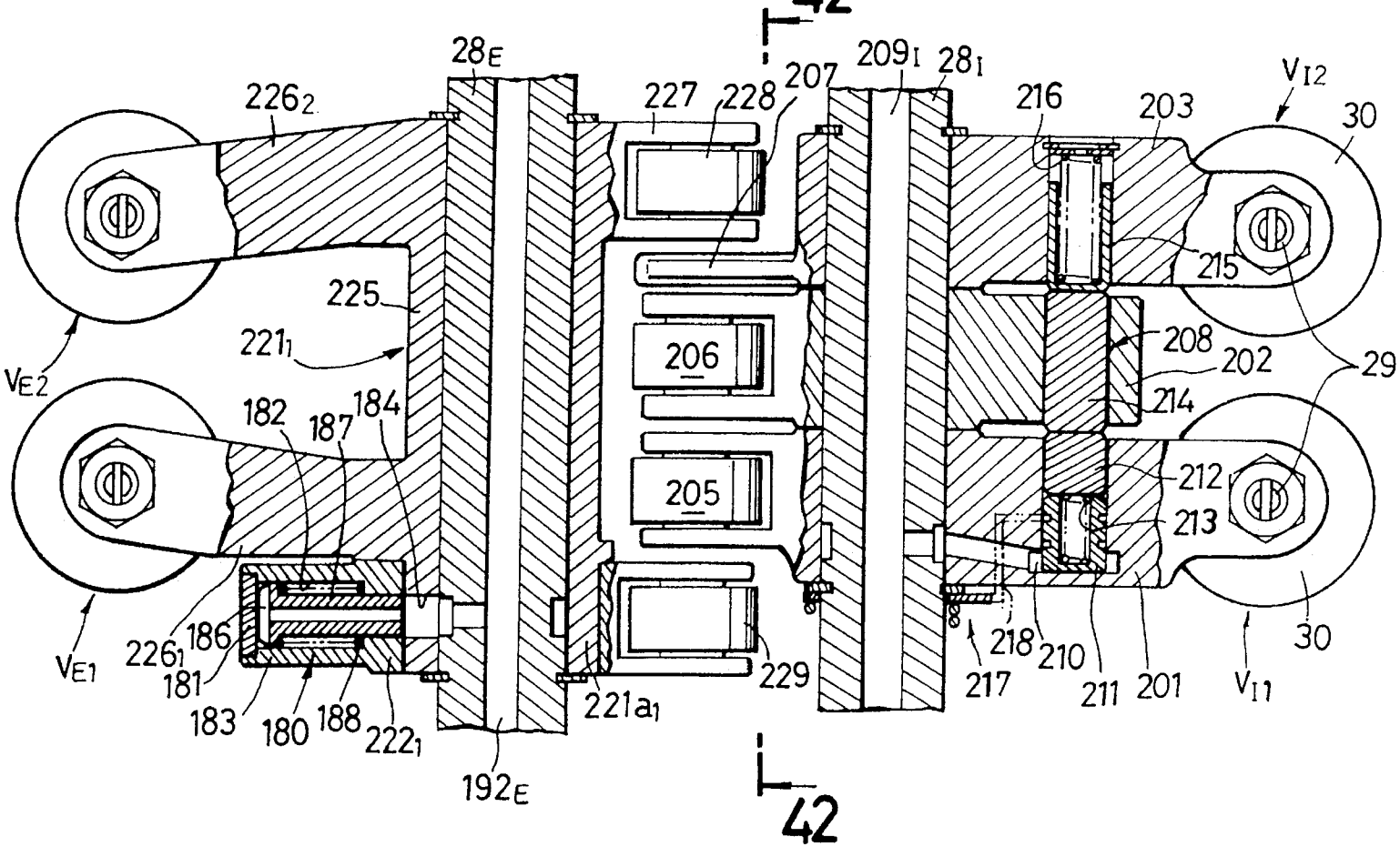
Figure 42:
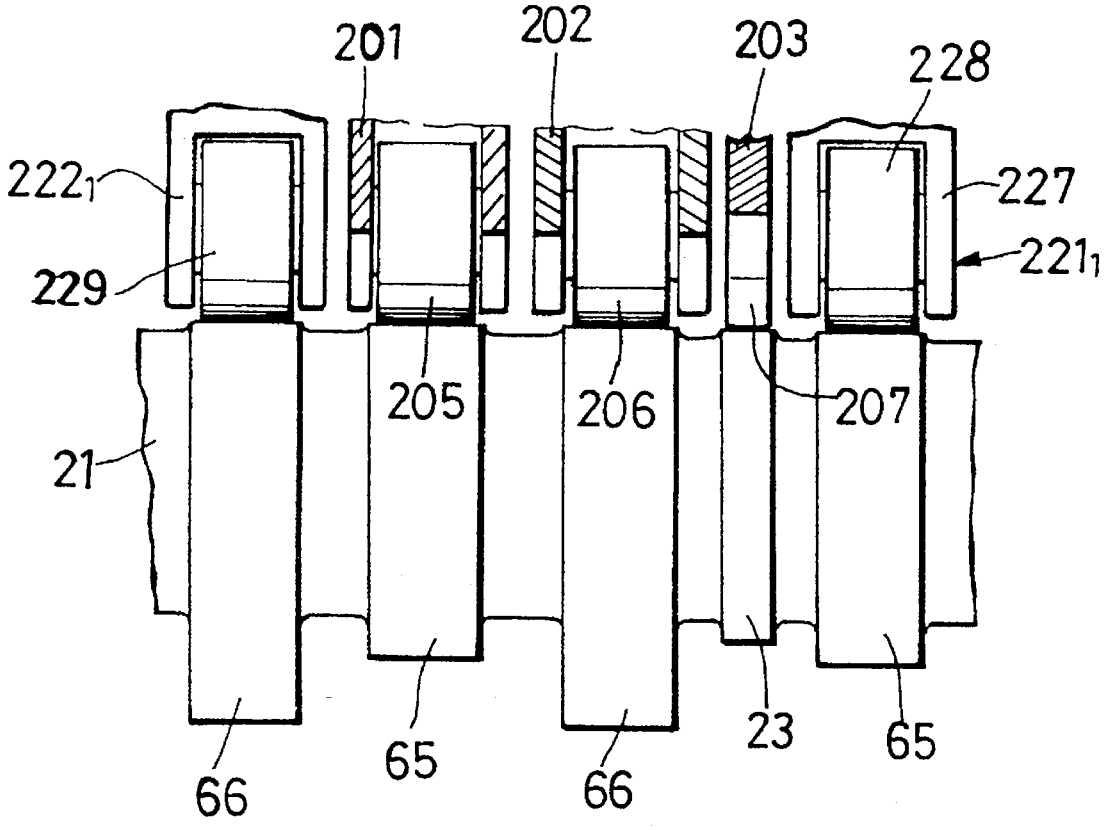
FIG. 42 is a sectional view taken along a line 42—42 in FIG. 41.

FIGS. 41 and 42 illustrate a 22nd embodiment of the present invention, wherein portions or components corresponding to those in the above-described embodiments are designated by like reference characters.

First, second and third intake-side rocker arms 201, 202 and 203 are swingably carried in an adjacent arrangement on an intake-side rocker arm shaft $\mathbf{28_I}$. Intake valves $V_{I1}$ and $V_{I2}$ are operatively connected to the first and third intake-side rocker arms 201 and 203. On the other hand, a low-speed cam 65, a high-speed cam 66 and a substantially stopping cam 23 are provided on a cam shaft 21. A roller 205 is supported on the first intake-side rocker arm 201 by a pin (not shown) to come into rolling contact with the low-speed cam 65. A roller 206 is supported on the second intake-side rocker arm 202 by a pin (not shown) to come into rolling contact with the high-speed cam 66. The substantially stopping cam 23 is provided to come into sliding contact with a slide contact portion 207 which is provided with a reduced width on the third intake-side rocker arm 203.

A connection switchover means 208 is provided in the intake-side rocker arms 201, 202 and 203 to have an operating axis parallel to the intake-side rocker arm shaft $\mathbf{28_I}$ and is switchable between a state in which it permits a relative swinging movement of all the rocker arms 201, 202 and 203 and a state in which it permits all the rocker arms 201, 202 and 203 to be integrally connected to one another.

The connection switchover means 208 includes a timing piston 211 slidably fitted into the first intake-side rocker arm 201 with one end facing a hydraulic pressure chamber 210 which leads to an oil passage $\mathbf{209_I}$ provided in he intake-side rocker arm shaft $\mathbf{28_I}$, a first switchover pin 212 slidably fitted into the first intake-side rocker arm 201 with one end capable to abutting against the timing piston 211 and with the other end capable of being fitted into the second intake-side rocker arm 202, a spring mounted under compression between the timing piston 211 and the first switchover pin 212, a second switchover pin 214 slidably fitted into the second intake-side rocker arm 202 with one end in abutment against the other end of the first switchover pin 212 and with the other end capable of being fitted into the third intake-side rocker arm 203, a limiting member 215 slidably fitted into the third intake-side rocker arm 203 to abut against the other end of the second switchover pin 214, and a return spring 216 mounted under compression between the limiting member 215 and the third intake-side rocker arm 203.

In a condition in which the hydraulic pressure in the hydraulic pressure chamber 210 has been released, the abutting surfaces of the first switchover pin 212 and the second switchover pin 214 are located between the first and second intake-side rocker arms 201 and 202, and the abutting surfaces of the second switchover pin 214 and the limiting member 215 are located between the second and third intake-side rocker arms 202 and 203, thereby disconnecting the rocker arms 201, 202 and 203, so that the one intake valve $V_{I1}$ is opened and closed with a characteristic corresponding to the profile of the low-speed cam 65, and the other intake valve $V_{I2}$ is substantially stopped by the substantially stopping cam 23.

If a hydraulic pressure is applied to the hydraulic pressure chamber 210, the other end of the first switchover pin 212 is fitted into the second intake-side rocker arm 202 and the second switchover pin 214 is fitted into the third intake-side rocker arm 203, thereby connecting all the intake-side rocker arms 201, 202 and 203 together, so that both the intake valves $V_{I1}$ and $V_{I2}$ are opened and closed with a characteristic corresponding to the profile of the high-speed cam 66.

A timing plate 218 of a trigger mechanism 217 is engagible with the timing piston 211 and carried on the intake-side rocker arm shaft 281 in such a manner that the engagement of the timing plate 218 with the timing piston 211 is released when the first intake-side rocker arm 201 is being swung by a cam lobe 65*a* (see FIG. 32) of the low-speed cam 65.

On the other hand, a first exhaust-side rocker arm $\mathbf{221}_1$ is swingably carried on an exhaust-side rocker arm shaft $\mathbf{28}_E$ parallel to the intake-side rocker arm shaft $\mathbf{28}_I$. The first exhaust-side rocker arm $\mathbf{221}_1$ includes a cylindrical base portion 225 swingably carried on the exhaust-side rocker arm shaft $\mathbf{28}_E$, connecting arm portions $\mathbf{226}_1$ and $\mathbf{226}_2$ extending from opposite sides of the base portion 225 toward exhaust valves $V_{E1}$ and $V_{E2}$ as engine valves, and a follower arm portion 227 provided to extend from the base portion 225 adjacent the outer side of the slide contact portion 207 of the third intake-side rocker arm 203. Tip ends of the connecting arm portions $\mathbf{226}_1$ and $\mathbf{226}_2$ are operatively connected to the exhaust valves $V_{E1}$ and $V_{E2}$, and a roller 228 is supported on the follower arm portion 227 to come into rolling contact with the low-speed cam 65 provided on the cam shaft 21.

The first exhaust-side rocker arm $\mathbf{221}_1$ has a support sleeve $\mathbf{221}a_1$ integrally connected to one end of the base portion 225 thereof to come into sliding contact with an outer surface of the exhaust-side rocker arm shaft $\mathbf{28}_E$. A second exhaust-side rocker arm $\mathbf{222}_1$ is swingably carried on the support sleeve $\mathbf{221}a_1$ to lie outside the first intake-side rocker arm 201, and a roller 229 is supported on the second exhaust-side rocker arm $\mathbf{222}_1$ to come into rolling contact with the high-speed cam 66 provided on the cam shaft 21.

A connection switchover means 180 is provided between the support sleeve $\mathbf{221}a_1$ integral with the first exhaust-side rocker arm $\mathbf{221}_1$ and the second exhaust-side rocker arm $\mathbf{222}_1$ swingably carried on the support sleeve $\mathbf{221}a_1$. The connection switchover means 180 has an operating axis perpendicular to an axis of the exhaust-side rocker arm shaft $\mathbf{28}_E$ and is switchably operated in response to the application and releasing of a hydraulic pressure to and from an oil passage $\mathbf{192}_E$ provided in the exhaust-side rocker arm shaft $\mathbf{28}_E$.

When the connection switchover means 180 is in its disconnecting state, the exhaust valves $V_{E1}$ and $V_{E2}$ are opened and closed with a characteristic corresponding to the profile of the low-speed cam 65. When the connection switchover means 180 is in its connecting state, the exhaust valves $V_{E1}$ and $V_{E2}$ are opened and closed with a characteristic corresponding to the profile of the high-speed cam 66.

In such SOHC type valve operating device, the first exhaust-side rocker arm $\mathbf{221}_1$ is carried on the exhaust-side rocker arm shaft $\mathbf{28}_E$ over a relative long distance along an axis of the exhaust-side rocker arm shaft $\mathbf{28}_E$ and therefore, the inclination of the first exhaust-side rocker arm $\mathbf{221}_1$ with respect to the rocker arm shaft $\mathbf{28}_E$ is prevented to the utmost, and a wearing due to a deviated contact between the low-speed cam 65 and the roller 228 is inhibited to the utmost. Moreover, since the connection switchover means 180 for switching over the connection and disconnection of the first and second exhaust-side rocker arms $\mathbf{221}_1$ and $\mathbf{222}_1$ from one to another has the operating axis perpendicular to the axis of the exhaust-side rocker arm shaft $\mathbf{28}_E$, it is possible to relatively reduce the width of the second exhaust-side rocker arm $\mathbf{222}_1$ along the axis of the exhaust-side rocker arm shaft $\mathbf{28}_E$ and to construct the valve operating device in a compact manner.

Figure 43:
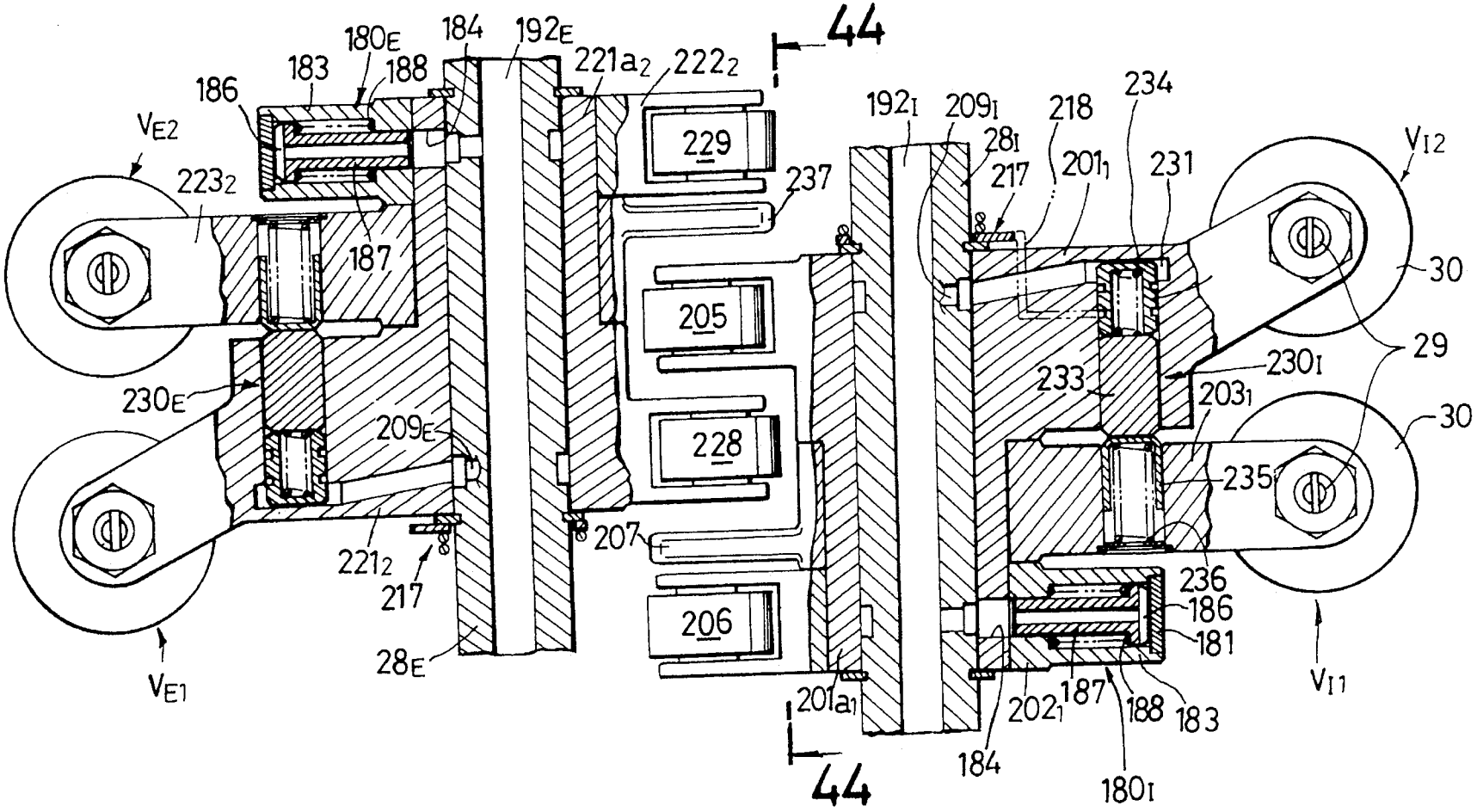
Figure 44:
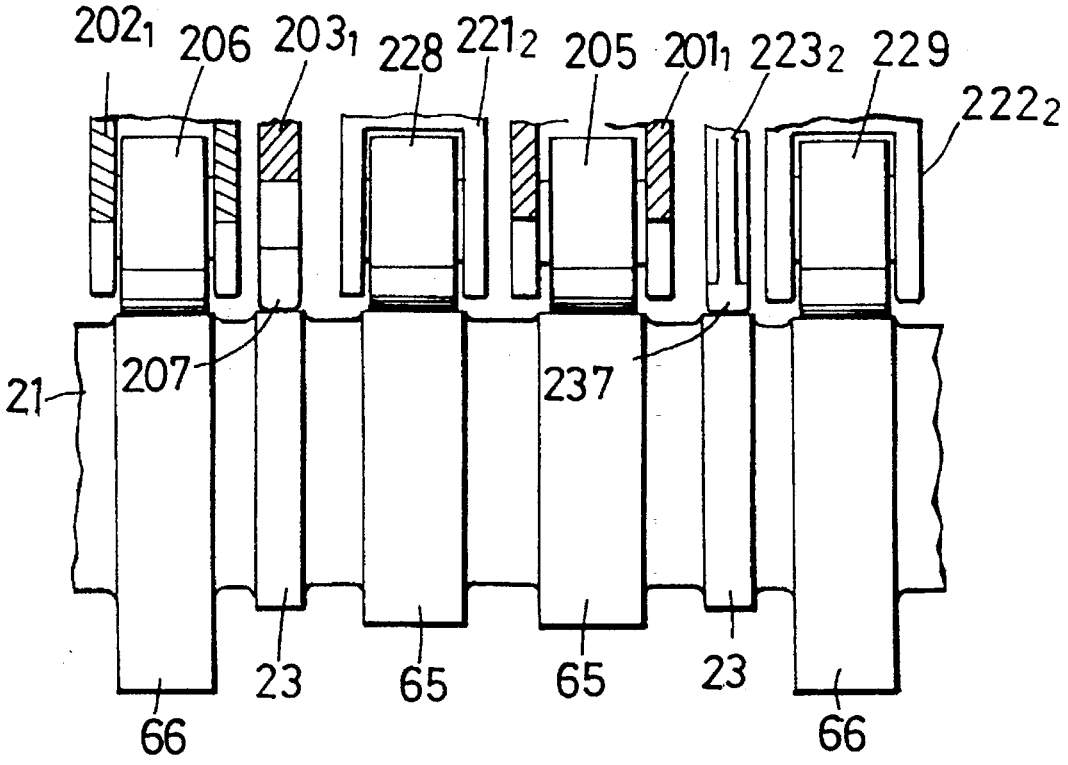
FIG. 44 is a sectional view taken along a line 44—44 in FIG. 43.

FIGS. 43 and 44 illustrate a 23rd embodiment of the present invention, wherein portions or components corresponding to those in the above-described embodiments are designated by like reference characters.

A first intake-side rocker arm $\mathbf{201}_1$ is operatively connected to an intake valve $V_{I2}$ and swingably carried on an intake-side rocker arm shaft $\mathbf{28}_I$. A support sleeve $\mathbf{201}a_1$ is integrally provided on the first intake-side rocker arm $\mathbf{201}_1$ with its inner surface put into sliding contact with an outer surface of intake-side rocker arm shaft $\mathbf{28}_I$, and a second intake-side rocker arm $\mathbf{202}_1$ and a third intake-side rocker arm $\mathbf{203}_1$ sandwiched between the first and second intake-side rocker arms $\mathbf{201}_1$ and $\mathbf{202}_1$ are swingably carried on the support sleeve $\mathbf{201}a_1$. An intake valve $V_{I1}$ is operatively connected to the third intake-side rocker arm $\mathbf{203}_1$. On the other hand, a low-speed cam 65, a high-speed cam 66 and a substantially stopping cam 23 are provided on a cam shaft 21. A roller 205 is supported on the first intake-side rocker arm $\mathbf{201}_1$ by a pin (not shown) to come into rolling contact with the low-speed cam 65, and a roller 206 is supported on the second intake-side rocker arm $\mathbf{202}_1$ by a pin (not shown) to come into rolling contact with the high-speed cam 66. The substantially stopping cam 23 is provided to come into sliding contact with a slide contact portion 207 which is provided with a reduced width on the third intake-side rocker arm $\mathbf{203}_1$.

A connection switchover means $\mathbf{230}_I$ is provided between the first and third intake-side rocker arms $\mathbf{201}_1$ and $\mathbf{203}_1$. The connection switchover means $\mathbf{230}_I$ has an operating axis parallel to the intake-side rocker arm shaft $\mathbf{28}_I$ and is switchable between a state in which it permits a relative swinging movement of the rocker arms $\mathbf{201}_1$ and $\mathbf{203}_1$ and a state in which it permits the rocker arms $\mathbf{201}_1$ and $\mathbf{203}_1$ to be integrally connected to each other.

The connection switchover means $\mathbf{230}_I$ includes a timing piston 232 slidably fitted into the first intake-side rocker arm $\mathbf{201}_1$ with one end facing a hydraulic pressure chamber 231 which leads to an oil passage $\mathbf{209}_1$ provided in the intake-side rocker arm shaft $\mathbf{28}_I$, a switchover pin 233 slidably fitted into the first intake-side rocker arm $\mathbf{201}_1$ with one end capable of abutting against the timing piston 232 with the other end capable of being fitted into the third intake-side rocker arm $\mathbf{203}_1$, a spring 234 mounted under compression between the timing piston 232 and the switchover pin 233, a limiting member 235 slidably fitted into the third intake-side rocker arm 203 to abut against the other end of the switchover pin 233, and a return spring 236 mounted under compression between the limiting member 235 and the third intake-side rocker arm $\mathbf{203}_1$.

In such connection switchover means $\mathbf{230}_I$, the abutting surface of the switchover pin 233 and the limiting member 235 can be located between the first and third intake-side rocker arms $\mathbf{201}_1$ and $\mathbf{203}_1$ by releasing the hydraulic pressure in the hydraulic pressure chamber 231, thereby disconnecting the rocker arms $\mathbf{201}_1$ and $\mathbf{203}_1$ from each other. The switchover pin 233 can be fitted into the third intake-side rocker arm $\mathbf{203}_1$ to connect the rocker arms $\mathbf{201}_1$ and $\mathbf{203}_1$ to each other by applying a hydraulic pressure to the hydraulic pressure chamber 231. Moreover, a trigger mechanism 217 is carried on the intake-side rocker arm shaft 281 for determining the operating timing for the timing piston 232.

A connection switchover means $180_I$ is provided between the support sleeve $201a_1$ integral with the first intake-side rocker arm $201_1$ and the second intake-side rocker arm $202_1$ swingably carried on the support sleeve $201a_1$. The connection switchover means $180_I$ has an operating axis perpendicular to an axis of the intake-side rocker arm shaft $28_I$ and is switchably operated in response to the application and releasing of a hydraulic pressure to and from an oil passage $192_1$ provided in the intake-side rocker arm shaft $28_I$ and separated from the oil passage $209_I$ in the connection switchover means $230_I$.

In such valve operating device for the intake valves $V_{I1}$ and $V_{I2}$, if the connection switchover means $230_I$ is brought into its disconnecting state, the one intake valve $V_{I1}$ is brought into a substantially stopped state by the substantially stopping cam 23, while the other intake valve $V_{I2}$ is opened and closed with a characteristic corresponding to the profile of the low-speed cam 65. If the connection switchover means $230_I$ is operated into its connecting state and the connection switchover means $180_I$ is brought into its disconnecting state, both the intake valves $V_{I1}$ and $V_{I2}$ are opened and closed with a characteristic corresponding to the profile of the low-speed cam 65. Further, if both the connection switchover means $230_I$ and $180_I$ are operated into their connecting states, all the first, second and third intake-side rocker arms $201_1$, $202_1$ and $203_1$ are connected to one another, whereby both the intake valves $V_{I1}$ and $V_{I2}$ are opened and closed with a characteristic corresponding to the profile of the high-speed cam 66.

On the other hand, a first exhaust-side rocker arm $221_2$ is swingably carried on an exhaust-side rocker arm shaft $28_E$ and has a support sleeve $221a_2$ integrally provided thereon with its inner surface in sliding contact with an outer surface of the rocker arm shaft $28_E$. A second exhaust-side rocker arm $222_2$ and a third exhaust-side rocker arm $223_2$ sandwiched between the first and second exhaust-side rocker arms $221_2$ and $222_2$ are swingably carried on the support sleeve $221a_2$. An exhaust valve $V_{E1}$ is operatively connected to the third exhaust-side rocker arm $223_2$. The low-speed cam 21 is also provided with a low-speed cam 65 with which a roller 228 supported by a pin (not shown) on the first exhaust-side rocker arm $221_2$ at a location between the roller 205 of the first intake-side rocker arm $201_1$ and the slide contact portion 277 of the third intake-side rocker arm $203_1$ are put into rolling contact, a high-speed cam 66 with which a roller 229 supported by a pin (not shown) on the second exhaust-side rocker arm $222_2$ on the opposite side of the roller 205 of the first intake-side rocker arm $201_1$ from the roller 228 is put into rolling contact, and a substantially stopping cam 23 which is provided to come into sliding contact with a slide contact portion 237 provided with a reduced width on the third exhaust-side rocker arm $223_2$ between the rollers 229 and 205.

A connection switchover means $230_E$ having an operating axis parallel to the exhaust-side rocker arm shaft $28_E$ is provided between the first and second exhaust-side rocker arms $221_2$ and $223_2$ and is switchable in response to the releasing of the hydraulic pressure in an oil passage $209_E$ provided in the exhaust-side rocker arm shaft $28_E$ and the application of a hydraulic pressure to the oil passage $209_E$.

A connection switchover means $180_E$ having an operating axis perpendicular to the axis of the exhaust-side rocker arm shaft $28_E$ is provided between the support sleeve $221a_2$ integral with the first exhaust-side rocker arm $221_2$ and the second exhaust-side rocker arm $222_2$ swingably carried on the support sleeve $221a_2$. The connection switchover means $180_E$ is switchably operated in response to the application and releasing of a hydraulic pressure to and from oil an passage $192_E$ provided in the exhaust-side rocker arm shaft $28_E$ and isolated from the oil passage $209_E$ in the connection switchover means $230_E$.

In such valve operating device for the exhaust valves $V_{E1}$ and $V_{E2}$, if the connection switchover means $230_E$ is brought into its disconnecting state, the one exhaust valve $V_{E1}$ is opened and closed with a characteristic corresponding to the profile of the low-speed cam 65, while the other exhaust valve $V_{E2}$ is brought into a substantially stopped state by the substantially stopping cam 23. If the connection switchover means $230_E$ is operated into its connecting state and the connection switchover means $180_E$ is brought into its disconnecting state, both the exhaust valves $V_{E1}$ and $V_{E2}$ are opened and closed with a characteristic corresponding to the profile of the low-speed cam 65. Further, if both the connection switchover means $230_E$ and $180_E$ are operated into their connecting states, all the first, second and third exhaust-side rocker arms $221_2$, $222_2$ and $223_2$ are connected to one another, whereby both the exhaust valves $V_{E1}$ and $V_{E2}$ are opened and closed with a characteristic corresponding to the profile of the high-speed cam 66.

Figure 45:
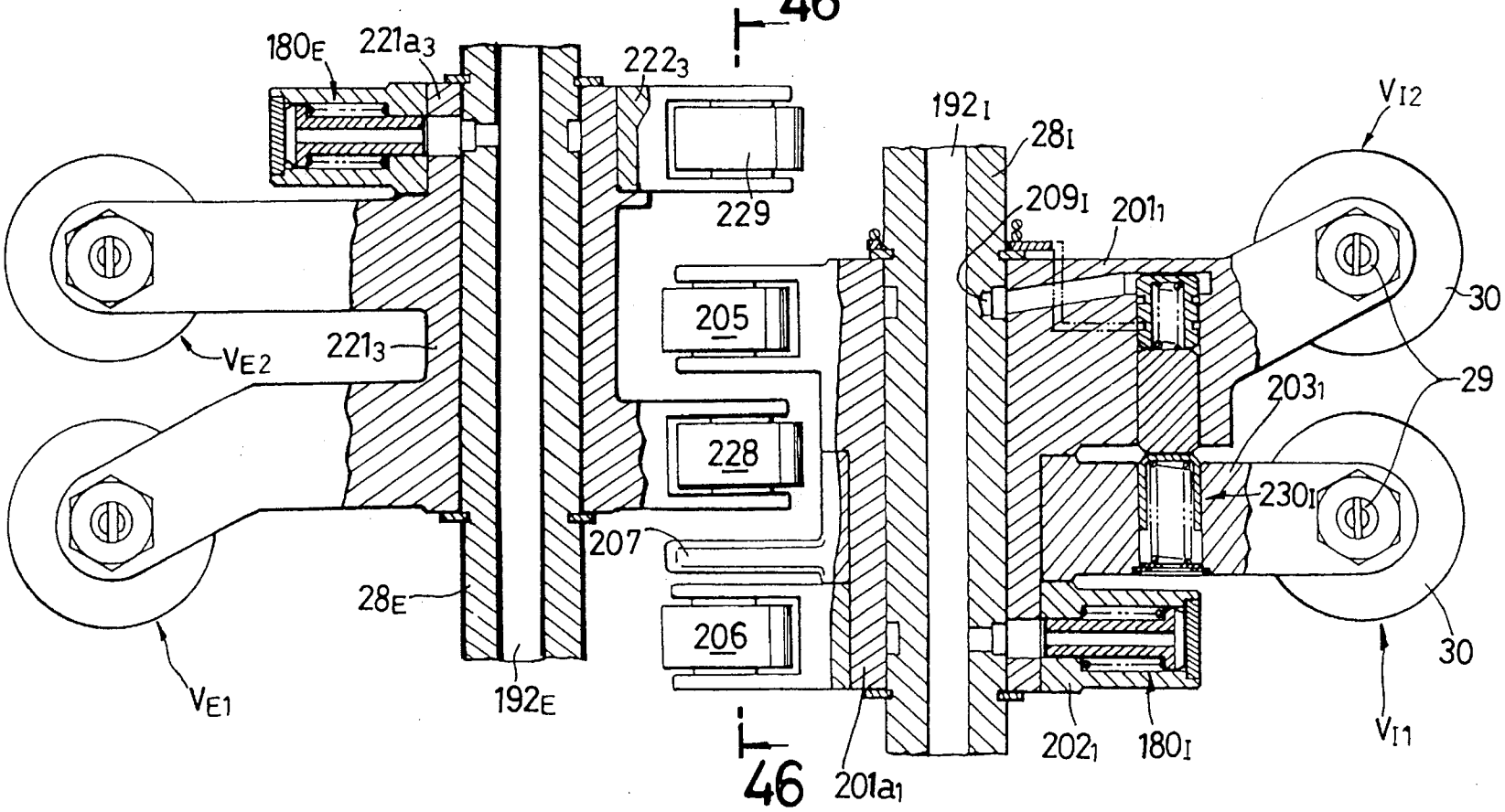
FIG. 45 is a cross-sectional plan view of a 24th embodiment of the present invention.
Figure 46:
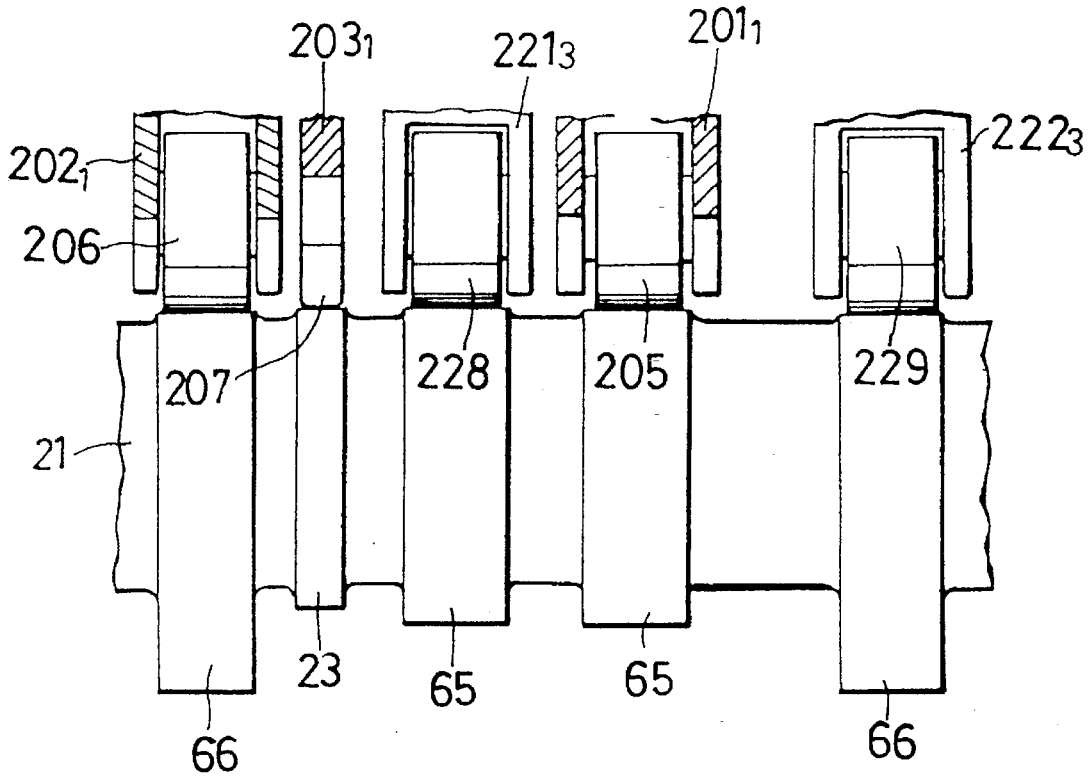
FIG. 46 is a sectional view taken along a line 46—46 in FIG. 45.

FIGS. 45 and 46 illustrate a 24th embodiment of the present invention, wherein portions or components are designated by like reference characters.

In this 24th embodiment, a construction for changing the combination of operating characteristics of intake valves $V_{I1}$ and $V_{I2}$ is similar to that in the above-described 23rd embodiment.

On the other hand, a first exhaust-side rocker arm $221_3$ is swingably carried on an exhaust-side rocker arm shaft $28_E$ and has a support sleeve $221a_3$ integrally provided thereon with its inner surface put into sliding contact with an outer surface of the rocker arm shaft $28_E$. A second exhaust-side rocker arm $222_3$ is swingably carried on the support sleeve $221a_3$. Exhaust valves $V_{E1}$ and $V_{E2}$ are operatively connected to the first exhaust-side rocker arm $221_3$. A low-speed cam 65 and a high-speed cam 66 are provided on a cam shaft 21. A roller is supported by a pin (not shown) on the first exhaust-side rocker arm $221_3$ at a location between the roller 205 of the first intake-side rocker arm 205 and the slide contact portion 207 to come into rolling contact with the low-speed cam 65, and a roller 229 is supported by a pin (not shown) on the second exhaust-side rocker arm $222_3$ on the opposite side of the roller 205 of the first intake-side rocker arm 205 from the roller 228 to come rolling contact with the high-speed cam 66.

A connection switchover means $180_E$ having an operating axis perpendicular to the axis of the exhaust-side rocker arm shaft $28_E$ is provided between the support sleeve $221a_3$ integral with the first intake-side rocker arm 205 and the second exhaust-side rocker arm $222_3$ swingably carried on the support sleeve $221a_3$. The connection switchover means $180_E$ is switchably operated in response to the application and releasing of a hydraulic pressure to and from an oil passage $192_E$ provided in the exhaust-side rocker arm shaft $28_E$.

In such valve operating device for the exhaust valves $V_{E1}$ and $V_{E2}$, if the connection switchover means $180_E$ is brought into its disconnecting state, both the exhaust valves $V_{E1}$ and $V_{E2}$ are opened and closed with a characteristic corresponding to the profile of the low-speed cam 65. If the connection switchover means $180_E$ is operated into its connecting state, both the exhaust valves $V_{E1}$ and $V_{E2}$ are opened and closed with a characteristic corresponding to the profile of the high-speed cam 66.

Figure 47:
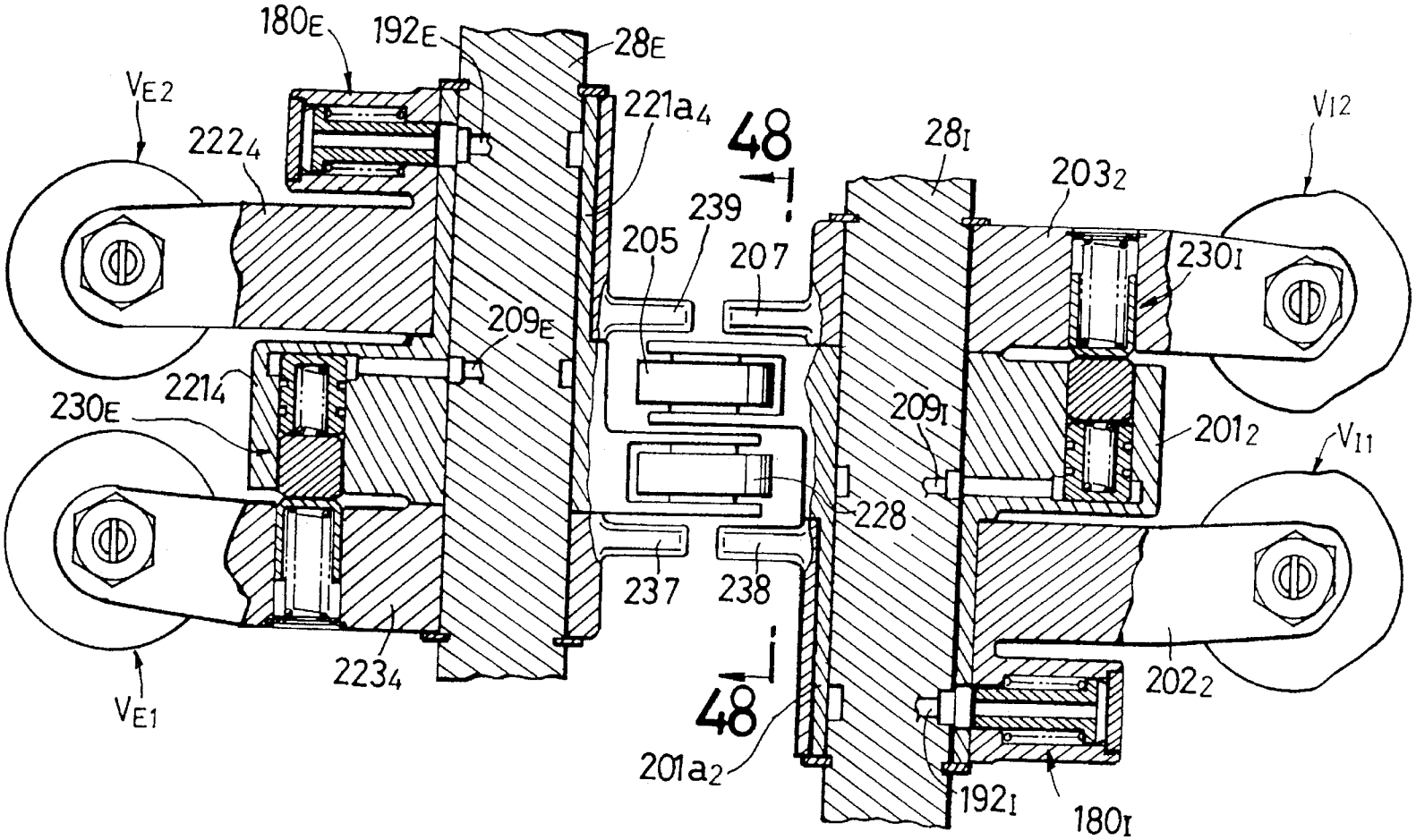
FIG. 47 is a cross-sectional plan view of a 25th embodiment of the present invention.
Figure 48:
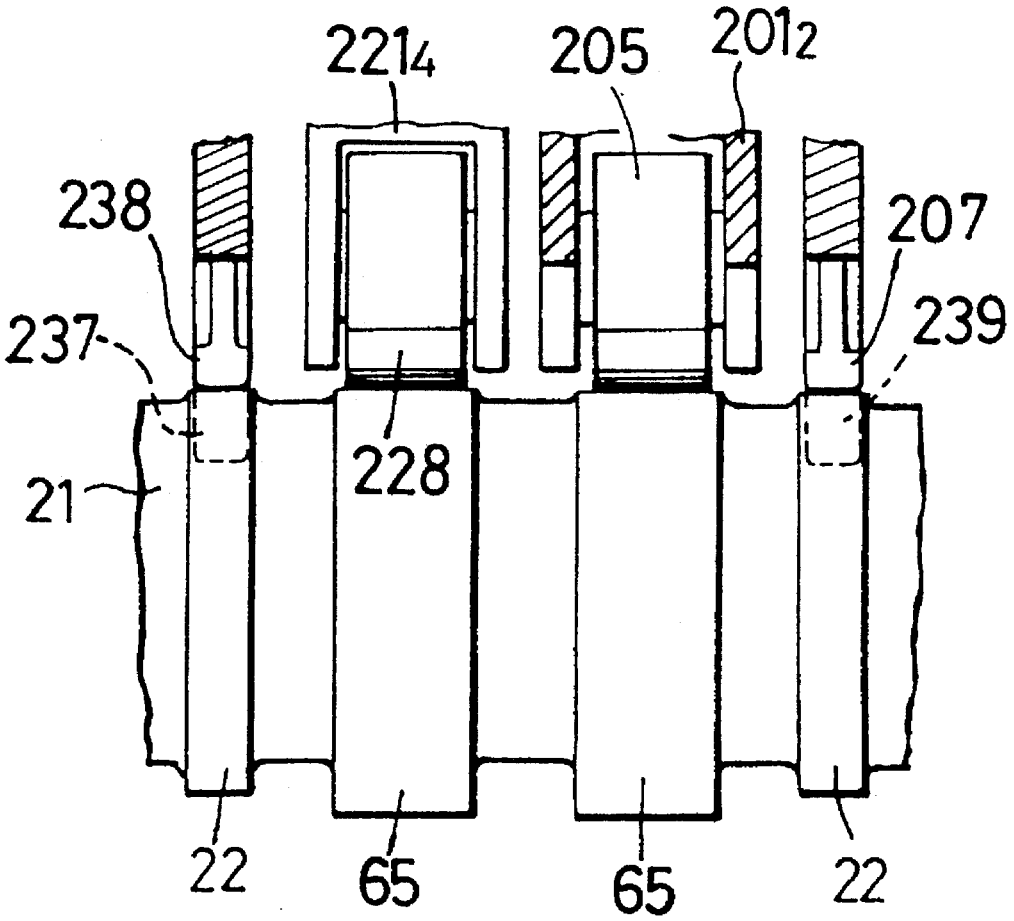
FIG. 48 is a sectional view taken along a line 48—48 in FIG. 47.

FIGS. 47 and 48 illustrate a 25th embodiment of the present invention, wherein portions or components corresponding to those in the above-described embodiments are designated by like reference characters.

A first intake-side rocker arm $\mathbf{201}_2$ is swingably carried on an intake-side rocker arm shaft $\mathbf{28}_I$. A support sleeve $\mathbf{201}a_2$ is integrally provided on the first intake-side rocker arm $\mathbf{201}_2$ with its inner surface put into sliding contact with an outer surface of the intake-side rocker arm shaft $\mathbf{28}_I$, and a second intake-side rocker arm $\mathbf{202}_2$ is swingably carried on the support sleeve $\mathbf{201}a_2$. A third intake-side rocker arm $\mathbf{203}_2$ is swingably carried on intake-side rocker arm shaft $\mathbf{28}_I$ adjacent the first intake-side rocker arm $\mathbf{201}_2$ on the opposite side from the second intake-side rocker arm $\mathbf{202}_2$. Intake valves $V_{I1}$ and $V_{I2}$ are operatively connected to the second and third intake-side rocker arms $\mathbf{202}_2$ and $\mathbf{203}_2$. On the other hand, a cam shaft 21 is provided with a low-speed cam 65 with which a roller 205 supported by a pin (not shown) on the first intake-side rocker arm $\mathbf{201}_2$ is put into rolling contact, a stopping cam 22 provided with a reduced width to come into a sliding contact with a slide contact portion 238 provided on the second intake-side rocker arm $\mathbf{202}_2$, and a stopping cam 22 provided with a reduced width to come into sliding contact with a slide contact portion 207 provided on the third intake-side rocker arm $\mathbf{203}_2$.

A connection switchover means $\mathbf{230}_I$ having an operating axis parallel to the intake-side rocker arm shaft $\mathbf{28}_I$ is provided between the first and third intake-side rocker arms $\mathbf{201}_2$ and $\mathbf{203}_2$ and is capable of switching over the connection and disconnection of the rocker arms $\mathbf{201}_2$ and $\mathbf{203}_2$ from one to another. A connection switchover means $\mathbf{230}_I$ having an operating axis perpendicular to an axis of the intake-side rocker arm $\mathbf{28}_I$ is provided between the support sleeve $\mathbf{201}a_2$ integral with the first intake-side rocker arm $\mathbf{201}_2$ and the second intake-side rocker arm $\mathbf{202}_2$ swingably carried on the support sleeve $\mathbf{201}a_2$.

In such valve operating device for the intake valves $V_{I1}$ and $V_{I2}$, if the connection switchover means $\mathbf{230}_I$ is brought into its disconnecting state, both the intake valves $V_{I1}$ and $V_{I2}$ are stopped by the stopping cams 22, 22 to provide a cylinder-inoperative state. If the connection switchover means $\mathbf{230}_I$ is brought into its disconnecting state and the connection switchover means $\mathbf{230}_I$ is operated into its connecting state, one of the intake valves $V_{I1}$ is opened and closed with a characteristic corresponding to the profile of the low-speed cam 65, while the other intake valve $V_{I2}$ remains stopped by the stopping cam 22. Further, if both the connection switchover means $\mathbf{230}_I$ and $\mathbf{180}_I$ are operated into their connecting states, all the first, second and third rocker arms $\mathbf{201}_2$, $\mathbf{202}_2$ and $\mathbf{203}_2$ are connected to one another, whereby both intake valve $V_{I1}$ and $V_{I2}$ are opened and closed with a characteristic corresponding to the profile of the low-speed cam 65.

On the other hand, a first exhaust-side rocker arm $\mathbf{221}_4$ is swingably carried on an exhaust-side rocker arm shaft $\mathbf{28}_E$ with its inner surface put into sliding contact with an outer surface of the rocker arm shaft $\mathbf{28}_E$. A second exhaust-side rocker arm $\mathbf{222}_4$ is swingably carried on the support sleeve $\mathbf{221}a_4$, and a third exhaust-side rocker arm $\mathbf{223}_4$ is swingably carried on the exhaust-side rocker arm shaft $\mathbf{28}_E$ adjacent the first exhaust-side rocker arm $\mathbf{221}_4$ on the opposite side from the second exhaust-side rocker arm $\mathbf{222}_4$ . Exhaust valves $V_{E1}$ and $V_{E2}$ are operatively connected to the second and third exhaust-side rocker arms $\mathbf{222}_4$ and $\mathbf{223}_4$. On the other hand, a low-speed cam 65 is provided on the cam shaft 21, and a roller 238 is supported on the first exhaust-side rocker arm $\mathbf{221}_4$ by a pin (not shown) to come into rolling contact with the low-speed cam 65 at a location adjacent the roller 205 of the first intake-side rocker arm $\mathbf{201}_2$. A slide contact portion 239 is provided with a reduced width on the second exhaust-side rocker arm $\mathbf{222}_4$ to come into sliding contact with the stopping cam 22 common to the slide contact portion 207 of the third intake-side rocker arm $\mathbf{203}_2$, and a slide contact portion 237 is provided on the third exhaust-side rocker arm $\mathbf{223}_4$ to come into sliding contact with the stopping cam 22 common to the slide contact portion 238 of the second intake-side rocker arm $\mathbf{202}_2$.

A connection switchover means $\mathbf{230}_E$ having an operating axis parallel to the exhaust-side rocker arm shaft $\mathbf{28}_E$ is provided between the first and third exhaust-side rocker arms $\mathbf{221}_4$ and $\mathbf{223}_4$ and capable of switching over the connection and disconnection of the rocker arms $\mathbf{221}_4$ and $\mathbf{223}_4$ from one to another. A connection switchover means $\mathbf{180}_E$ having an operating axis perpendicular to an axis of the exhaust-side rocker arm shaft $\mathbf{28}_E$ is provided between the support sleeve $\mathbf{221}a_4$ integral with the first exhaust-side rocker arm $\mathbf{221}_4$ and the second exhaust-side rocker arm $\mathbf{222}_4$ swingably carried on the support sleeve $\mathbf{221}a_4$.

In such valve operating device for the exhaust valves $V_{E1}$ and $V_{E2}$, if the connection switchover means $\mathbf{230}_E$ and $\mathbf{180}_E$ are brought into their disconnecting states, both the exhaust valves $V_{E1}$ and $V_{E2}$ are stopped by the stopping cams 22, 22 to provide a cylinder-inoperative state. If the connection switchover means $\mathbf{230}_E$ is brought into its disconnecting state and the connection switchover means $\mathbf{180}_E$ is operated into its connecting state, the one exhaust valve $V_{E2}$ is opened and closed with a characteristic corresponding to the profile of the low-speed cam 65, while the other exhaust valve $V_{E1}$ remains stopped by the stopping cam 22. Thus, by driving the exhaust valve $V_{E2}$ by the low-speed cam 65 and stopping the exhaust valve $V_{E1}$ when the intake valve $V_{I1}$ has been driven by the low-speed cam 65 and the intake valve $V_{I2}$ has been stopped, a flow of a fuel-air mixture can be smoothened within a combustion chamber of an engine with intake and exhaust ports opening into the combustion chamber being located at symmetric positions. If both the connection switchover means $\mathbf{230}_E$ and $\mathbf{180}_E$ are operated into their connecting states, all the first, second and third exhaust-side rocker arms $\mathbf{221}_4$, $\mathbf{222}_4$ and $\mathbf{223}_4$ are connected to one another, whereby both the exhaust valves $V_{E1}$ and $V_{E2}$ are opened and closed with a characteristic corresponding to the profile of the low-speed cam 65.

Figure 49:
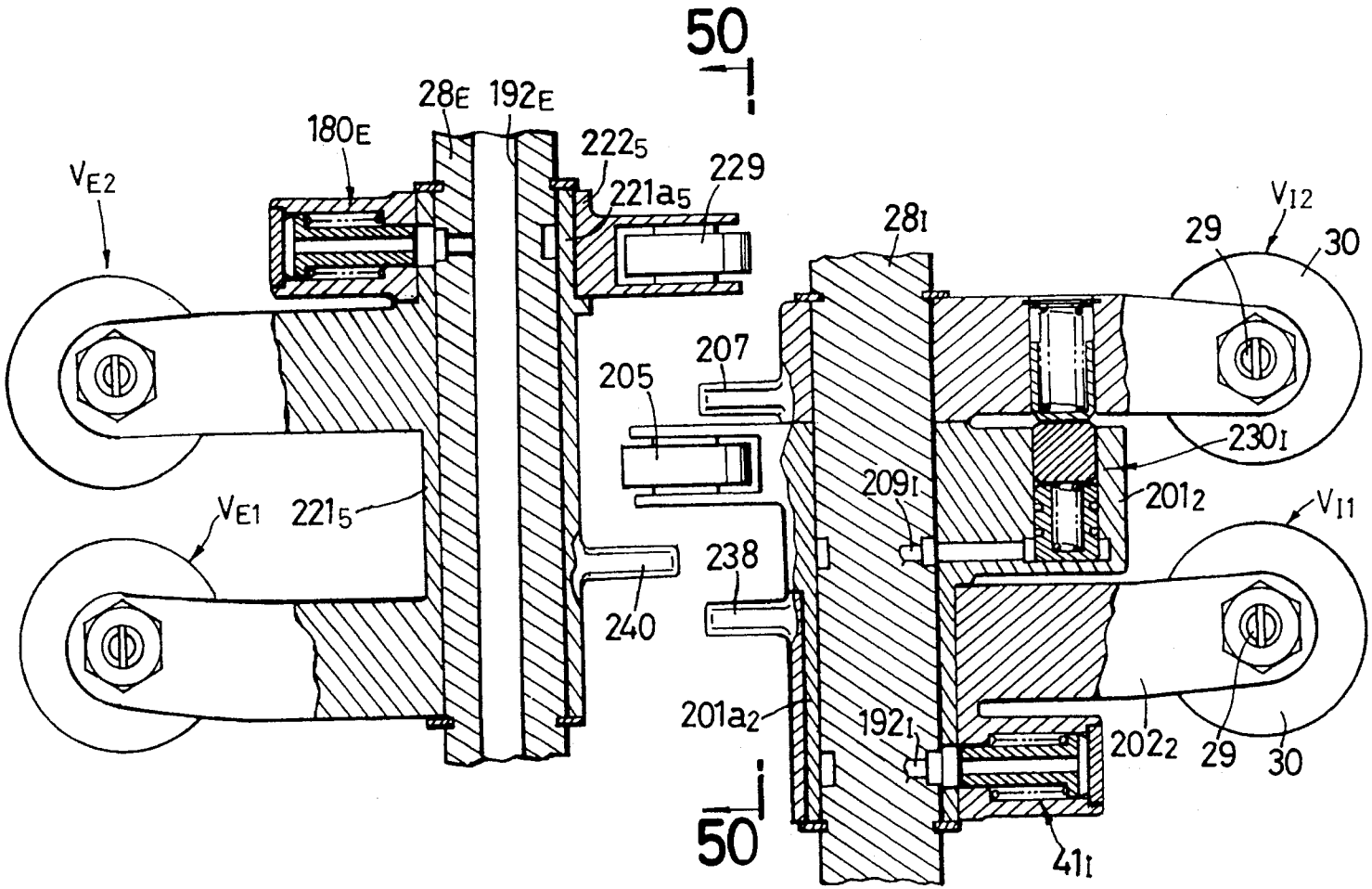
FIG. 49 is a cross-sectional plan view of a 26th embodiment of the present invention.
Figure 50:
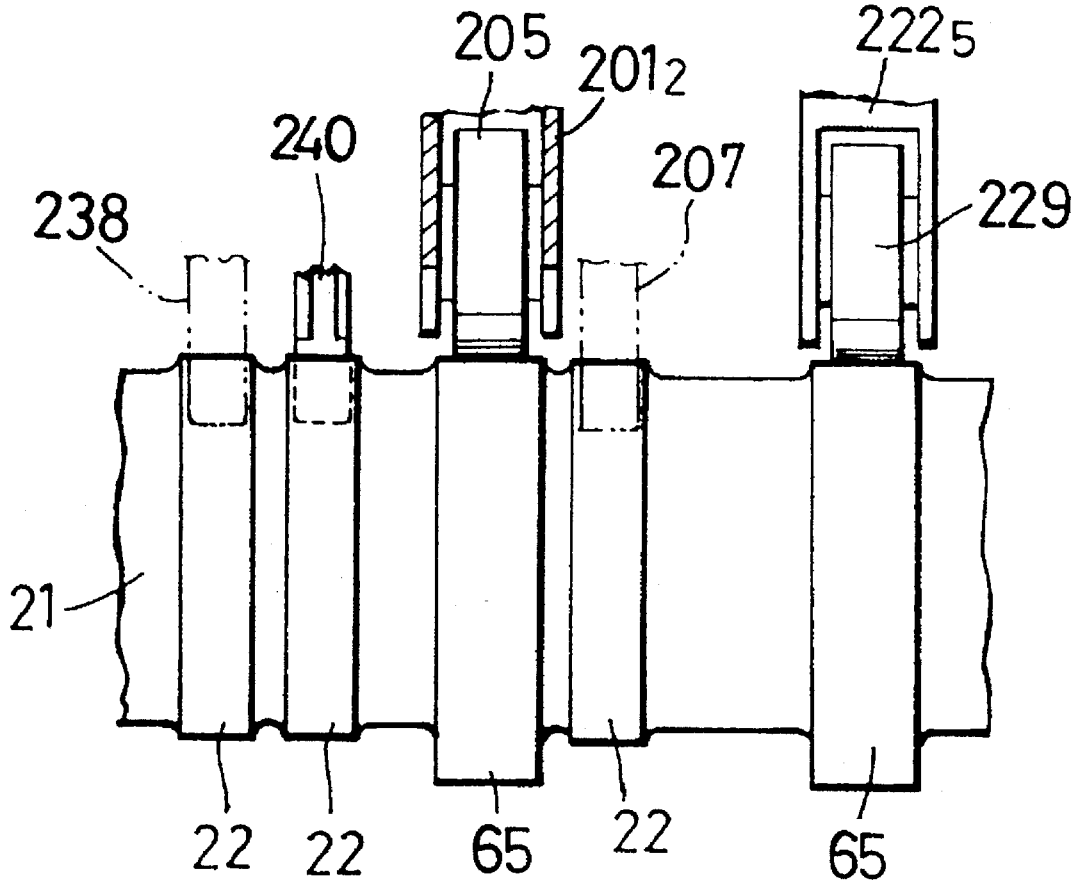
FIG. 50 is a sectional view taken along a line 50—50 in FIG. 49.

FIGS. 49 and 50 illustrate 26th embodiment of the present invention, wherein portions and components corresponding to those in the above-described embodiments are designated by like reference characters.

In the 26th embodiment, the construction for changing the combination of operating characteristics of the intake valves $V_{I1}$ and $V_{I2}$ is similar to that in the 25th embodiment.

On the other hand, a first exhaust-side rocker arm 221-5 is swingably carried on an exhaust-side rocker arm shaft $\mathbf{28}_E$ and has a support sleeve integrally provided thereon with its inner surface put into sliding contact with an outer surface of the rocker arm shaft $\mathbf{28}_E$. A second exhaust-side rocker arm 222-5 is swingably carried on the support sleeve 221a-5. Exhaust valves $V_{E1}$ and $V_{E2}$ are operatively connected to the first exhaust-side rocker arm 221-5. A cam shaft 21 includes a stopping cam 22, with which a slide contact portion 238 of a reduced width provided on the first exhaust-side rocker arm 221-5 at a location between the roller 205 of the first intake-side rocker arm $\mathbf{201}_2$ and the slide contact portion 238 of the second intake-side rocker arm $\mathbf{202}_2$ is put into sliding contact, and a low-speed cam 65, with which a roller 239 supported by a pin (not shown) on the second exhaust-side rocker arm 222-5 on the opposite side of the slide contact portion 207 of the third intake-side rocker arm $\mathbf{203}_2$ from the roller 205 is put into rolling contact.

In such valve operating device for the exhaust valves $V_{E1}$ and $V_{E2}$, it is possible to switch over the state in which both the exhaust valves $V_{E1}$ and $V_{E2}$ are stopped, and the state in which both the exhaust valves $V_{E1}$ and $V_{E2}$ are opened and closed with the characteristic corresponding to the profile of the low-speed cam 65.

Figure 51:
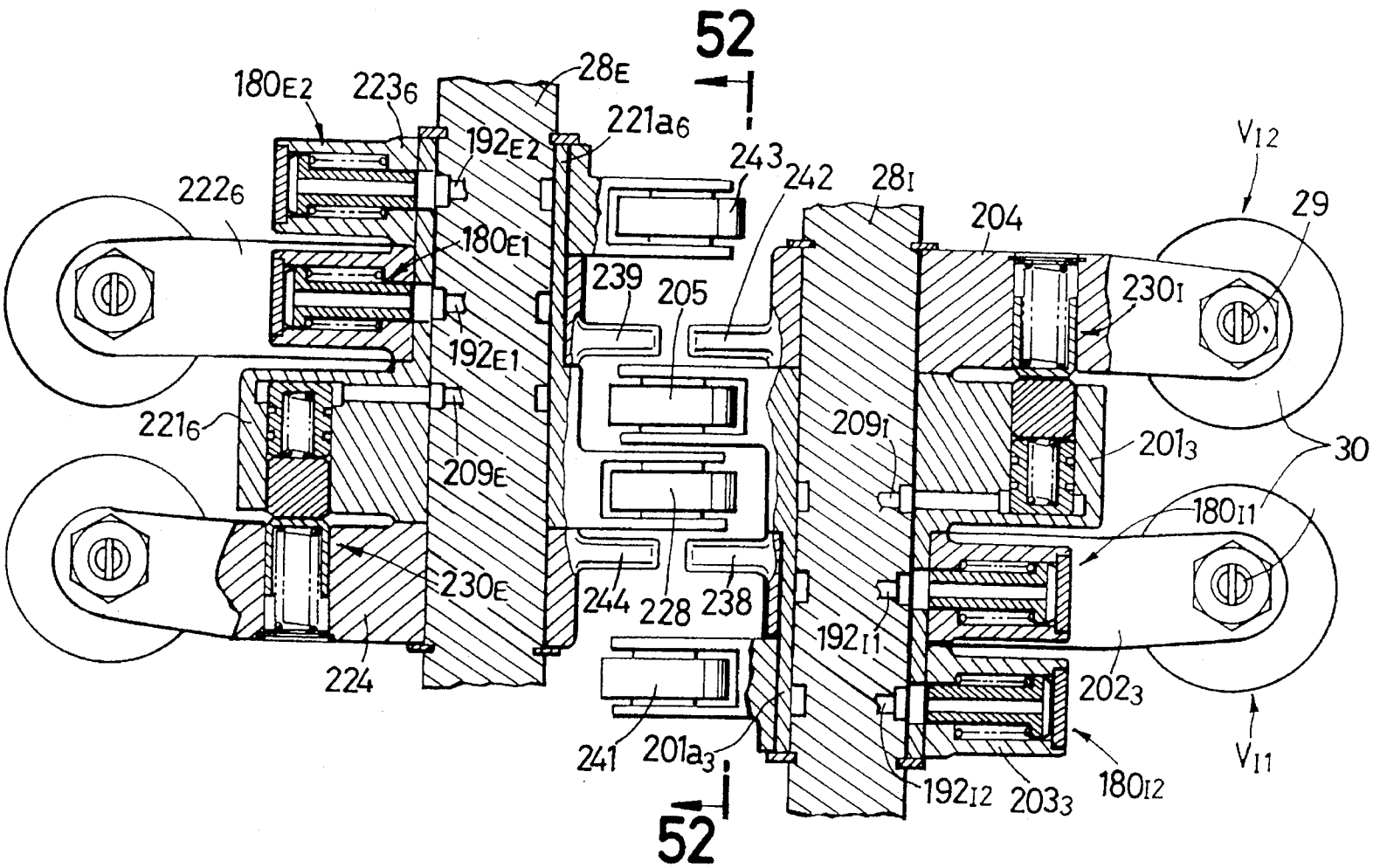
FIG. 51 is a cross-sectional plan view of a 27th embodiment of the present invention.
Figure 52:
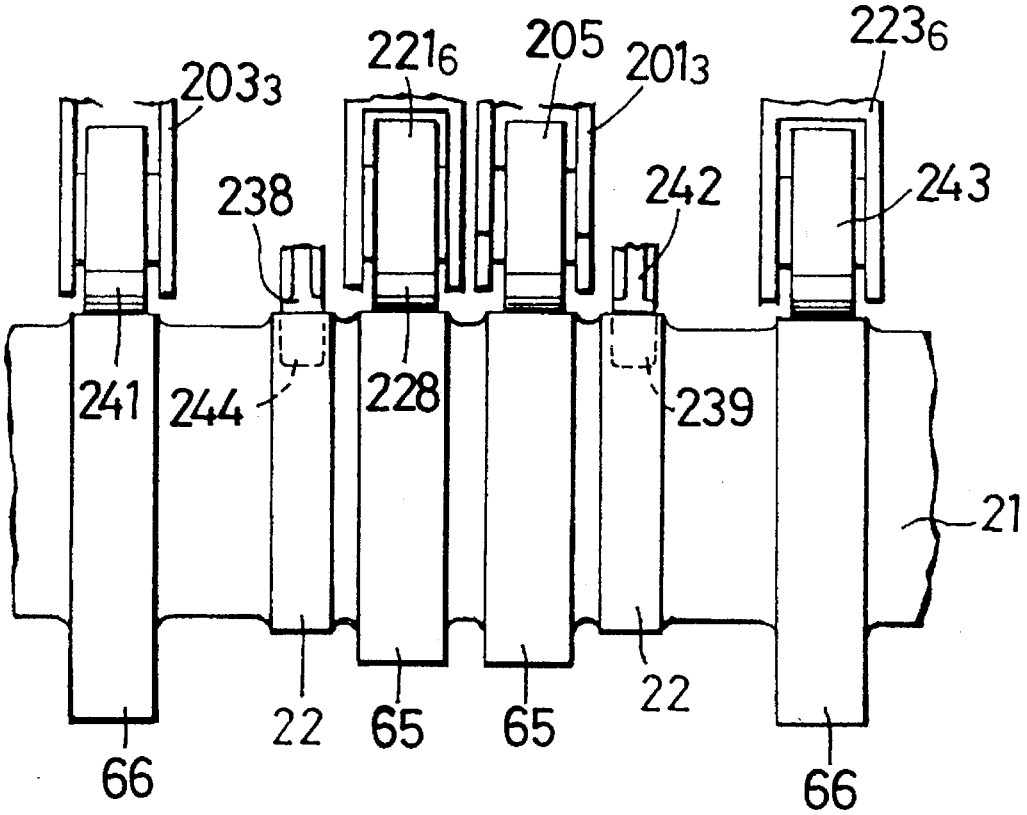
FIG. 52 is a sectional view taken along a line 52—52 in FIG. 51.

FIGS. 51 and 52 illustrate a 27th embodiment of the present invention, wherein portions or components corresponding to those in the above-described embodiments are designated by like reference characters.

A first intake-side rocker arm $\mathbf{201}_3$ is swingably carried on an intake-side rocker arm shaft $\mathbf{28}_I$. Second and third intake-side rocker arms $\mathbf{202}_3$ and $\mathbf{203}_3$ are swingably carried on a support sleeve $\mathbf{201}a_3$ which is integrally provided on the first intake-side rocker arm $\mathbf{201}_3$ with its inner surface put into sliding contact with an outer surface of the intake-side rocker arm shaft $\mathbf{28}_I$. A fourth intake-side rocker arm 204 is swingably carried on the intake-side rocker arm shaft $\mathbf{28}_I$ adjacent the first intake-side rocker arm $\mathbf{201}_3$ on the opposite side from the second and third intake-side rocker arms $\mathbf{202}_3$ and $\mathbf{203}_3$. Intake valves $V_{I1}$ and $V_{I2}$ are operatively connected to the second and fourth intake-side rocker arms $\mathbf{202}_3$ and $\mathbf{204}_3$.

On the other hand, a cam shaft 21 is provided with a low-speed cam 65 with which a roller 205 supported by a pin (not shown) on the first intake-side rocker arm $\mathbf{201}_3$ is put into rolling contact, a stopping cam 22 put into sliding contact with a slide contact portion 238 provided on the second intake-side rocker arm $\mathbf{202}_3$, a high-speed cam 66 with which a roller 241 supported by a pin (not shown) on the third intake-side rocker arm $\mathbf{203}_3$ is put into rolling contact, and a low-speed cam 22 put into sliding contact with a slide contact portion of a reduced width provided on the fourth intake-side rocker arm 204.

A connection switchover means $\mathbf{230}_I$ having an operating axis parallel to the intake-side rocker arm shaft $\mathbf{28}_I$ is provided between the first and fourth intake-side rocker arm $\mathbf{201}_3$ and 204 and capable of switching over the connection and disconnection of the rocker arms $\mathbf{201}_3$ and 204 to and from each other in response to the releasing and application of a hydraulic pressure from and to an oil passage $\mathbf{209}_1$ provided in the intake-side rocker arm shaft $\mathbf{28}_I$.

A connection switchover means $\mathbf{180}_{I1}$ is provided between the support sleeve $\mathbf{201}a_3$ integral with the first intake-side rocker arm $\mathbf{201}_3$ and the second intake-side rocker arm $\mathbf{202}_3$ swingably carried on the support sleeve $\mathbf{201}a_3$ and is switchably operated on an operating axis perpendicular to an axis of the intake-side rocker arm shaft $\mathbf{28}_I$ in response to the releasing and application of a hydraulic pressure from and to an oil passage $\mathbf{192}_{I1}$ provided in the intake-side rocker arm shaft $\mathbf{28}_I$ and isolated from the oil passage $\mathbf{209}_I$. Further, a connection switchover means $\mathbf{180}_{I2}$ is provided between the support sleeve $\mathbf{201}a_3$ and the third intake-side rocker arm $\mathbf{203}_3$ swingably carried on the support sleeve $\mathbf{201}a_3$ and is switchably operated on an operating axis perpendicular to the axis of the intake-side rocker arm shaft $\mathbf{28}_I$ in response to the releasing and application of a hydraulic pressure from and to an oil passage $\mathbf{192}_{I2}$ provided in the intake-side rocker arm shaft $\mathbf{28}_I$ and isolated from the oil passage $\mathbf{209}_I$ and $\mathbf{192}_{I1}$.

In such valve operating device for the intake valves $V_{I1}$ and $V_{I2}$, if the connection switchover means $\mathbf{230}_I$, $\mathbf{180}_I$ and $\mathbf{180}_{I2}$ are brought into their disconnecting states, the intake valves $V_{I1}$ and $V_{I2}$ are stopped by the stopping cams 22, 22. If the connection switchover means $\mathbf{230}_1$ is operated into its connecting state and the connection switchover means $\mathbf{180}_I$ and $\mathbf{180}_{I2}$ are brought into their disconnecting states, the one intake valve $V_{I1}$ is opened and closed with a characteristic corresponding to the profile of the low-speed cam 65, while the other intake valve $V_{I2}$ remains stopped. If the connection switchover means $\mathbf{230}_I$ and $\mathbf{180}_{I1}$ are operated into their connecting states and the connection switchover means $\mathbf{180}_{I2}$ is brought into its disconnecting state, the intake valves $V_{I1}$ and $V_{I2}$ are opened and closed with the characteristic corresponding to the profile of the low-speed cam 65. Further, if all the connection switchover means $\mathbf{230}_I$, $\mathbf{180}_I$ and $\mathbf{180}_{I2}$ are operated into their connecting states, the intake valves $V_{I1}$ and $V_{I2}$ are opened and closed with a characteristic corresponding to the profile of the high-speed cam 66.

On the other hand, a first exhaust-side rocker arm 221-6 is swingably carried on an exhaust-side rocker arm shaft $\mathbf{28}_E$ and has a support sleeve 221a-6 integrally provided thereon with its inner surface put into sliding contact with an outer surface of the rocker arm shaft $\mathbf{28}_E$. Second and third exhaust-side rocker arms $\mathbf{222}_E$ and $\mathbf{223}_E$ are swingably carried on the support sleeve 221a-6. A fourth exhaust-side rocker arm 224 is swingably carried on the exhaust-side rocker arm shaft $\mathbf{28}_E$ adjacent the first exhaust-side rocker arm 221-6 on the opposite side from the second and third exhaust-side rocker arms $\mathbf{222}_E$ and $\mathbf{223}_E$. Exhaust valves $V_{E1}$ and $V_{E2}$ are operatively connected to the second and fourth exhaust-side rocker arms 222-6 and 224.

The cam shaft 21 is provided with a low-speed cam 65 with which a roller 228 supported by a pin (not shown) on the first exhaust rocker arm 221-6 at a location between the roller 205 of the first intake-side rocker arm $\mathbf{201}_3$ and the slide contact portion 238 of the second intake-side rocker arm $\mathbf{202}_3$ is put into rolling contact, and a high-speed cam 66 with which a roller 243 supported by a pin (not shown) on the third exhaust rocker arm 223-6 is put into rolling contact. A slide contact portion 239 is provided on the second exhaust-side rocker arm 222-6 to come into sliding contact with the stopping cam 22 common to the slide contact portion 242 of the fourth intake-side rocker arm 204, and a slide contact portion of a reduced width is provided on the fourth exhaust-side rocker arm 224 to come into sliding contact with the stopping cam 22 common to the slide contact portion 238 of the second intake-side rocker arm $\mathbf{202}_3$.

A connection switchover means $\mathbf{180}_E$ having an operating axis parallel to the exhaust-side rocker arm shaft $\mathbf{28}_E$ is provided between the first and fourth exhaust-side rocker arms 221-6 and 224 and capable to switching over the connection and disconnection of the rocker arms 221-6 and 224 to and from each other in response to the releasing and application of a hydraulic pressure from and to an oil passage $\mathbf{209}_E$ provided in the exhaust-side rocker arm shaft $\mathbf{28}_E$.

A connection switchover means $\mathbf{180}_{E1}$ is provided between the support sleeve 221a-6 integral with the first exhaust-side rocker arm 221-6 and the second exhaust-side rocker arm 222-6 swingably carried on the support sleeve 221a-6 and is switchably operated on an operating axis perpendicular to an axis of he exhaust-side rocker arm shaft $28_E$ in response to the releasing and application of a hydraulic pressure from and to an oil passage $192_{E1}$ provided in the exhaust-side rocker arm shaft $28_E$ and isolated from the oil passage $209_E$. Further, a connection switchover means $180_{E2}$ is provided between the support sleeve 221a-6 and the third exhaust-side rocker arm 223-6 and is switchably operated on an operating axis perpendicular to an axis of he exhaust-side rocker arm shaft $28_E$ in response to the releasing and application of a hydraulic pressure from and to an oil passage $192_{E2}$ provided in the exhaust-side rocker arm shaft $28_E$ and isolated from the oil passages $209_E$ and $192_{E1}$.

In such valve operating device for the exhaust valves $V_{E1}$ and $V_{E2}$, if all the connection switchover means $230_E$, $180_{E1}$ and $180_{E2}$ are operated into their connecting states, the exhaust valves $V_{E1}$ and $V_{E2}$ are opened and closed with a characteristic corresponding to the profile of the high-speed cam 66.

Figure 53:
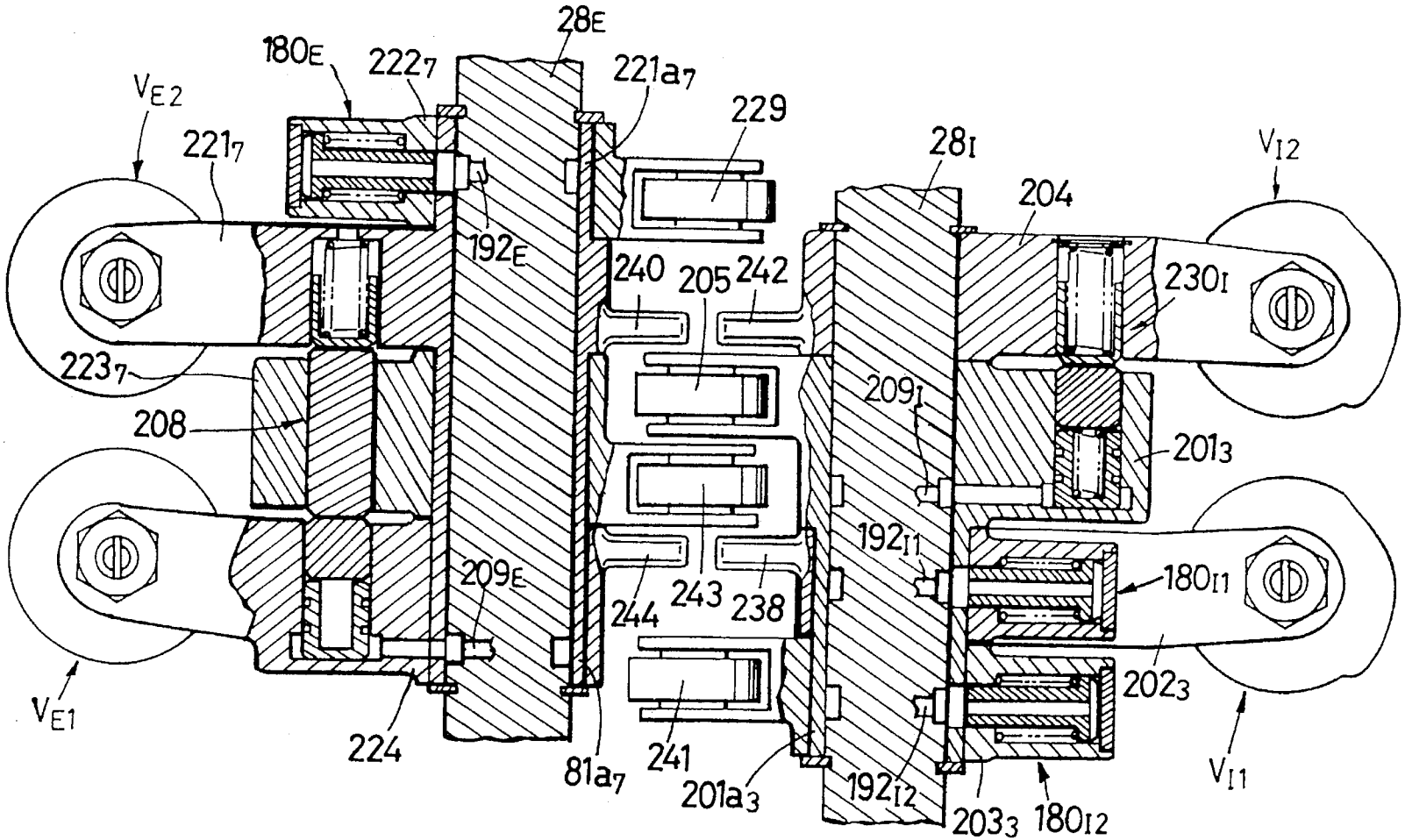
FIG. 53 is a cross-sectional plan view of a 28th embodiment of the present invention.

FIG. 53 illustrates a 28th embodiment of the present invention, wherein portions or components corresponding to those in the above-described 27th embodiment are designated by like reference characters.

In this 28th embodiment, the construction for changing the combination of operating characteristics of the intake valves $V_{I1}$ and $V_{I2}$ and the arrangement of cams on a cam shaft 21 are similar to those in the 27th embodiment.

On the other hand, a first exhaust-side rocker arm $221_7$ is swingably carried on an exhaust-side rocker arm shaft $28_E$ and a support sleeve $221a_7$ integrally provided thereon to extend in laterally opposite directions, and an exhaust valve $V_{E2}$ is operatively connected to the first exhaust-side rocker arm $221_7$. A second exhaust-side rocker arm $222_7$ is swingably carried on the support sleeve $221a_7$ on one side of the first exhaust-side rocker arm $221_7$, and a third exhaust-side rocker arm $223_7$ and a fourth exhaust-side rocker arm 224 operatively connected to an exhaust valve $V_{E1}$ are swingably carried on the support sleeve $221a_7$ on the other side of the first exhaust-side rocker arm $221_7$.

A connection switchover means 208 having an operating axis parallel to the exhaust-side rocker arm shaft $28_E$ is provided in the first, second and third exhaust-side rocker arms $221_7$, $222_7$ and 224 and capable of switching the connection and disconnection of the rocker arms $221_7$, $222_7$ and 224 to and from one another in response to the releasing and application of a hydraulic pressure from and to an oil passage 209E provided in the exhaust-side rocker arm shaft $28_E$.

A connection switchover means $180_E$ is also provided between the support sleeve $221a_7$ integral with the first exhaust-side rocker arm $221_7$ and the second exhaust-side rocker arm $222_7$ swingably carried on the support sleeve $221a_7$ and is switchably operated on an operating axis perpendicular to an axis of the exhaust-side rocker arm shaft $28_E$ in response to the releasing and application of a hydraulic pressure from and to an oil passage $192_E$ provided in the exhaust-side rocker arm shaft $28_E$ and isolated from the oil passage $209_E$.

In such valve operating device for the exhaust valves $V_{E1}$ and $V_{E2}$, if the connection switchover means 208 and $180_E$ are brought into their disconnecting states, the exhaust valves $V_{E1}$ and $V_{E2}$ are stopped by the stopping cams 22, 22. If the connection switchover means 208 is operated into its connecting state and the connection switchover means $180_E$ is brought into its disconnecting state, the exhaust valves $V_{E1}$ and $V_{E2}$ are opened and closed with a characteristic corresponding to the profile of the low-speed cam 65. If the connection switchover means 208 and $180_E$ are operated to their connecting states, the exhaust valves $V_{E1}$ and $V_{E2}$ are opened and closed with a characteristic corresponding to the profile of the high-speed cam 66.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating device for an internal combustion engine, comprising: a plurality of rocker arms including at least first, second and third rocker arms adjacently disposed for swinging movement about a common axis; a plurality of cams provided on a cam shaft in independent correspondence to said rocker arms; and a connection switchover means capable of switching over between a connection and a disconnection of said rocker arms in various combinations, wherein said connection switchover means includes: a switchover piston slidably fitted into said first rocker arm operatively connected to an engine valve and having one end facing a hydraulic pressure chamber; a switchover pin slidably fitted into said second rocker arm adjacent said first rocker arm and having one end abutting against the other end of said switchover piston; and a limiting mechanism which is slidably fitted into said third rocker arm operatively connected to another engine valve and adjoining said second rocker arm on an opposite side from said first rocker arm, and said limiting mechanism abuts against the other end of said switchover pin; said limiting mechanism including a spring biasing mechanism provided in said third rocker arm for biasing said limiting mechanism toward said switchover pin, said spring biasing mechanism enabling a sliding stroke of each of said switchover piston, said switchover pin and said limiting mechanism to be changed at two stages in response to increasing of the hydraulic pressure at two stages in said hydraulic pressure chamber; said switchover pin having an axial length such that when a one axial end of the switchover pin has been fitted into one of said first and third rocker arms, the other axial end of the switchover pin is located between the other of said first and third rocker arms and said second rocker arm, wherein at least two of said rocker arms are held in a connected state by said switchover pin in all operation ranges of the engine and said second rocker arm is one of said at least two of said rocker arms.

2. A valve operating device according to claim 1, wherein said limiting mechanism comprises a first limiting member abutting against the other end of said switchover pin and a second limiting member, and wherein said spring biasing mechanism comprises a first spring interposed under compression between said first and second limiting members and a second spring for urging said second limiting member toward said first limiting member, said first spring having a spring force set smaller than a spring force of said second spring and acting on the first limiting member to separate the first limiting member from said second limiting member by a distance that corresponds to an amount of said switchover pin fitted into said first rocker arm when the other end of the switchover pin is located between the second and third rocker arms.

* * * * *